US006764816B2

(12) United States Patent
Ohzeki

(10) Patent No.: US 6,764,816 B2
(45) Date of Patent: Jul. 20, 2004

(54) THERMALLY DEVELOPABLE PHOTOSENSITIVE MATERIAL

(75) Inventor: Tomoyuki Ohzeki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/102,886

(22) Filed: Mar. 22, 2002

(65) Prior Publication Data

US 2002/0197570 A1 Dec. 26, 2002

(30) Foreign Application Priority Data

Mar. 23, 2001 (JP) ..... 2001-086161

(51) Int. Cl.[7] ..... G03C 1/498; G03C 1/34

(52) U.S. Cl. ..... 430/619; 430/598; 430/601; 430/607; 430/611; 430/613; 430/614

(58) Field of Search ..... 430/600, 611, 430/607, 598, 613, 614, 619, 965, 601

(56) References Cited

U.S. PATENT DOCUMENTS 2,910,377 A 10/1959 Owen
3,152,904 A 10/1964 Sorensen et al.
3,457,075 A 7/1969 Morgan et al.
6,054,260 A * 4/2000 Adin et al. ..... 430/583
6,174,663 B1 * 1/2001 Kato ..... 430/619
6,203,972 B1 * 3/2001 Katoh et al. ..... 430/619

* cited by examiner

*Primary Examiner*—Thorl Chea
(74) *Attorney, Agent, or Firm*—Birch, Stewart, Kolasch & Birch, LLP

(57) ABSTRACT

The present invention provides a thermally developable photosensitive material including a support, the image-forming layer containing a non-photosensitive organic silver salt, a photosensitive silver halide, a reducing agent, a binder and a compound represented by the following formula (I), wherein after the material is exposed and thermally developed at 121° C. for 24 seconds, at least 90% of the developed silver is in contact with the photosensitive silver halide grains after development;

$$(X)_k(L)_m(A—B)_n \qquad \text{Formula (I)}$$

wherein:

X represents a silver halide-adsorbing group or light-absorbing group; L represents a (k+n)-valent linking group; A represents an electron-donating group, B represents a leaving group or a hydrogen atom, and after oxidized, (A—B) is eliminated or deprotonated to form a radical A'; and k falls between 0 and 3; m represents 0 or 1; n represents 1 or 2, but if k=0 and n=1, then m=0.

20 Claims, No Drawings

THERMALLY DEVELOPABLE PHOTOSENSITIVE MATERIAL

BACKGROUND OF THE INVENTION

1. Field of the Invention

The present invention relates to a thermally developable photosensitive material. More specifically, the invention relates to a thermally developable photosensitive material which exhibits high sensitivity and excellent blue black image tone as well as has good photographic performance and good image storability.

2. Description of the Related Art

In recent years, in the fields of films for medical diagnosis and photographic films for plate-making, it has been strongly desired, from the standpoints of environmental protection and space-saving, to reduce the volume of processing waste fluids. Thus, there is a need for technologies relating to thermally developable photosensitive materials (heat development-type photosensitive materials), as films for medical diagnosis or photographic films for plate-making which can be efficiently exposed by a laser image setter or a laser imager to form clear black images having high resolution and sharpness. These thermally developable photosensitive materials are advantageous in providing customers with a thermal processing system that does not need liquid-type processing solutions, and which is simple and not harmful to the environment.

There is also a need for the same technologies in the field of ordinary image forming materials. In particular in the field of medical diagnosis, which requires detail depiction, high quality images excellent in sharpness and graininess are needed and blue black image tone is desired in view of diagnosing readiness. Currently, various types of hard copy systems using pigments and dyes, for example, ink jet printers and electrophotographic systems are widely used as the ordinary imaging system. However, satisfactory systems for outputting images for use in medical diagnosis have never been developed.

On the other hand, thermally developable image forming systems using organic silver salts are described, for example, in U.S. Pat. Nos. 3,152,904 and 3,457,075, and in "Thermally Processed Silver Systems (Imaging Processes and Materials)" written by D. Klosterboer, Neblette, 8th Ed., edited by J. Sturge, V. Walworth & A. Shepp, Chap. 9, p. 279, 1989. In general, thermally developable photosensitive materials have a photosensitive layer (image-forming layer) produced by dispersing a catalytically active amount of a photocatalyst (e.g., silver halide), a reducing agent, a reducible silver salt (e.g., organic silver salt), and optionally a toning agent for adjusting silver color tone in a binder matrix. Thermally developable photosensitive materials of this type are, after having been imagewise exposed, heated to an elevated temperature (for example, at 80° C. or higher) to form black silver images through redox reaction between a reducible silver salt (serving as an oxidizing agent) and a reducing agent. The redox reaction is accelerated by catalytic action of latent images which have been formed on silver halides exposed. Therefore, the black silver images are formed in the exposed area. This technique is disclosed in many references, such as U.S. Pat. No. 2,910,377 and JP-B No.43-4924.

Thermally developable photosensitive materials do not require processing agents and do not discharge a large amount of wastes, whereby the materials have widely spread in the market as a good system to reduce burden on environment, which is currently a matter of concern. In particular, images used for medical diagnosis are required to achieve detail depiction to produce high quality images which have excellent sharpness and graininess. In addition, in view of readiness in diagnosing, blue black image tone is preferred in the field of medical diagnosis. From the foregoing, in the field of medical diagnosis, there have been a demand to produce thermally developable photosensitive materials which fulfill the requirements of exhibiting low fog, good storability, high sensitivity, high maximum density (Dmax) and excellent silver color tone, further has reduced dependency on temperature and humidity conditions during development, and hence are most suitable for medically diagnostic imaging.

SUMMARY OF THE PRESENT INVENTION

In view of the prior art problems stated above, it is an object of the present invention to provide a thermally developable photosensitive material which exhibits low fog, good storability, high sensitivity, high maximum density (Dmax) and excellent silver color tone, and further has reduced dependency on temperature and humidity conditions during development, and thus is most suitable for medically diagnostic imaging.

The inventors conducted extensive researches and found that by selectively combining specific components to form an image-forming layer, thermally developable photosensitive materials exerting desired effects can be provided, thereby accomplishing the present invention.

That is, the present invention provides a thermally developable photosensitive material including a support and an image-forming layer disposed on one surface of the support, the image-forming layer containing a non-photosensitive organic silver salt, a photosensitive silver halide, a reducing agent for reducing silver ions, a binder and a compound represented by the following formula (I), wherein after the material is exposed and thermally developed at 121° C. for 24 seconds, at least 90% of the developed silver is in contact with the photosensitive silver halide grains after development;

$$(X)_k(-L)_m(-A—B)_n \qquad \text{Formula (I)}$$

wherein X represents a silver halide-adsorbing group or light-absorbing group having at least one atom of N, S, P, Se and Te; L represents a (k+n)-valent linking group having at least one atom of C, N, S and O; A represents an electron-donating group, B represents a leaving group or a hydrogen atom, and after the compound represented by formula (I) is oxidized, (A—B) is eliminated, or eliminated and further deprotonated to form a radical A'; and k falls between 0 and 3; m represents 0 or 1; n represents 1 or 2, with a proviso that if k=0 and n=1, then m=0.

The phrase "falling between ~ and ~" as used herein includes both upper and lower limits of a given numerical range.

DESCRIPTION OF THE PREFERRED EMBODIMENTS

The thermally developable photosensitive material of the present invention is described in detail hereinafter.

The thermally developable photosensitive material of the present invention includes a support and an image-forming layer disposed on one surface of the support, and the image-forming layer contains a non-photosensitive organic silver salt (hereinafter occasionally referred to as "organic silver salt"), a photosensitive silver halide, a reducing agent for reducing silver ions, a binder and a compound represented by formula (I). If the aforementioned requirements are fulfilled, the thermally developable photosensitive material of the present invention provides the advantages of exhibiting low fog, good storability, high sensitivity, high maximum density (Dmax) and excellent silver color tone, and further has reduced dependency on temperature and humidity conditions during development.

The thermally developable photosensitive material of the present invention is required that after having been exposed and thermally developed under the conditions of at 121° C. for 24 seconds, at least 90% of the developed silver is in contact with the photosensitive silver halide grains after development. By fulfilling the requirements stated above, the thermally developable photosensitive material of the present invention has an advantage of achieving outputted silver images of blue black tone, which is most suitable for medically diagnostic imaging. The term "developed silver" as used herein refers to silver that is produced from a non-photosensitive organic silver salt through thermal development of the thermally developable photosensitive material.

The proportion of the developed silver in contact with the silver halide grains after development can be obtained as follows: After exposed and thermally developed, the material is cut out at the Dmax portion with a diamond knife, in the direction perpendicular to the support of the material to prepare ultra-thin sections. Each section has a thickness falling between 0.1 and 0.2 $\mu$m, and its length and width are arbitrarily defined. Next, the ultra-thin section is placed on a mesh for observation with a transmission electronic microscope to count the number (x) of the developed silver in contact with the silver halide grains, and the number (y) of the developed silver having no contact with the grains, respectively. The proportion can be obtained by calculating the ratio of the number (x) of the developed silver in contact with the silver halide grains to the number (x+y) of all the developed silver, i.e., (100x/(x+y)).

The constitutive components to prepare a thermally developable photosensitive material of the present invention are described hereinafter.

First, the compound represented by formula (I) for preparing the thermally developable photosensitive material of the present invention is described.

In formula (I), X represents a silver halide-adsorbing group or light-absorbing group having at least one atom of N, S, P, Se and Te.

Preferably, X is a silver halide-adsorbing group having at least one atom of N, S, P, Se and Te and having a silver ion ligand structure. As the silver halide-adsorbing group having a silver ion ligand structure, there are mentioned, for example, the groups represented by the following formulae.

$$—G^1—Z^1—Y^1$$ Formula (X-1)

wherein $G^1$ represents a divalent linking group, such as a substituted or unsubstituted alkylene group, alkenylene group, alkynylene group or arylene group, an $SO_2$ group, or a divalent heterocyclic group; $Z^1$ represents an atom of S, Se or Te; $Y^1$ represents a hydrogen atom or a counter ion such as a sodium ion, potassium ion, lithium ion or ammonium ion in case where $Z^1$ is a dissociated form.

Formula (X-2a)

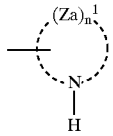

Formula (X-2b)

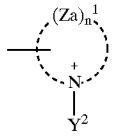

The groups represented by formula (X-2a) and formula (X-2b) shown above have a 5- to 7-membered heterocyclic or unsaturated ring. In the above formulae (X-2a) and (X-2b), Za represents an atom of O, N, S, Se or Te; $n^1$ falls between 0 and 3; and $Y^2$ represents a hydrogen atom, an alkyl group, an alkenyl group, an alkynyl group or an aryl group.

$$—Y^3—(Z^2)n^2—Y^4$$ Formula (X-3)

wherein $Z^2$ represents an atom of S, Se or Te; $n^2$ falls between 1 and 3; $Y^3$ represents a divalent linking group, such as an alkylene group, an alkenylene group, an alkynylene group, an arylene group, or a divalent heterocyclic group; and $Y^4$ represents an alkyl group, an aryl group, or a heterocyclic group.

Formula (X-4)

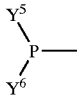

wherein $Y^5$ and $Y^6$ each independently represent an alkyl group, an alkenyl group, an arylene group or a heterocyclic group.

Formula (X-5a)

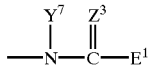

Formula (X-5b)

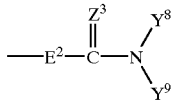

wherein $Z^3$ represents an atom of S, Se or Te; $E^1$ represents a hydrogen atom, $NH_2$, $NHY^{10}$, $N(Y^{10})_2$, $NHN(Y^{10})_2$, $OY^{10}$ or $SY^{10}$; $E^2$ represents a divalent linking group, such as NH, $NY^{10}$, $NHNY^{10}$, O or S; $Y^7$, $Y^8$ and $Y^9$ each independently represent a hydrogen atom, an alkyl group, an alkenyl group, an aryl group or a heterocyclic group; $Y^8$ and $Y^9$ may be bonded to each other to form a ring; and $Y^{10}$ represents a hydrogen atom, an alkyl group, an alkenyl group, an aryl group or a heterocyclic group.

Formula (X-6a)

$$—Y^{11}—C\equiv H$$

-continued

Formula (X-6b)

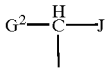

wherein $Y^{11}$ represents a divalent linking group, such as an alkylene group, an alkenylene group, an alkynylene group, an arylene group, or a divalent heterocyclic group; $G^2$ and J each independently represent $COOY^{12}$, $SO_2Y^{12}$, $COY^{12}$, $SOY^{12}$, CN, CHO or $NO_2$; and $Y^{12}$ represents an alkyl group, an alkenyl group or an aryl group.

Formula (X-1) is described in detail. In the formula, the linking group represented by $G^1$ includes, for example, a substituted or unsubstituted, linear or branched alkylene group having 1 to 20 carbon atoms (e.g., methylene, ethylene, trimethylene, propylene, tetramethylene, hexamethylene, 3-oxapentylene or 2-hydroxytrimethylene group), a substituted or unsubstituted cyclic alkylene group having 3 to 18 carbon atoms (e.g., cyclopropylene, cyclopentylene or cyclohexylene group), a substituted or unsubstituted alkenylene group having 2 to 20 carbon atoms (e.g., ethene or 2-butenylene group), an alkynylene group having 2 to 10 carbon atoms (e.g., ethynylene group), and a substituted or unsubstituted arylene group having 6 to 20 carbon atoms (e.g., unsubstituted p-phenylene or unsubstituted 2,5-naphthylene group).

In formula (X-1), the group $SO_2$ represented by $G^1$ includes, in addition to the group —$SO_2$—, the group —$SO_2$— bonded to any of a substituted or unsubstituted, linear or branched alkylene group having 1 to 10 carbon atoms, a substituted or unsubstituted cyclic alkylene group having from 3 to 6 carbon atoms, and an alkenylene group having 2 to 10 carbon atoms.

In formula (X-1), the divalent heterocyclic group represented by $G^1$ may be unsubstituted or substituted with any of an alkylene group, an alkenylene group, an arylene group and a heterocyclic group, or may be condensed with benzene ring or naphthalene ring (e.g., 2,3-tetrazole-diyl, 1,3-triazole-diyl, 1,2-imidazole-diyl, 3,5-oxadiazole-diyl, 2,4-thiazole-diyl, 1,5-benzimidazole-diyl, 2,5-benzothiazole-diyl, 2,5-benzoxazole-diyl, 2,5-pyrimidine-diyl, 3-phenyl-2,5-tetrazole-diyl, 2,5-pyridine-diyl, 2,4-furan-diyl, 1,3-piperidine-diyl or 2,4-morpholine-diyl group).

In formula (X-1), the alkylene group, the alkenylene group, the alkynylene group, the arylene group, the group $SO_2$ and the divalent heterocyclic group represented by $G^1$ may optionally be substituted. The substituents for these groups are mentioned below. Those substituents will be hereinafter referred to as "substituent Y".

The substituents include, for example, a halogen atom (e.g., fluorine, chlorine or bromine atom), an alkyl group (e.g., methyl, ethyl, isopropyl, n-propyl or tert-butyl group), an alkenyl group (e.g., allyl or 2-butenyl group), an alkynyl group (e.g., propargyl group), an aralkyl group (e.g., benzyl group), an aryl group (e.g., phenyl, naphthyl or 4-methylphenyl group), a heterocyclic group (e.g., pyridyl, furyl, imidazolyl, piperidinyl or morpholyl group), an alkoxy group (e.g., methoxy, ethoxy, butoxy, 2-ethylhexyloxy, ethoxyethoxy or methoxyethoxy group), an aryloxy group (e.g., phenoxy or 2-naphthyloxy group), an amino group (e.g., unsubstituted amino, dimethylamino, diethylamino, dipropylamino, dibutylamino, ethylamino or anilino group), an acylamino group (e.g., acetylamino or benzoylamino group), an ureido group (e.g., unsubstituted ureido or N-methylureido group), an urethane group (e.g., methoxycarbonylamino or phenoxycarbonylamino group), a sulfonylamino group (e.g., methylsulfonylamino or phenylsulfonylamino group), a sulfamoyl group (e.g., unsubstituted sulfamoyl, N,N-dimethylsulfamoyl or N-phenylsulfamoyl group), a carbamoyl group (e.g., unsubstituted carbamoyl, N,N-diethylcarbamoyl or N-phenylcarbamoyl group), a sulfonyl group (e.g., mesyl or tosyl group), a sulfinyl group (e.g., methylsulfinyl or phenylsulfinyl group), an alkyloxycarbonyl group (e.g., methoxycarbonyl or ethoxycarbonyl group), an aryloxycarbonyl group (e.g., phenoxycarbonyl group), an acyl group (e.g., acetyl, benzoyl, formyl or pivaloyl group), an acyloxy group (e.g., acetoxy or benzoyloxy group), a phosphoric acid amido group (e.g., N,N-diethylphosphoric acid amido group), a cyano group, a sulfo group, a thiosulfonic acid group, a sulfinic acid group, a carboxyl group, a hydroxyl group, a phosphono group, a nitro group, an ammonio group, a phosphonio group, a hydrazino group, and a thiazolino group. In case where the group represented by $G^1$ has two or more substituents, the substituents may be the same or different and may further have substituents.

Preferred examples of formula (X-1) are shown below.

For preferable formula (X-1), $G^1$ is a substituted or unsubstituted arylene group having 6 to 10 carbon atoms, or is a 5- to 7-membered heterocyclic group which is unsubstituted, or bonded to an alkylene group or an arylene group, or condensed with benzene ring or naphthalene ring; $Z^1$ is S or Se; $Y^1$ is a hydrogen atom, or a sodium or potassium ion.

More preferably, $G^1$ is a substituted or unsubstituted arylene group having 6 to 8 carbon atoms, or is a 5- or 6-membered heterocyclic group bonded to an arylene group or condensed with benzene ring, most preferably, it is a 5- or 6-membered heterocyclic group bonded to an arylene group or condensed with benzene ring. Also preferably, $Z^1$ is S, and $Y^1$ is a hydrogen atom or a sodium ion.

Formulae (X-2a) and (X-2b) are described in detail below.

In these formulae, the alkyl group, the alkenyl group and the alkynyl group represented by $Y^2$ may be, for example, a substituted or unsubstituted, linear or branched alkyl group having 1 to 10 carbon atoms (e.g., methyl, ethyl, isopropyl, n-propyl, n-butyl, tert-butyl, 2-pentyl, n-hexyl, n-octyl, tert-octyl, 2-ethylhexyl, 2-hydroxyethyl, 1-hydroxyethyl, diethylaminoethyl, n-butoxypropyl or methoxymethyl group), a substituted or unsubstituted cyclic alkyl group having 3 to 6 carbon atoms (e.g., cyclopropyl, cyclopentyl or cyclohexyl group), an alkenyl group having 2 to 10 carbon atoms (e.g., allyl, 2-butenyl or 3-pentenyl group), an alkynyl group having 2 to 10 carbon atoms (e.g., propargyl or 3-pentynyl group), and an aralkyl group having 6 to 12 carbon atoms (e.g., benzyl group). The aryl group may be, for example, a substituted or unsubstituted aryl group having 6 to 12 carbon atoms (e.g., hydroxyphenyl or 4-methylhydroxyphenyl group).

$Y^2$ may further have a substituent such as Y.

Preferred examples of formulae (X-2a) and (X-2b) are mentioned below.

In these formulae, $Y^2$ is preferably a hydrogen atom, a substituted or unsubstituted alkyl group having 1 to 6 carbon atoms, or a substituted or unsubstituted aryl group having 6 to 10 carbon atoms; Za is O, N or S; and $n^1$ falls between 1 and 3.

More preferably, $Y^2$ is a hydrogen atom, or an alkyl group having 1 to 4 carbon atoms; Za is N or S; and $n^1$ is 2 or 3.

Formula (X-3) is described in detail below.

In the formula, the linking group represented by $Y^3$ includes, for example, a substituted or unsubstituted, linear or branched alkylene group having 1 to 20 carbon atoms (e.g., methylene, ethylene, trimethylene, isopropylene, tetramethylene, hexamethylene, 3-oxapentylene or 2-hydroxytrimethylene group), a substituted or unsubstituted cyclic alkyl group having 3 to 18 carbon atoms (e.g., cyclopropylene, cyclopentynylene or cyclohexylene group), a substituted or unsubstituted alkenylene group having 2 to 20 carbon atoms (e.g., ethene or 2-butenylene group), an alkynylene group having 2 to 10 carbon atoms (e.g., ethynylene group), and a substituted or unsubstituted arylene group having 6 to 20 carbon atoms (e.g., unsubstituted p-phenylene or unsubstituted 2,5-naphthyleneb group). The heterocyclic group may be unsubstituted, or may be substituted with any of an alkylene group, an alkenylene group, an arylene group and an additional heterocyclic group (e.g., 2,5-pyridine-diyl, 3-phenyl-2,5-pyridine-diyl, 1,3-piperidine-diyl or 2,4-morpholine-diyl group).

In formula (X-3), the alkyl group represented by $Y^4$ includes, for example, a substituted or unsubstituted, linear or branched alkyl group having 1 to 10 carbon atoms (e.g., methyl, ethyl, isopropyl, n-propyl, n-butyl, tert-butyl, 2-pentyl, n-hexyl, n-octyl, tert-octyl, 2-ethylhexyl, 2-hydroxyethyl, 1-hydroxyethyl, diethylaminoethyl, dibutylaminoethyl, n-butoxymethyl or methoxymethyl group), and a substituted or unsubstituted cyclic alkyl group having 3 to 6 carbon atoms (e.g., cyclopropyl, cyclopentyl or cyclohexyl group); and the aryl group may be, for example, a substituted or unsubstituted aryl group having 6 to 12 carbon atoms (e.g., unsubstituted phenyl or 2-methylphenyl group).

The heterocyclic group represented by $Y^4$ may be unsubstituted or substituted with any of an alkyl group, an alkenyl group, an aryl group and an additional heterocyclic group (e.g., pyridyl, 3-phenylpyridyl, piperidyl or morpholyl group).

$Y^4$ may further have a substituent such as Y.

Preferred examples of formula (X-3) are mentioned below.

In the formula, $Y^3$ is preferably a substituted or unsubstituted alkylene group having 1 to 6 carbon atoms, or a substituted or unsubstituted arylene group having 6 to 10 carbon atoms; $Y^4$ is a substituted or unsubstituted alkyl group having 1 to 6 carbon atoms, or a substituted or unsubstituted aryl group having 6 to 10 carbon atoms; $Z^2$ is S or Se; and $n^2$ falls between 1 and 2.

More preferably, $Y^3$ is an alkylene group having 1 to 4 carbon atoms; $Y^4$ is an alkyl group having 1 to 4 carbon atoms; $Z^2$ is S; and $n^2$ is 1.

Formula (X-4) is described in detail below.

In the formula, the alkyl group and the alkenyl group represented by $Y^5$ and $Y^6$ include, for example, a substituted or unsubstituted, linear or branched alkyl group having from 1 to 10 carbon atoms (e.g., methyl, ethyl, isopropyl, n-propyl, n-butyl, tert-butyl, 2-pentyl, n-hexyl, n-octyl, tert-octyl, 2-ethylhexyl, hydroxymethyl, 2-hydroxyethyl, 1-hydroxyethyl, diethylaminoethyl, dibutylaminoethyl, n-butoxymethyl, n-butoxypropyl or methoxymethyl group), a substituted or unsubstituted cyclic alkyl group having 3 to 6 carbon atoms (e.g., cyclopropyl, cyclopentyl or cyclohexyl group), and an alkenyl group having 2 to 10 carbon atoms (e.g., allyl, 2-butenyl or 3-pentenyl group). The aryl group represented by $Y^5$ or $Y^6$ may be, for example, a substituted or unsubstituted aryl group having 6 to 12 carbon atoms (e.g., unsubstituted phenyl or 4-methylphenyl group); and the heterocyclic group may be unsubstituted or substituted with any of an alkylene group, an alkenylene group, an arylene group and an additional heterocyclic group (e.g., pyridyl, 3-phenylpyridyl, furyl, piperidyl or morpholino group).

In formula (X-4), $Y^5$ and $Y^6$ may further have a substituent such as Y.

Preferred examples of formula (X-4) are mentioned below.

In the formula, $Y^5$ and $Y^6$ are preferably substituted or unsubstituted alkyl groups having 1 to 6 carbon atoms, or a substituted or unsubstituted aryl group having 6 to 10 carbon atoms.

More preferably, $Y^5$ and $Y^6$ are aryl groups having 6 to 8 carbon atoms.

Next, formulae (X-5a) and (X-5b) are described in detail. In these formulae, the group $E^1$ includes, for example, $NH_2$, $NHCH_3$, $NHC_2H_5$, NHPh, $N(CH_3)_2$, $N(Ph)_2$, $NHNHC_3H_7$, NHNHPh, $OC_4H_9$, OPh and $SCH_3$; and $E^2$ includes, for example, NH, $NCH_3$, $NC_2H_5$, NPh, $NHNC_3H_7$, and NHNPh. "Ph" as used herein refers to a phenyl group.

In formulae (X-5a) and (X-5b), the alkyl group and the alkenyl group represented by $Y^7$, $Y^8$ and $Y^9$ include, for example, a substituted or unsubstituted, linear or branched alkyl group having 1 to 10 carbon atoms (e.g., methyl, ethyl, isopropyl, n-propyl, n-butyl, tert-butyl, 2-pentyl, n-hexyl, n-octyl, tert-octyl, 2-ethylhexyl, hydroxymethyl, 2-hydroxyethyl, 1-hydroxyethyl, diethylaminoethyl, dibutylaminoethyl, n-butoxymethyl, n-butoxypropyl, methoxymethyl group), a substituted or unsubstituted cyclic alkyl group having 3 to 6 carbon atoms (e.g., cyclopropyl, cyclopentyl or cyclohexyl group), and an alkenyl group having 2 to 10 carbon atoms (e.g., allyl, 2-butenyl or 3-pentenyl group). The aryl group may be, for example, a substituted or unsubstituted aryl group having 6 to 12 carbon atoms (e.g., unsubstituted phenyl or 4-methylphenyl group). The heterocyclic group may be unsubstituted or substituted with any of an alkylene group, an alkenylene group, an arylene group and an additional heterocyclic group (e.g., pyridyl, 3-phenylpyridyl, furyl, piperidyl or morpholyl group).

In formulae (X-5a) and (X-5b), $Y^7$, $Y^8$ and $Y^9$ may further have a substituent such as Y.

Preferred examples of formulae (X-5a) and (X-5b) are mentioned below.

In these formulae, $E^1$ is preferably an alkyl-substituted or unsubstituted amino group or an alkoxy group; $E^2$ is an alkyl-substituted or unsubstituted amino-linking group; $Y^7$, $Y^8$ and $Y^9$ are substituted or unsubstituted alkyl groups having 1 to 6 carbon atoms, or substituted or unsubstituted arylene groups having 6 to 10 carbon atoms; and $Z^3$ is S or Se.

More preferably, $E^1$ is an alkyl-substituted or unsubstituted amino group; $E^2$ is an alkyl-substituted or unsubstituted amino-linking group; $Y^7$, $Y^8$ and $Y^9$ are substituted or unsubstituted alkyl groups having group 1 to 4 carbon atoms; and $Z^3$ is S.

Next, formulae (X-6a) and (X-6b) are described in detail below.

In these formulae, the groups $G^2$ and J include, for example, $COOCH_3$, $COOC_3H_7$, $COOC_6H_{13}$, COOPh, $SO_2CH_3$, $SO_2C_4H_9$, $COC_2H_5$, COPh, $SOCH_3$, SOPh, CN, CHO and $NO_2$.

In these formulae, the linking group represented by $Y^{11}$ includes, for example, a substituted or unsubstituted, linear or branched alkylene group having 1 to 20 carbon atoms (e.g., methylene, ethylene, trimethylene, propylene, tetramethylene, hexamethylene, 3-oxapentylene or 2-hydroxytrimethylene group), a substituted or unsubstituted cyclic alkylene group having 3 to 18 carbon atoms (e.g., cyclopropylene, cyclopentylene or cyclohexylene group), a substituted or unsubstituted alkenylene group having 2 to 20 carbon atoms (e.g., ethene or 2-butenylene group), an alkynylene group having 2 to 10 carbon atoms (e.g., ethynylene group), and a substituted or unsubstituted arylene group having 6 to 20 carbon atoms (e.g., unsubstituted p-phenylene or unsubstituted 2,5-naphthylene group).

In formulae (X-6a) and (X-6b), the divalent heterocyclic group represented by $Y^{11}$ may be unsubstituted or substituted with any of an alkylene group, an alkenylene group, an arylene group and an additional heterocyclic group (e.g., 2,5-pyridine-diyl, 3-phenyl-2,5-pyridine-diyl, 2,4-furan-diyl, 1,3-piperidine-diyl or 2,4-morpholine-diyl group).

In these formulae, $Y^{11}$ may further have a substituent such as Y.

Preferred examples of formulae (X-6a) and (X-6b) are mentioned below.

In these formulae, $G^2$ and J are preferably carboxylic acid esters and carbonyls having 2 to 6 carbon atoms; and $Y^{11}$ is a substituted or unsubstituted alkylene group having 1 to 6 carbon atoms, or a substituted or unsubstituted arylene group having 6 to 10 carbon atoms.

More preferably, $G^2$ and J are carboxylic acid esters having 2 to 4 carbon atoms; and $Y^{11}$ is a substituted or unsubstituted alkylene group having 1 to 4 carbon atoms, or a substituted or unsubstituted arylene group having 6 to 8 carbon atoms.

The order of preference for the silver halide-adsorbing group represented by X is formulae (X-1), (X-2a), (X-2b), (X-3), (X-5a), (X-5b), (X-4), (X-6a) and (X-6b).

Next, the light-absorbing group represented by X in formula (I) is described in detail.

The light-absorbing group represented by X in formula (I) may be represented, for example, by the following formula:

Formula (X-7)

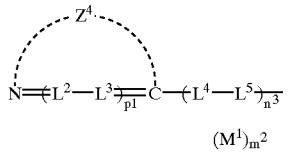

wherein $Z^4$ represents an atomic group necessary for forming a 5- or 6-membered, nitrogen-containing heterocyclic ring; $L^2$, $L^3$, $L^4$ and $L^5$ each represent a methine group; $p^1$ represents 0 or 1; $n^3$ falls between 0 and 3; $M^1$ represents a charge-balancing counter ion; and $m^2$ indicates a number necessary to neutralize the charge of the molecule, which falls between 0 and 10.

In formula (X-7), the 5- or 6-membered, nitrogen-containing heterocyclic ring represented by $Z^4$ includes, for example, thiazolidine, thiazole, benzothiazole, oxazoline, oxazole, benzoxazole, selenazoline, selenazole, benzoselenazole, 3,3-dialkylindolenine (e.g., 3,3-dimethylindolenine), imidazoline, imidazole, benzimidazole, 2-pyridine, 4-pyridine, 2-quinoline, 4-quinoline, 1-isoquinoline, 3-isoquinoline, imidazo[4,5-b] quinoxaline, oxadiazole, thiadiazole, tetrazole and pyrimidine nuclei.

The 5- or 6-membered, nitrogen-containing heterocyclic ring represented by $Z^4$ may have a substituent such as Y stated above.

In formula (X-7), $L^2$, $L^3$, $L^4$ and $L^5$ each independently represent a methine group. The methine group represented by $L^2$, $L^3$, $L^4$ and $L^5$ may have substitutes. The substituents include, for example, a substituted or unsubstituted alkyl group having 1 to 15 carbon atoms (e.g., methyl, ethyl or 2-carboxyethyl group), a substituted or unsubstituted aryl group having 6 to 20 carbon atoms (e.g., phenyl or o-carboxyphenyl group), a substituted or unsubstituted heterocyclic group having 3 to 20 carbon atoms (e.g., N,N-diethylbarbituric acid residue), a halogen atom (e.g., chlorine, bromine, fluorine or iodine atom), an alkoxy group having 1 to 15 carbon atoms (e.g., methoxy or ethoxy group), an alkylthio group having 1 to 15 carbon atoms (e.g., methylthio or ethylthio group), an arylthio group having 6 to 20 carbon atoms (e.g., phenylthio group), and an amino group having 0 to 15 carbon atoms (e.g., N,N-diphenylamino, N-methyl-N-phenylamino or N-methylpiperazine group).

The methine group may form a ring together with another methine group, or may also form a ring together with an additional chemical moiety.

$M^1$ is optionally included in the formula to represent the presence of a cation or anion for neutralizing the ionic charge of the light-absorbing group. Typical examples of the cation are inorganic cations such as hydrogen ion ($H^+$) and alkali metal ions (e.g., sodium ion, potassium ion, lithium ion); and organic cations such as ammonium ions (e.g., ammonium ion, tetraalkylammonium ions, pyridinium ion, ethylpyridinium ion). The anion may also be any of an inorganic anion or an organic anion, including, for example, halogen anions (e.g., fluoride ion, chloride ion, iodide ion), substituted arylsulfonate ions (e.g., p-toluenesulfonate ion, p-chlorobenzenesulfonate ion), aryldisulfonate ions (e.g., 1,3-benzenedisulfonate ion, 1,5-naphthalenedisulfonate ion, 2,6-naphthalenedisulfonate ion), alkylsulfate ion (e.g., methylsulfate ion), sulfate ion, thiocyanate ion, perchlorate ion, tetrafluoroborate ion, picrate ion, acetate ion, and trifluoromethanesulfonate ion. In addition, ionic polymers or light-absorbing groups carrying counter-charged groups may be used.

As used herein, for example, the sulfo group is represented by $SO_3^-$, and the carboxyl group is represented by $CO_2^-$; but when the counter ion is a hydrogen ion, they may be represented by $SO_3H$ and $CO_2H$, respectively.

In formula (X-7), $m^2$ indicates a number necessary to neutralize the charge. In case where a salt is formed in the molecule, m is 0.

Preferred examples of formula (X-7) are mentioned below.

In formula (X-7), $Z^4$ preferably represents a benzoxazole nucleus, a benzothiazole nucleus, a benzimidazole nucleus or a quinoline nucleus; $L^2$, $L^3$, $L^4$ and $L^5$ each represent an unsubstituted methine group; $p^1$ is 0; and $n^3$ is 1 or 2.

More preferably, $Z^4$ represents a benzoxazole nucleus or a benzothiazole nucleus, and $n^3$ is 1. Particularly preferably, $Z^4$ represents a benzothiazole nucleus.

In formula (I), k is preferably 0 or 1, and more preferably 1.

Specific examples of X in formula (I) are listed below, however, X employable in the present invention is not limited thereto.

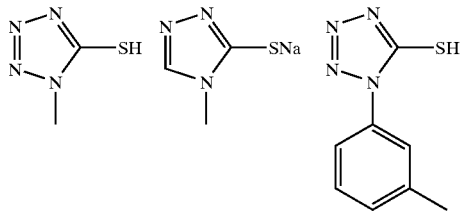

-continued

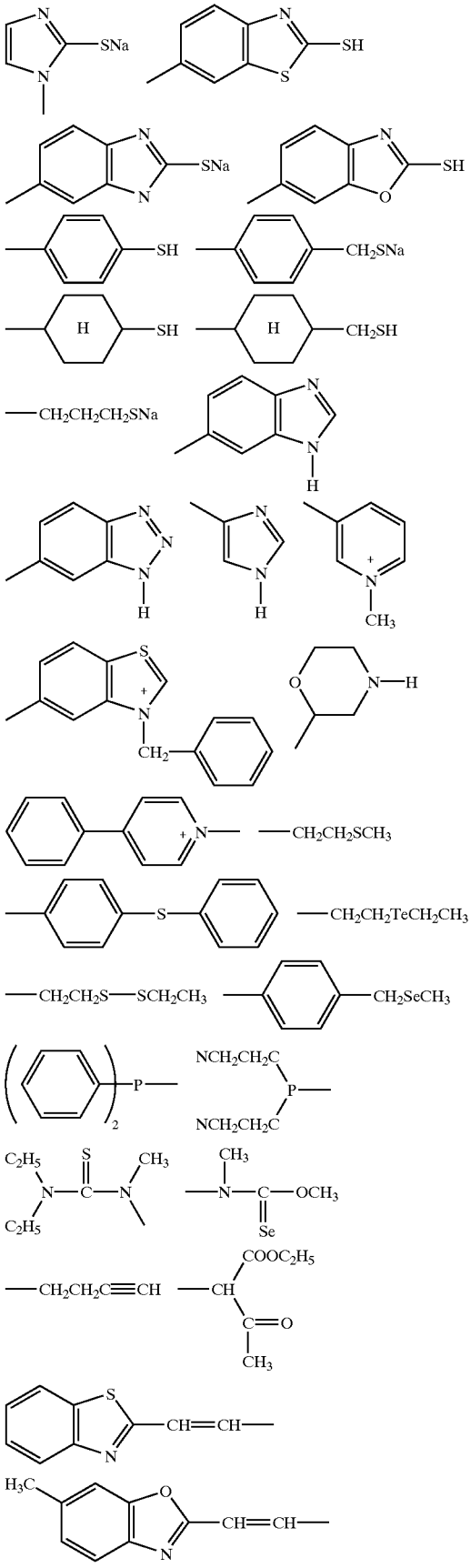

-continued

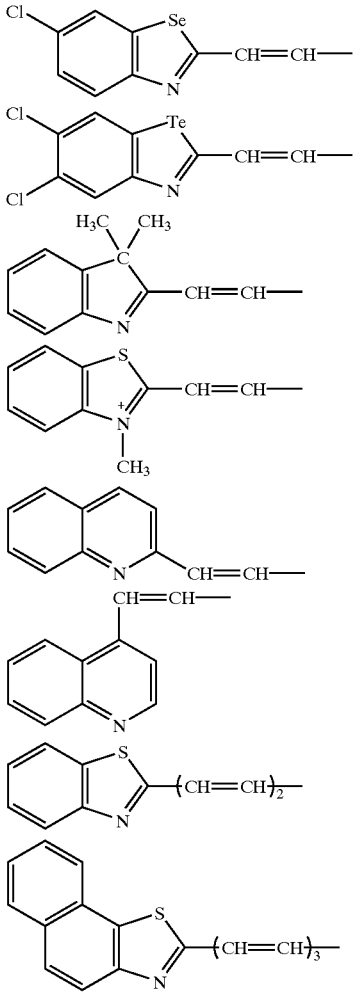

The linking group represented by L in formula (1) is described in detail.

The linking group represented by L in formula (1) includes, for example, a substituted or unsubstituted, linear or branched alkylene group having 1 to 20 carbon atoms (e.g., methylene, ethylene, trimethylene, propylene, tetramethylene, hexamethylene, 3-oxapentylene or 2-hydroxytrimethylene group), a substituted or unsubstituted cyclic alkylene group having 3 to 18 carbon atoms (e.g., cyclopropylene, cyclopentylene or cyclohexylene group), a substituted or unsubstituted alkenylene group having 2 to 20 carbon atoms (e.g., ethene or 2-butenylene group), an alkynylene group having 2 to 10 carbon atoms (e.g., ethynylene group), a substituted or unsubstituted arylene group having 6 to 20 carbon atoms (e.g., unsubstituted p-phenylene or unsubstituted 2,5-naphthylene group), a heterocyclic linking group (e.g., 2,6-pyridine-diyl group), a carbonyl group, a thiocarbonyl group, an imido group, a sulfonyl group, a sulfonyloxy group, an ester group, a thioester group, an amido group, an ether group, a thioether group, an amino group, an ureido group, a thioureido group, and a thiosulfonyl group. These linking groups may be bonded to each other to form additional linking groups.

L may have a substituent such as Y.

The linking group L is preferably an unsubstituted alkylene group having 1 to 10 carbon atoms, or an alkylene group having 1 to 10 carbon atoms bonded to any of an amino group, an amido group, a thioether group, an ureido group and a sulfonyl group. More preferably, it is an unsubstituted alkylene group having 1 to 6 carbon atoms, or an alkylene group having 1 to 6 carbon atoms bonded to any of an amino group, an amido group and a thioether group.

In formula (I), m is preferably 0 or 1, more preferably 1.

Next, the electron-donating group A is described in detail.

The following scheme shows the process in which after the compound represented by formula (I) is oxidized, the moiety (A—B) is eliminated to release an electron and hence produce a radical A', whereby high sensitivity is obtained.

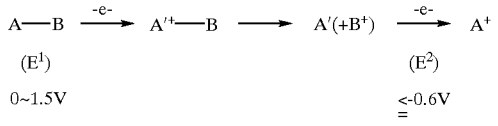

Since A is an electron-donating group, the substituents on the aromatic group of any structure is preferably selected to satisfy the electron-rich condition of A. For example, in case where the aromatic ring does not satisfy the electron-rich condition, it is desirable to introduce an electron-donating group; conversely in case where the aromatic ring has too many electrons like anthracene, it is desirable to introduce an electron-attracting group, so that in both cases the oxidation potential may well be controlled.

Preferably, the group A is represented by any of the following general formulae (A-1), (A-2) and (A-3):

Formula (A-1)

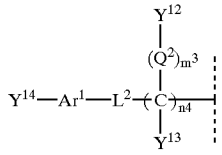

Formula (A-2)

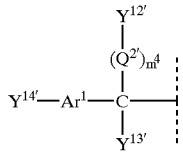

Formula (A-3)

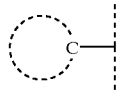

In formulae (A-1) and (A-2), $Y^{12}$, $Y^{12'}$, $Y^{13}$ and $Y^{13'}$ each independently represent a hydrogen atom, or a substituted or unsubstituted alkyl, aryl, alkylene or arylene group; $Y^{14}$ and $Y^{14'}$ each independently represent an alkyl group, COOH, a halogen atom, $N(Y^{15})_2$, $OY^{15}$, $SY^{15}$, CHO, $COY^{15}$, $COOY^{15}$, $CONHY^{15}$, $CON(Y^{15})_2$, $SO_3Y^{15}$, $SO_2NHY^{15}$, $SO_2NY^{15}$, $SO_2Y^{15}$, $SO_2Y^{15}$, or $CSY^{15}$; $Ar^1$ and $Ar^{1'}$ each independently represent an aryl group or a heterocyclic group; $Y^{12}$ and $Y^{13}$, $Y^{12}$ and $Ar^1$, $Y^{12'}$ and $Y^{13'}$, and $Y^{12'}$ and $Ar^{1'}$ may be bonded to each other to form a ring; $Q^2$ and $Q^{2'}$ each independently represent O, S, Se or Te; $m^3$ and $m^4$ each independently indicate 0 or 1; $n^4$ falls between 1 and 3; $L^2$ represents N—R, N—Ar, O, S or Se, and may optionally have a 5- to 7-membered heterocyclic ring or unsaturated ring; and $Y^{15}$ represents a hydrogen atom, an alkyl group or an aryl group. The cyclic structure of formula (A-3) indicates a substituted or unsubstituted, 5- to 7-membered unsaturated ring or heterocyclic ring group.

Formulae (A-1), (A-2) and (A-3) are described in detail. In these formulae, the alkyl group represented by $Y^{12}$, $Y^{12'}$, $Y^{13}$ and $Y^{13'}$ includes, for example, a substituted or unsubstituted, linear or branched alkyl group having 1 to 10 carbon atoms (e.g., methyl, ethyl, isopropyl, n-propyl, n-butyl, tert-butyl, 2-pentyl, n-hexyl n-octyl, tert-octyl, 2-ethylhexyl, 2-hydroxyethyl, 1-hydroxyethyl, diethylaminoethyl, dibutylaminoethyl, n-butoxymethyl or methoxymethyl group), and a substituted or unsubstituted cyclic alkyl group having 3 to 6 carbon atoms (e.g., cyclopropyl, cyclopentyl, cyclohexyl group). The aryl group may be, for example, a substituted or unsubstituted aryl group having 6 to 12 carbon atoms (e.g., unsubstituted phenyl or 2-methylphenyl group).

The alkylene group may be, for example, a substituted or unsubstituted, linear or branched alkylene group having 1 to 10 carbon atoms (e.g., methylene, ethylene, trimethylene, tetramethylene or methoxyethylene group); and the arylene group may be, for example, a substituted or unsubstituted arylene group having 6 to 12 carbon atoms (e.g., unsubstituted phenylene, 2-methylphenylene or naphthylene group).

In formulae (A-1) and (A-2), the groups $Y^{14}$ and $Y^{14'}$ include, for example, an alkyl group (e.g., methyl, ethyl, isopropyl, n-propyl, n-butyl, 2-pentyl, n-hexyl, n-octyl, 2-ethylhexyl, 2-hydroxyethyl or n-butoxymethyl group), COOH group, halogen atoms (e.g., fluorine, chlorine, bromine), OH, $N(CH_3)_2$, $NPh_2$, $OCH_3$, OPh, $SCH_3$, SPh, CHO, $COCH_3$, COPh, $COOC_4H_9$, $COOCH_3$, $CONHC_2H_5$, $CON(CH_3)_2$, $SO_3CH_3$, $SO_3C_3H_7$, $SO_2NHCH_3$, $SO_2N(CH_3)_2$, $SO_2C_2H_5$, $SOCH_3$, CSPh, and $CSCH_3$.

$Ar^1$ and $Ar^{1'}$ in formulae (A-1) and (A-2) include, for example, a substituted or unsubstituted aryl group having 6 to 12 carbon atoms (e.g., phenyl, 2-methylphenyl or naphthyl group), and a substituted or unsubstituted heterocyclic group (e.g., pyridyl, 3-phenylpyridyl, piperidyl or morpholyl group).

$L^2$ in formulae (A-1) and (A-2) include, for example, NH, $NCH_3$, $NC_4H_9$, $NC_3H_7$(i), NPh, NPh-$CH_3$, O, S, Se and Te.

The cyclic structure of formula (A-3) includes an unsaturated 5- to 7-membered ring and a heterocyclic ring (e.g., furyl, piperidyl, morpholyl group).

$Y^{12}$, $Y^{13}$, $Y^{14}$, $Ar^1$, $L^2$, $Y^{12'}$, $Y^{13'}$, $Y^{14'}$, $Ar^{1'}$ in formulae (A-1) and (A-2), and the cyclic structure of formula (A-3) may have a substituent such as Y stated above.

Preferred examples of formulae (A-1), (A-2) and (A-3) are mentioned below.

In formulae (A-1) and (A-2), $Y^{12}$, $Y^{12'}$, $Y^{13}$ and $Y^{13'}$ preferably each independently represent a substituted or unsubstituted alkyl or alkylene group having 1 to 6 carbon atoms, or a substituted or unsubstituted aryl group having 6 to 10 carbon atoms; $Y^{14}$ and $Y^{14'}$ are substituted or unsubstituted alkyl groups having 1 to 6 carbon atoms, monoalkyl-substituted or dialkyl-substituted amino groups having 1 to 4 carbon atoms, carboxyl groups, halogen atom, or a carboxylic acid ester having 1 to 4 carbon atoms; $Ar^1$ and $Ar^{1'}$ are substituted or unsubstituted aryl groups having 6 to 10 carbon atoms; $Q^2$ and $Q^{2'}$ are O, S or Se; $m^3$ and $m^4$ are 0 or 1; $n^4$ falls between 1 and 3; and $L^2$ is an amino group substituted with alkyl group (s) having 0 to 3 carbon atoms.

Preferably, the cyclic structure of formula (A-3) is a 5- to 7-membered heterocyclic ring.

More preferably in formulae (A-1) and (A-2), $Y^{12}$, $Y^{12'}$, $Y^{13}$ and $Y^{13'}$ each independently represent a substituted or unsubstituted alkyl or alkylene group having 1 to 4 carbon atoms; $Y^{14}$ and $Y^{14'}$ are unsubstituted alkyl groups having 1 to 4 carbon atoms, or monoalkyl-substituted or dialkyl-substituted amino groups having 1 to 4 carbon atoms; $Ar^1$ and $Ar^1$ are substituted or unsubstituted aryl groups having 6 to 10 carbon atoms; $Q^2$ and $Q^{2'}$ are O or S; $m^3$ and $m^4$ are both 0; $n^4$ is 1; and $L^2$ is an amino group substituted with alkyl group(s) having 0 to 3 carbon atoms.

Also more preferably, the cyclic structure of formula (A-3) is a 5- or 6-membered heterocyclic ring.

In formula (I), when X is represented by formula (A-1) or (A-2), the moiety of A bonded to X or L is selected from $Y^{12}$, $Y^{13}$, $Ar^1$, $Y^{12'}$, $Y^{13'}$ and $Ar^{1'}$.

Specific examples of A in formula (I) are listed below, however, A employable in the present invention is not limited thereto.

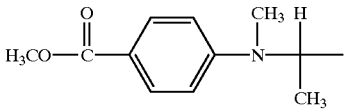

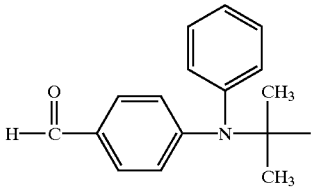

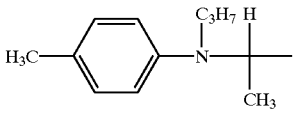

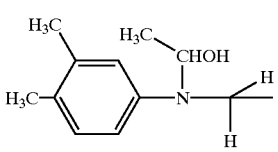

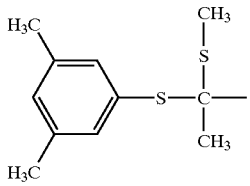

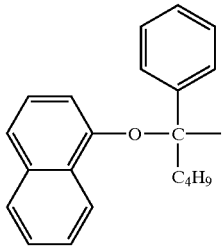

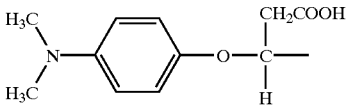

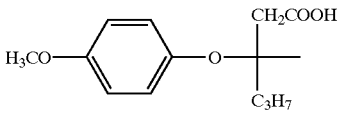

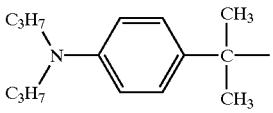

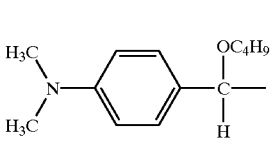

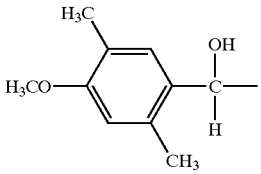

-continued

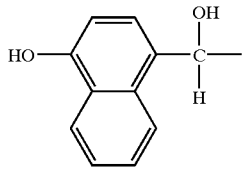

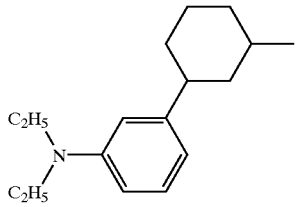

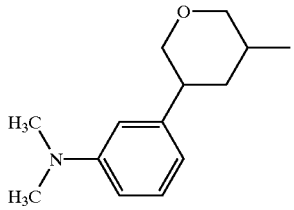

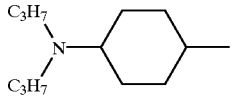

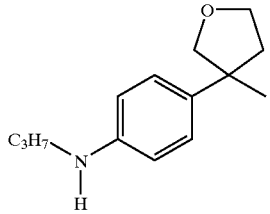

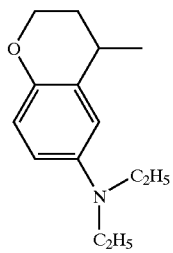

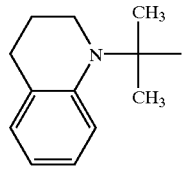

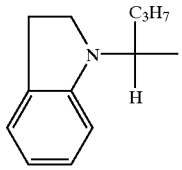

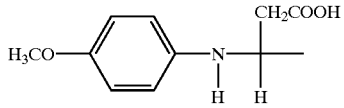

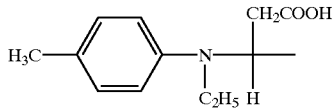

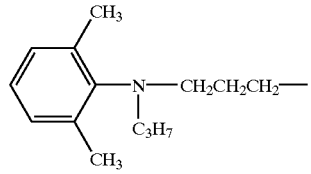

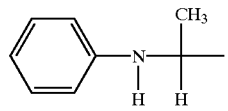

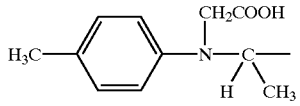

-continued

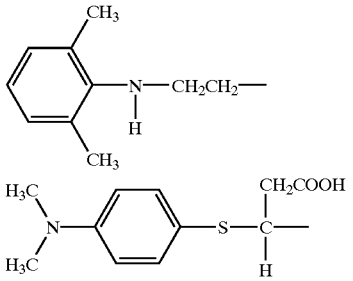

Next, B in formula (1) is described in detail.

In case where B is a hydrogen atom, the compound represented by formula (I), after having been oxidized, is deprotonated by an intramolecular base to produce a radical A'.

Preferably, B is a hydrogen atom or a group represented by any of the following formulae (B-1), (B-2) and (B-3):

Formula (B-1)

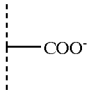

Formula (B-2)

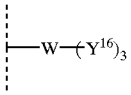

Formula (B-3)

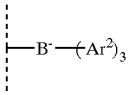

In formulae (B-1), (B-2) and (B-3), W represents Si, Sn or Ge; $Y^{16}$s each independently represent an alkyl group; and $Ar^2$s each independently represent an aryl group.

The group represented by formula (B-2) or (B-3) may be bonded to the adsorbing group X.

Formulae (B-1), (B-2) and (B-3) are described in detail. In these formulae, the alkyl group represented by $Y^{16}$ includes, for example, a substituted or unsubstituted, linear or branched alkyl group having 1 to 6 carbon atoms (e.g., methyl, ethyl, isopropyl, n-propyl, n-butyl, tert-butyl, 2-pentyl, n-hexyl, n-octyl, tert-octyl, 2-ethylhexyl, 2-hydroxyethyl, 1-hydroxyethyl, n-butoxyethyl or methoxymethyl group), and a substituted or unsubstituted aryl group having 6 to 12 carbon atoms (e.g., phenyl or 2-methylphenyl group).

$Y^{16}$ and $Ar^2$ in formulae (B-1), (B-2) and (B-3) may further have a substituent such as Y.

Preferred examples of formulae (B-1), (B-2) and (B-3) are mentioned below.

In formulae (B-2) and (B-3), $Y^{16}$ is preferably a substituted or unsubstituted alkyl group having 1 to 4 carbon atoms; $Ar^2$ is a substituted or unsubstituted aryl group having 6 to 10 carbon atoms; and W is Si or Sn.

More preferably in formulae (B-2) and (B-3), $Y^{16}$ is a substituted or unsubstituted alkyl group having 1 to 3 carbon atoms; $Ar^2$ is a substituted or unsubstituted aryl group having 6 to 8 carbon atoms; and W is Si.

Among ulae (B-1), (B-2) and (B-3), most preferred are $COO^-$ of formula (B-1), and Si—$(Y^{16})_3$ of formula (B-2).

In formula (I), n is preferably 1.

Specific examples of (A—B) in formula (I) are mentioned below, however, (A—B) employable in the present invention is not limited thereto.

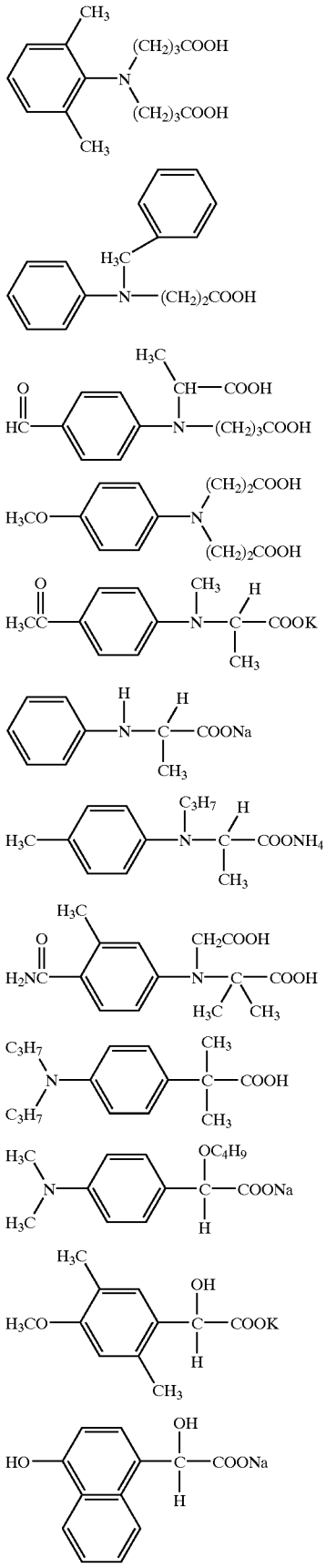

-continued

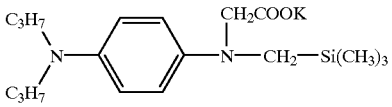

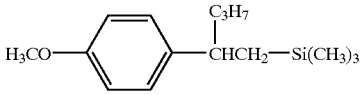

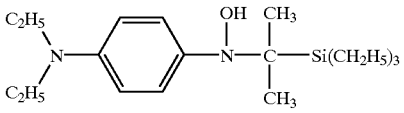

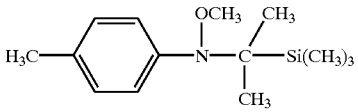

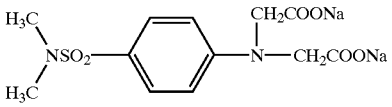

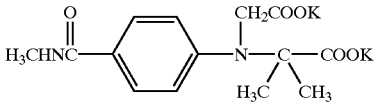

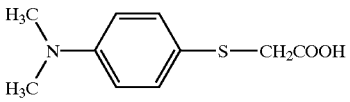

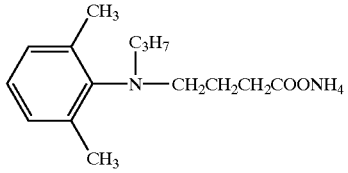

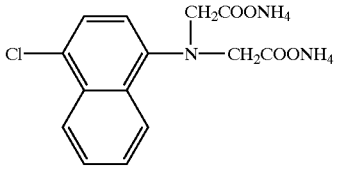

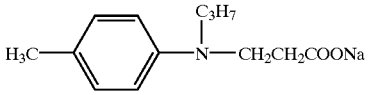

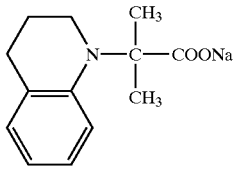

-continued

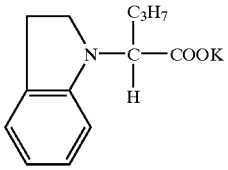

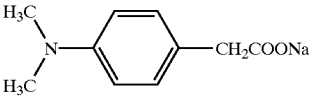

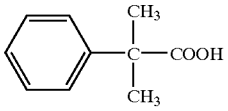

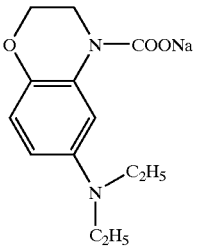

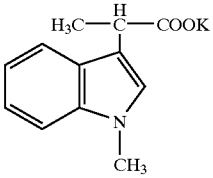

The counter ion necessary to balance the charge of (A—B) includes, for example, sodium ion, potassium ion, triethylammonium ion, diisopropylammonium ion, tetrabutylammonium ion and tetramethylguanidinium ion.

Preferable oxidation potential of (A—B) falls between 0 and 1.5 V, more preferably between 0 and 1.0 V, even more preferably between 0.3 and 1.0 V.

Preferable oxidation potential ($E_2$) of the radical A' produced by cleavage reaction falls between −0.6 and −2.5 V, more preferably between −0.9 and −2 V, even more preferably between −0.9 and −1.6 V.

The oxidation potential may be measured as follows:

$E^1$ may be measured through cyclic voltammetry. In more detail, an electron donor A is dissolved in a solution of a 80/20 (% by volume) acetonitrile/water containing 0.1 M lithium perchlorate. A glassy carbon disc is used as a working electrode; a platinum wire is used as a counter electrode; and a saturated calomel electrode (SCE) is used as a reference electrode. The potential is measured at a potential scanning speed of 0.1 V/sec at 25° C. The ratio of oxidation potential/SCE is read at the peak of the cyclic voltammetric wave. The value $E^1$ of the compound (A—B) is described in European Patent Laid-Open (EP) No.93,731A1.

The oxidation potential of the radical is measured through transitional electrochemical and pulse-radiation decomposition method. The measurement is reported in *J. Am. Chem. Soc.*, 1988, 110, 132; ibid., 1974, 96, 1287; and ibid., 1974, 96, 1295.

Specific examples of the compound represented by formula (I) are listed below, however, the compounds employable in the present invention are not limited thereto.

(I-1)
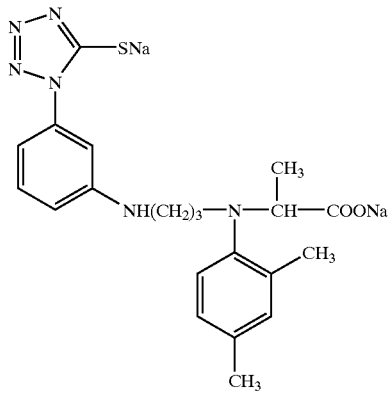
(I-2)
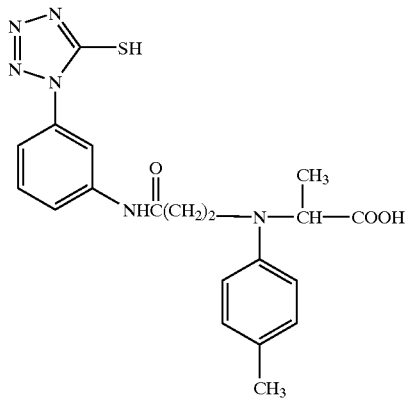
(I-3)
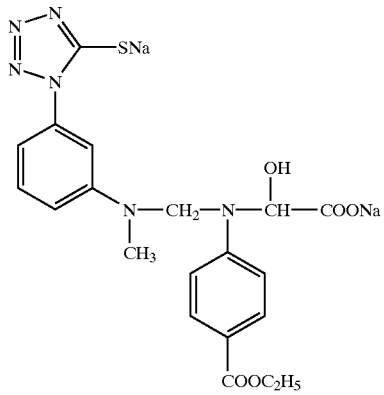
(I-4)
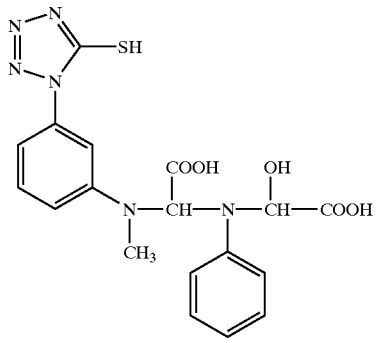
-continued
(I-5)
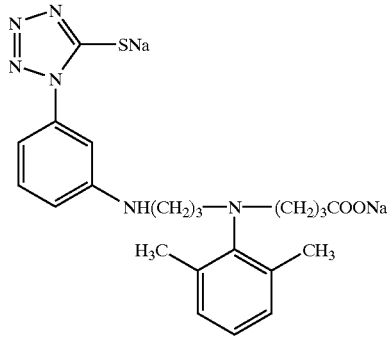
(I-6)
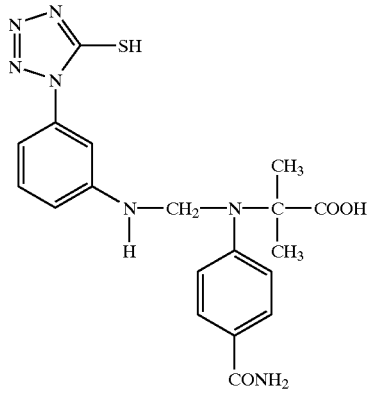
(I-7)
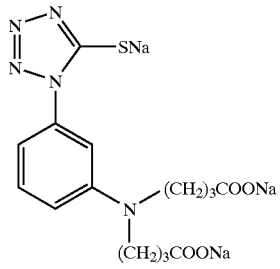
(I-8)
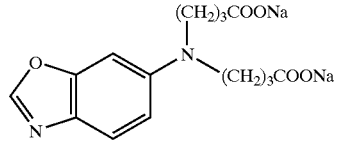
(I-9)
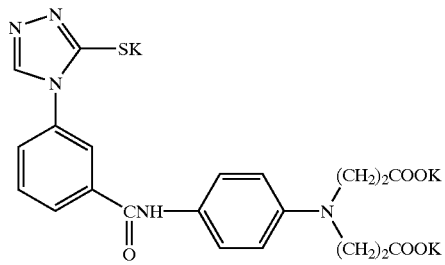

-continued
(I-10)
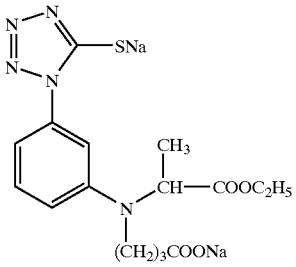
(I-11)
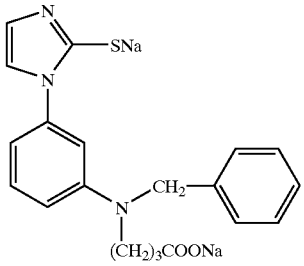
(I-12)
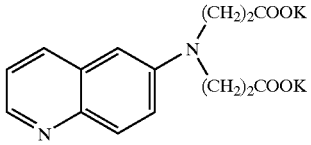
(I-13)
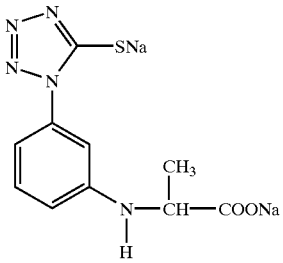
(I-14)
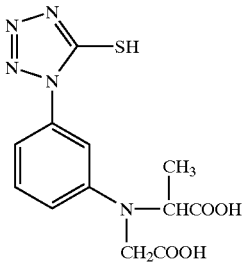
(I-15)
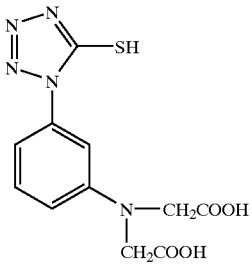
-continued
(I-16)
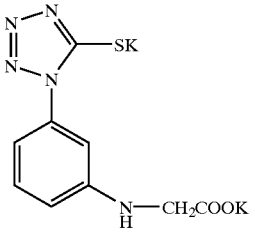
(I-17)
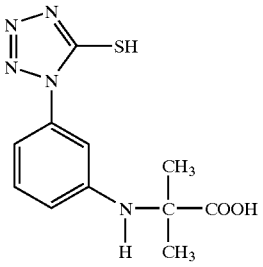
(I-18)
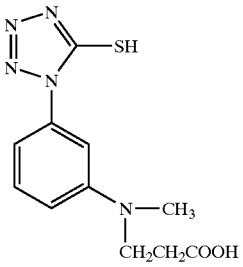
(I-19)
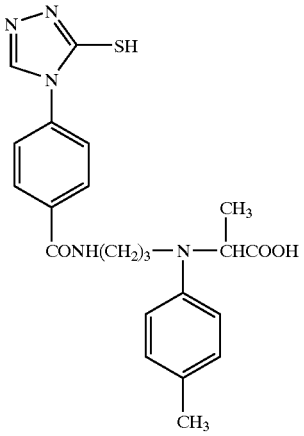
(I-20)
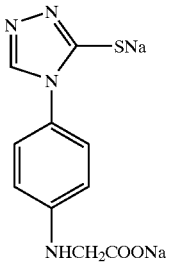

-continued
(I-21)
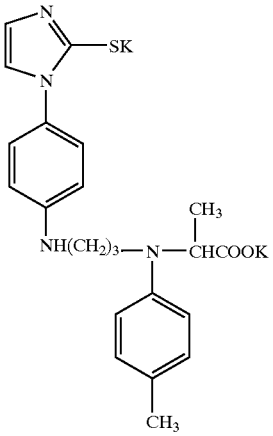
(I-22)
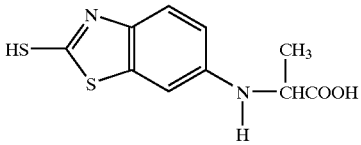
(I-23)
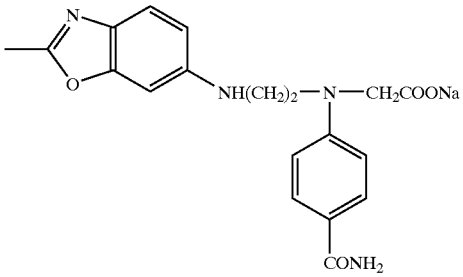
(I-24)
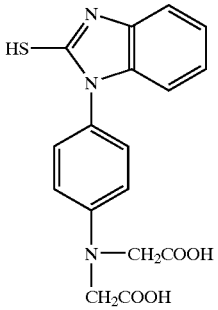
(I-25)
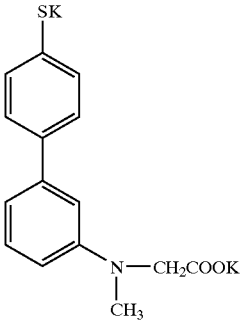
-continued
(I-26)
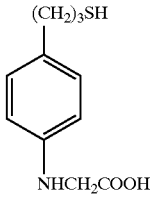
(I-27)
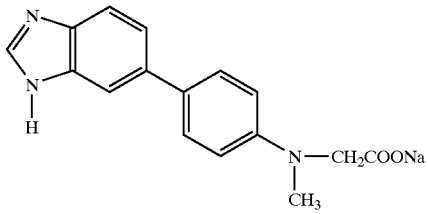
(I-28)
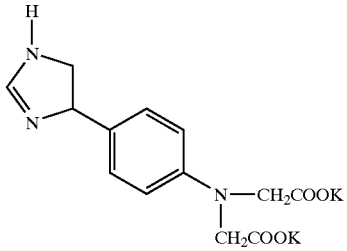
(I-29)
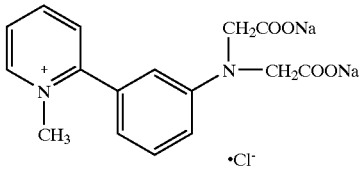
(I-30)
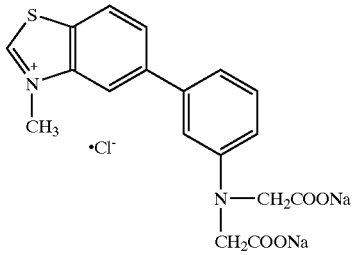
(I-31)
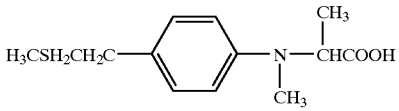
(I-32)
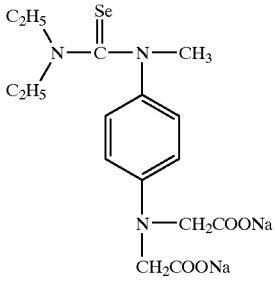
(I-33)
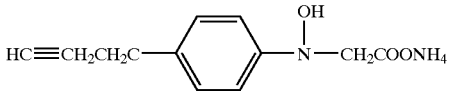

-continued
(I-34)
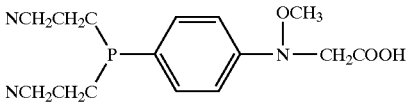
(I-35)
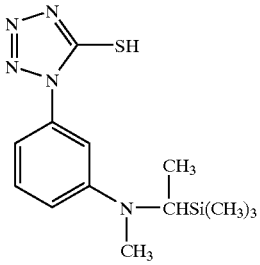
(I-36)
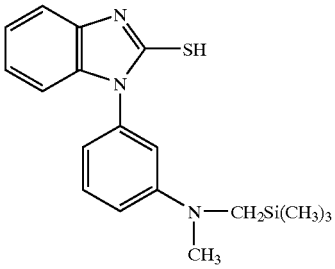
(I-37)
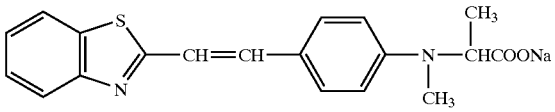
(I-38)
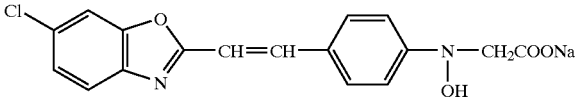
(I-39)
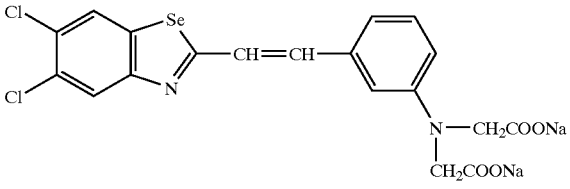
(I-40)
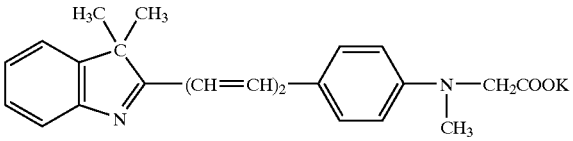
(I-41)
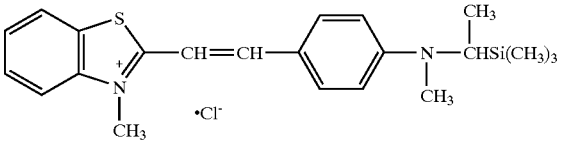
(I-42)
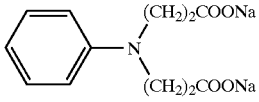
-continued
(I-43)
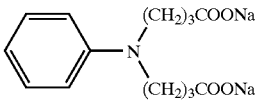
(I-44)
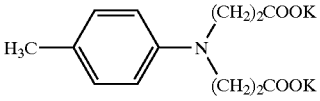
(I-45)
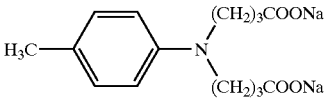
(I-46)
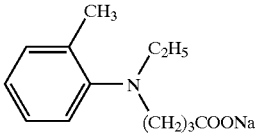
(I-47)
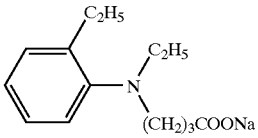
(I-48)
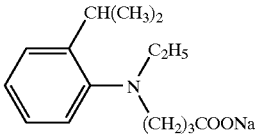
(I-49)
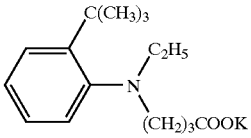
(I-50)
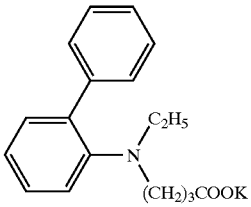
(I-51)
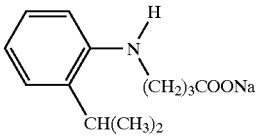
(I-52)
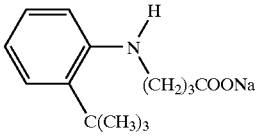
(I-53)
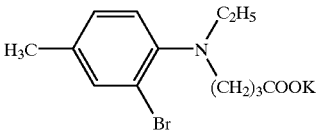

-continued
(I-54)
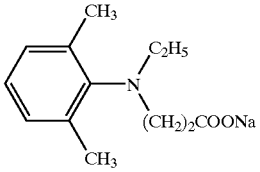
(I-55)
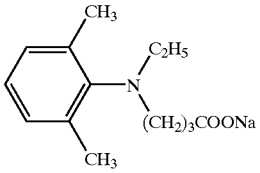
(I-56)
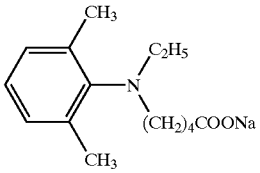
(I-57)
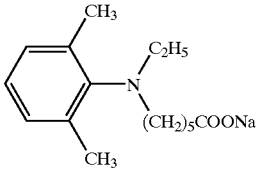
(I-58)
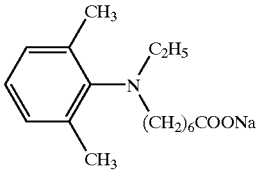
(I-59)
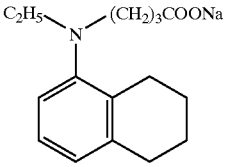
(I-60)
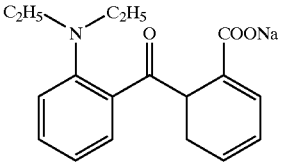
(I-61)
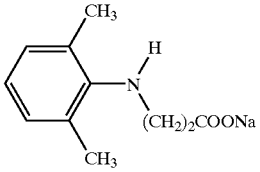
(I-62)
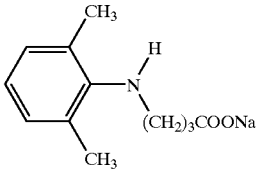
-continued
(I-63)
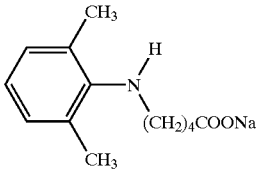
(I-64)
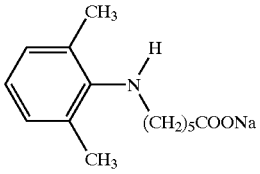
(I-65)
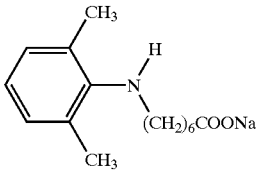
(I-66)
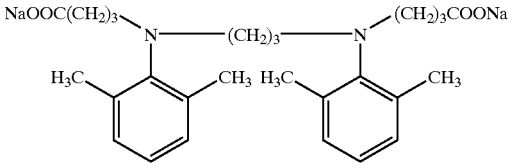
(I-67)
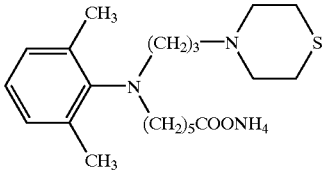
(I-68)
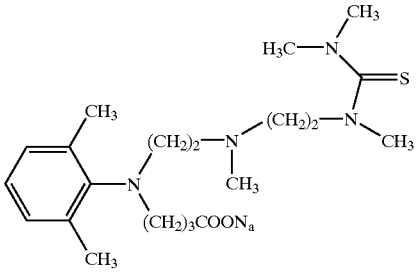
(I-69)
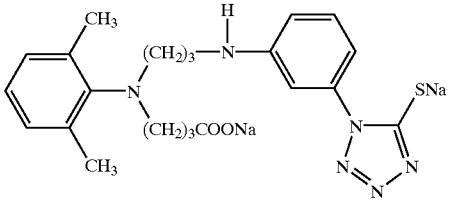

-continued
(I-70)
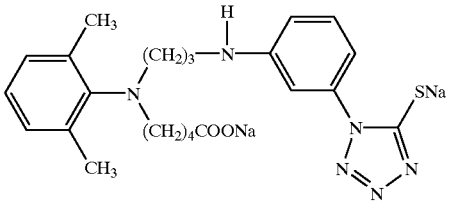
(I-71)
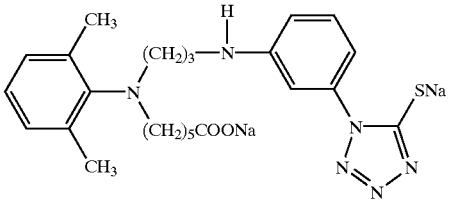
(I-72)
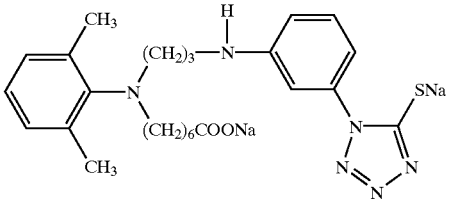
(I-73)
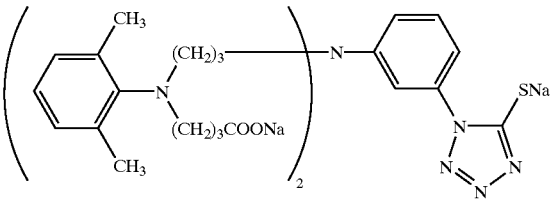
(I-74)
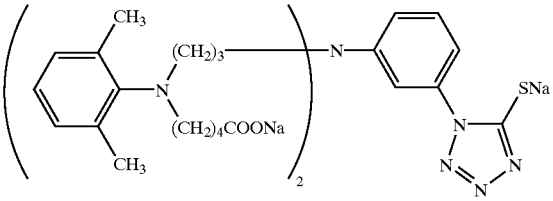
(I-75)
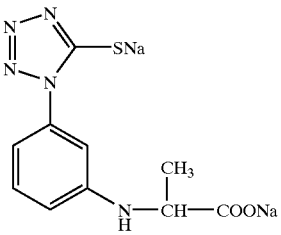
(I-76)
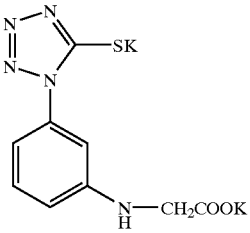
-continued
(I-77)
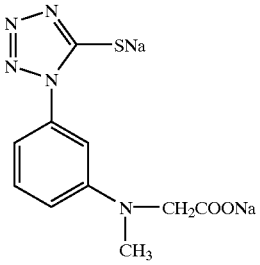
(I-78)
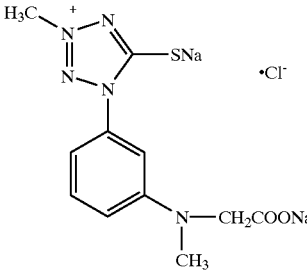
(I-79)
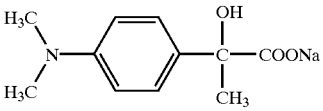
(I-80)
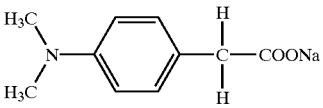
(I-81)
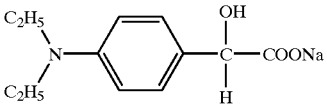
(I-82)
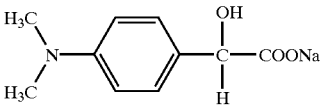
(I-83)
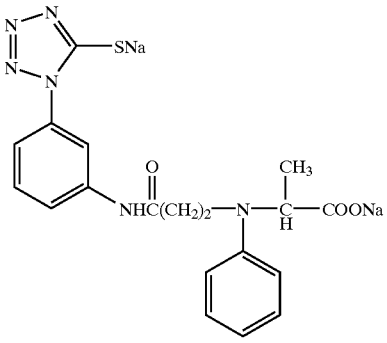

-continued
(I-84)
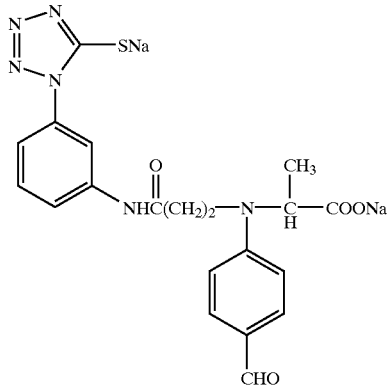
(I-85)
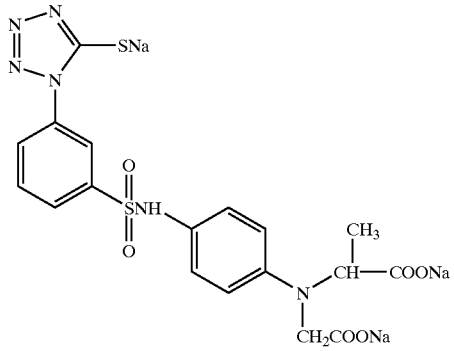
(I-86)
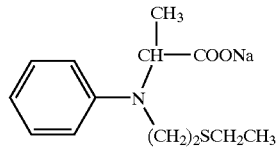
(I-87)
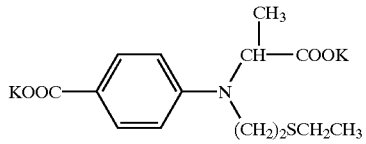
(I-88)
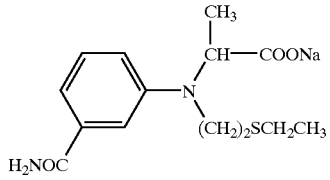
(I-89)
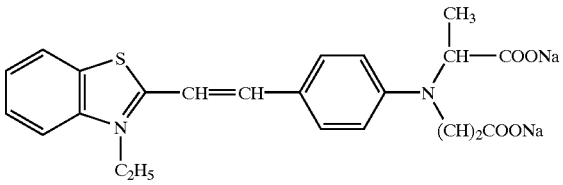
-continued
(I-90)
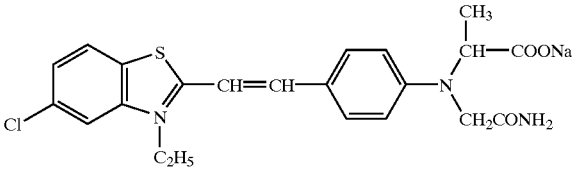
(I-91)
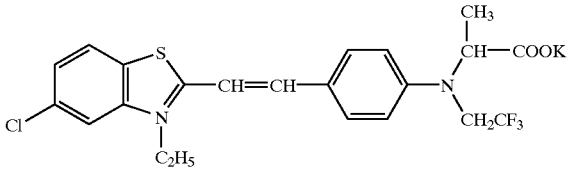
(I-92)
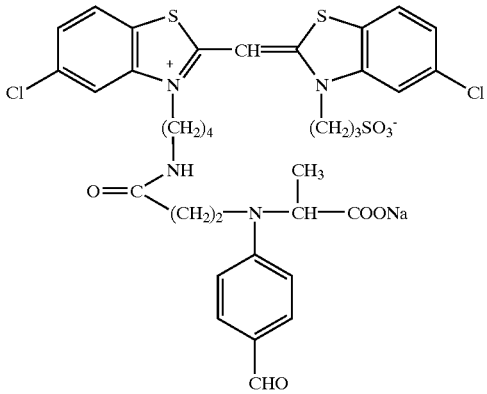
(I-93)
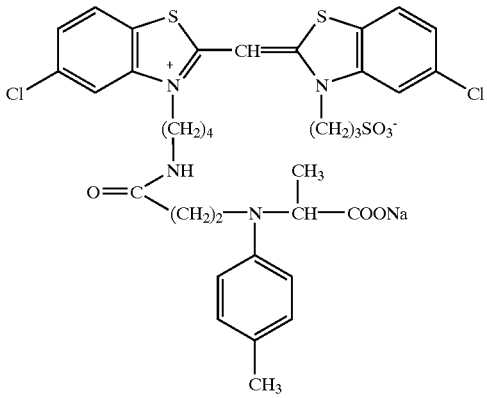
(I-94)
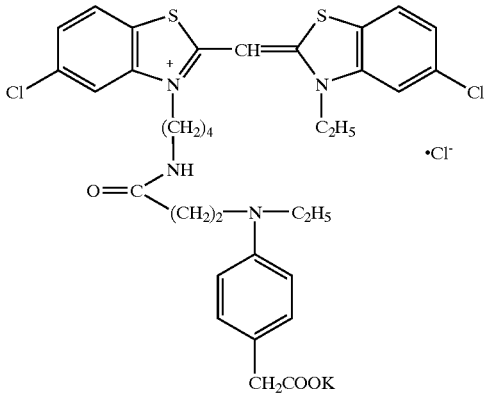

The compound represented by formula (I) may readily be produced according to the methods described in, for example, U.S. Pat. Nos. 5,747,235, 5,747,235, EP Nos.786, 692A1, 893,731A1, 893,732A1, and International Publication WO99/05570, or according to those similar to the methods.

In producing the thermally developable photosensitive material of the present invention, the compound represented by formula (1) may be used in any stage of production, for example, in the step of preparing an emulsion to be coated or in the step of producing a thermally developable photosensitive material. For example, the compound may be used when conducting grain formation, de-salting or chemical sensitization, or alternatively, prior to coating. In these steps, the compound may be divided and added in several portions.

The compound represented by formula (1) is added, after having been dissolved in water or a water-soluble solvent such as methanol or ethanol or in a mixture thereof. When dissolving in water, the compound having a higher solubility at a higher pH may be dissolved at a higher pH. On the contrary, the compound having a higher solubility at a lower pH may be dissolved in water at a lower pH.

The compound represented by formula (1) is preferably included in the image-forming layer (emulsion layer) of the thermally developable photosensitive material. It may also be possible to previously add the compound not only to an image-forming layer but also to a protective layer and/or to an interlayer and to make the compound diffuse when applying coating. The compound represented by formula (1) may be added at any time, irrespective of before and after addition of a sensitizing dye. Preferably, the compound of formula (1) is added to the image-forming layer containing silver halide in amounts falling between $1\times10^{-9}$ and $5\times10^{-1}$ mols, more preferably between $1\times10^{-8}$ and $2\times10^{-1}$ mols per mol of silver halide.

The halogen composition of the photosensitive silver halide grains for use in the present invention is not specifically limited, and there may be used silver chloride, silver chlorobromide, silver bromide, silver iodobromide, silver iodochlorobromide. Regarding the halide distribution in individual grains, the halide may be uniformly distributed throughout the grain, or may stepwise distributed, or may continuously distributed. Silver halide grains having a core/shell structure are preferably used. Preferably, the core/shell structure of the grains has 2 to 5 layers, more preferably 2 to 4 layers. Also a technique to localize silver bromide on the surface of silver chloride or silver chlorobromide grains is preferably employed.

Methods of forming photosensitive silver halides are well known in the art and may be employed in the present invention, for example, as described in *Research Disclosure* No.17029 (June 1978), and U.S. Pat. No. 3,700,458. More specifically, a silver source-supplying compound and a halogen source-supplying compound are added to a solution of gelatin or any other polymer to prepare a photosensitive silver halide, followed by admixing with an organic silver salt. Further, the method described in JP-A No.11-119374, paragraphs [0217] to [0244]; and the methods described in JP-A Nos.11-98708 and 11-84182 are also preferable.

The photosensitive silver halide grains preferably have a smaller size in order to prevent the formed images from becoming cloudy. Specifically, the size is preferably at most 0.20 $\mu$m, more preferably falling between 0.01 $\mu$m and 0.15 $\mu$m, and even more preferably between 0.02 $\mu$m and 0.12 $\mu$m. The grain size as used herein refers to the diameter of the circular image having the same area as the projected area of each silver halide grain (for tabular grains, the main face of each grain is projected to determine the projected area of the grain).

Silver halide grains may have various shapes including, for example, cubic grains, octahedral grains, tabular grains, spherical grains, rod-like grains, and potato-like grains. Cubic silver halide grains are especially preferred for use in the present invention. Also preferred are roundish silver halide grains with their corners rounded. The surface index (Miller index) of the outer surface of the photosensitive silver halide grains for use in the present invention is not specifically limited, but it is preferred that the proportion of {100} plane, which ensures higher spectral sensitization when it has adsorbed a color-sensitizing dye, in the outer surface is large. Preferably, the proportion of {100} plane is at least 50%, more preferably at least 65%, and even more preferably at least 80%. The Miller index expressed by the proportion of {100} plane can be obtained according to the method described in *J. Imaging Sci.*, written by T. Tani, 29, 165 (1985), based on the adsorption dependency of {111} plane and {100} plane for sensitizing dyes.

Silver halide grains having a hexacyano-metal complex in their outermost surface are preferred for use in the present invention. The hexacyano-metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. The hexacyano-Fe complexes are preferably used in the present invention.

As hexacyano-metal complexes exist in the form of ions in their aqueous solutions, their counter cations are of no importance. However, it is preferable to use as the counter cation any of alkali metal ions such as sodium ion, potassium ion, rubidium ion, cesium ion and lithium ion; ammonium ion, and alkylammonium ion (e.g., tetramethylammonium ion, tetraethylammonium ion, tetrapropylammonium ion and tetra(n-butyl)ammonium ion) due to good water miscibility and easy handling of silver halide emulsion sedimentation.

The hexacyano-metal complex may be added in the form of a solution thereof in water or in a mixed solvent of water and an organic solvent miscible with water (for example, alcohols, ethers, glycols, ketones, esters, amides), or in the form of a mixture with gelatin.

The amount of the hexacyano-metal complex to be added preferably falls between $1\times10^{-5}$ mols and $1\times10^{-2}$ mols, per mol of silver, and more preferably between $1\times10^{-4}$ mols and $1\times10^{-3}$ mols.

In order to make the hexacyano-metal complex exist in the outermost surface of silver halide grains, addition of the complex is conducted in the charging step, i.e., after an aqueous silver nitrate solution to form silver halide grains has been added to a reaction system but before the grains having formed are subjected to chemical sensitization such as chalcogen sensitization with sulfur, selenium or tellurium or noble metal sensitization with gold or the like, or alternatively the complex is directly added to the grains in the step of rinsing, dispersing or prior to conducting chemical sensitization. In order to prevent the silver halide grains from excessively growing, it is desirable to add the hexacyano-metal complex to the grains immediately after they are formed, and preferably before the charging step is completed.

Addition of the hexacyano-metal complex to silver halide grains may be started after 96% by mass of the total of silver nitrate for forming the grains has been added to a reaction system, but is preferably started after 98% by mass of silver nitride has been added thereto, more preferably after 99% by mass thereof has been added thereto.

The hexacyano-metal complex, when added to silver halide grains after an aqueous solution of silver nitrate has been added to the reaction system but just before the grains are completely formed, can be adsorbed by the grains formed to exist on the outermost surface thereof. Most of the complex thus added can form hardly-soluble salts with the silver ions present on the surface of the grains. Since the silver salt of hexacyano-iron(II) is more hardly soluble than AgI, fine grains are prevented from re-dissolving. Consequently, fine silver halide grains having a small grain size can be produced.

The photosensitive silver halide grains for use in the present invention may contain a metal or metal complex of Groups VIII to X of the Periodic Table (including Groups I to XVIII). As the metal or the central metal of metal complex of Groups VIII to X, preferably used is rhodium, ruthenium or iridium. In the present invention, one metal complex may be used alone, or two or more metal complexes of the same species or different species of metals may be used in combination. The metal or metal complex content of the grains preferably falls between $1\times10^{-9}$ mols and $1\times10^{-3}$ mols per mol of silver. Such heavy metals and metal complexes, and methods of adding them to silver halide grains are described in, for example, JP-A No.7-225449, JP-A No.11-65021, paragraphs [0018] to [0024], and JP-A No. 11-119374, paragraphs [0227] to [0240].

The metal atoms (e.g., $[Fe(CN)_6]^{4-}$) that may be included to the silver halide grains for use in the present invention, as well as the methods of desalting or chemical sensitization of the silver halide emulsions are described, for example, in JP-A No.11-84574, paragraphs [0046] to [0050], JP-A No.11-65021, paragraphs [0025] to [0031], and JP-A No.11-119374, paragraphs [0242] to [0250].

Various kinds of gelatins may be used for preparing the photosensitive silver halide emulsions for use in the present invention. In order to sufficiently disperse the photosensitive silver halide emulsion in a coating solution containing an organic silver salt, preferably used is a low-molecular gelatin having a molecular weight of from 500 to 60,000. The low-molecular gelatin may be used when forming the silver halide grains or when dispersing the grains after the grains have been desalted. Preferably, it is used when dispersing the grains after they have been desalted.

In the present invention, sensitizing dyes may be used. Usable as the sensitizing dyes, preferably selected are those which, after adsorbed by silver halide grains, can spectrally sensitize the grains within a desired wavelength range and have spectral sensitivity suitable for the light source to be used for exposure. Details of sensitizing dyes and methods for adding them to the thermally developable photosensitive material of the present invention, reference are made to paragraphs [0103] to [0109] in JP-A No.11-65021; compounds of formula (II) in JP-A No.10-186572; dyes of formula (I) and paragraph [0106] in JP-A No.11-119374; dyes described in U.S. Pat. Nos. 5,510,236 and 3,871,887 (Example 5); dyes described in JP-A Nos.2-96131 and 59-48753; from page 19, line 38 to page 20, line 35 in EP No.0803764A1; JP-A Nos.2000-86865 and 2000-102560. These sensitizing dyes may be used herein either singly or in combination of two or more. Regarding the time at which the sensitizing dye is added to the silver halide emulsion in the present invention, it is desirable that the sensitizing dye is added thereto after the desalting step but before the coating step, more preferably after the desalting step but before the chemical ripening step.

The amount of the sensitizing dye to be included in the thermally developable photosensitive material of the present invention varies as desired, depending on the sensitivity and the fogging properties of the material. In general, it preferably falls between $10^{-6}$ and 1 mol, more preferably between $10^{-4}$ and $10^{-1}$ mols, per mol of the silver halide in the image-forming layer of the material.

In order to improve spectral sensitization, a supersensitizer may be used in the present invention. For the supersensitizer, for example, usable are the compounds described in EP No.587,338, U.S. Pat. Nos. 3,877,943, 4,873,184, and JP-A Nos.5-341432, 11-109547 and 10-111543.

Preferably, the photosensitive silver halide grains for use in the present invention are chemically sensitized with, for example, sulfur, selenium or tellurium. For such sulfur, selenium or tellurium sensitization, any known compounds are usable. For example, preferred are the compounds described in JP-A No.7-128768. Tellurium sensititization is preferably conducted in the present invention, by using the compounds described in JP-A No.11-65021, paragraph [0030], and the compounds of formulae (II), (III) and (IV) given in JP-A No.5-313284.

In the present invention, the silver halides may be chemically sensitized in any stage after their formation but before their coating. For example, they may be chemically sensitized after desalted, but (1) before spectral sensitization, or (2) along with spectral sensitization, or (3) after spectral sensitization, or (4) just before coating. Especially preferably, the grains are chemically sensitized after spectral sensitization.

The amount of the sulfur, selenium or tellurium sensitizer for such chemical sensitization varies, depending on the type of the silver halide grains to be sensitized therewith and the condition for chemically ripening the grains, but may fall generally between $10^{-8}$ and $10^{-2}$ mols, preferably approximately between $10^{-7}$ and $10^{-3}$ mols, per mol of the silver halide. Though not specifically limited, the condition for chemical sensitization may be such that the pH falls between 5 and 8, the pAg falls between 6 and 11, and the temperature falls approximately between 40 and 95° C. or so.

If desired, a thiosulfonic acid compound may be added to the silver halide emulsions for use in the present invention, according to the method described in EP No.293,917.

The photothermographic image-recording material of the present invention may contain a single kind or two or more kinds of photosensitive silver halide grains (these may differ in their mean grain size, halogen composition or crystal habit, or in the condition for their chemical sensitization), either alone or in combination. Combining two or more kinds of photosensitive silver halide grains differing in their sensitivity enables to control the gradation of the thermally developable photosensitive material. The techniques relating thereto are described in JP-A NOs.57-119341, 53-106125, 47-3929, 48-55730, 46-5187, 50-73627 and 57-150841. The sensitivity difference between silver halide emulsions to be mixed is at least 0.2 logE.

The amount of the photosensitive silver halide grains is preferably from 0.03 to 0.6 g/m$^2$, more preferably from 0.05 to 0.4 g/m$^2$, and most preferably from 0.1 to 0.4 g/m$^2$, in terms of the coating amount of silver per m$^2$ of the thermally developable photosensitive material. Per mol of the organic silver salt, photosensitive silver halide grains to be used preferably falls between 0.01 mol and 0.5 mol, more preferably between 0.02 mol and 0.3 mol.

Regarding the methods and the conditions for admixing the photosensitive silver halide grains with an organic silver salt having been prepared separately, employable is a method of mixing them in a high-performance stirrer, a ball mill, a sand mill, a colloid mill, a shaking mill, a homogenizer or the like; or a method of adding the photosensitive silver halide grains having been prepared to an organic silver salt in any desired timing to produce the organic silver salt. However, there is no specific limitation thereto, insofar as the methods employed provide the advantages of the present invention. Mixing two or more kinds of aqueous organic silver salt dispersions with two or more kinds of aqueous photosensitive silver salt dispersions is preferably conducted in order to suitably control the photographic properties.

The preferred point at which the silver halide grains are added to the coating solution to form an image-forming layer may fall between 180 minutes before coating the liquid and a time just before the coating, preferably between 60 minutes and 10 seconds before the coating. However, there is no specific limitation thereto, insofar as the methods and the conditions employed for adding the grains to the coating solution provide the advantages of the present invention. Specific mixing methods include, for example, a method of mixing the grains with the coating solution in a tank in such a controlled manner that the mean dwelling time, as calculated from an adding flow rate and a supplying flow rate to a coater, will fall within a predetermined duration; or a method of mixing them by means of a static mixer, for example, as described in "*Liquid Mixing Technology*" written by N. Harunby, M. F. Edwards & A. W. Nienow, Chap. 8 (translated by Koji Takahasi, published by Nikkan Kogyo Shinbun, 1989).

The image-forming layer of the thermally developable photosensitive material of the present invention preferably contains a compound represented by the following formula (D):

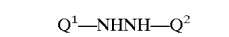

$$Q^1—NHNH—Q^2 \qquad \text{Formula (D)}$$

wherein $Q^1$ represents an aromatic group or heterocyclic group whose carbon atom bonds to —NHNH—$Q^2$; $Q^2$ represents a carbamoyl group, an acyl group, an alkoxycarbonyl group, an aryloxycarbonyl group, a sulfonyl group, or a sulfamoyl group.

The aromatic group or heterocyclic group represented by $Q^1$ is preferably a 5- to 7-membered unsaturated ring. Preferred examples of the ring include benzene, pyridine, pyrazine, pyrimidine, pyridazine, 1,2,4-triazine, 1,3,5-triazine, pyrrole, imidazole, pyrazole, 1,2,3-triazole, 1,2,4-triazole, tetrazole, 1,3,4-thiadiazole, 1,2,4-thiadiazole, 1,2,5-thiadiazole, 1,3,4-oxadiazole, 1,2,4-oxadiazole, 1,2,5-oxadiazole, thiazole, oxazole, isothiazole, isoxazole and thiophene rings. Also preferably, these rings may be condensed to each other to form a condensed ring.

These rings may have substituent(s). In case where they have two or more substituents, the substituents may be the same or different. Examples of the substituents include a halogen atom, an alkyl group, an aryl group, a carbonamido group, an alkylsulfonamido group, an arylsulfonamido group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. If possible, the substituents may further be substituted with any other substituents. Preferred examples of the additional substituents include a halogen atom, an alkyl group, an aryl group, a carbonamido group, an alkylsulfonamido group, an arylsulfonamido group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q^2$ is preferably a carbamoyl group having 1 to 50 carbon atoms, more preferably 6 to 40 carbon atoms including, for example, unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl) carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl and N-benzylcarbamoyl.

The acyl group represented by $Q^2$ is preferably an acyl group having 1 to 50 carbon atoms, more preferably 6 to 40 carbon atoms including, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl and 2-hydroxymethylbenzoyl.

The alkoxycarbonyl group represented by $Q^2$ is preferably an alkoxycarbonyl group having 2 to 50 carbon atoms, more preferably 6 to 40 carbon atoms including, for example, methoxycarbonyl, ethoxycarbonyl, isobutyloxycarbonyl, cyclohexyloxycarbonyl, decyloxycarbonyl and benzyloxycarbonyl.

The aryloxycarbonyl group represented by $Q^2$ is preferably a aryloxycarbonyl group having 7 to 50 carbon atoms, more preferably 7 to 40 carbon atoms including, for example, phenoxycarbonyl, 4-octyloxyphenoxycarbonyl, 2-hydroxymethylphenoxycarbonyl and 4-dodecyloxyphenoxycarbonyl.

The sulfonyl group represented by $Q^2$ is preferably a sulfamoyl group having 1 to 50 carbon atoms, more preferably 6 to 40 carbon atom including, for example, methylsulfonyl, butylsulfonyl, octylsulfonyl, 2-hexadecylsulfonyl, 3-dodecyloxypropylsulfonyl, 2-octyloxy-6-tert-octylphenylsulfonyl and 4-dodecyloxyphenylsulfonyl.

The sulfamoyl group represented by $Q^2$ is preferably a sulfamoyl group having from 0 to 50 carbon atoms, more preferably 6 to 40 carbon atoms including, for example, unsubstituted sulfamoyl, N-ethylsulfamoyl, N-(2-ethylhexyl)sulfamoyl, N-decylsulfamoyl, N-hexadecylsulfamoyl, N-{3-(2-ethylhexyloxy) propyl}sulfamoyl, N-(2-chloro-5-dodecyloxycarbonylphenyl)sulfamoyl and N-(2-tetradecyloxyphenyl) sulfamoyl.

The group $Q^2$ may be further substituted with any of the substituents mentioned hereinabove for the 5- to 7-membered unsaturated ring represented by $Q^1$. In case where the group $Q^2$ has two or more substituents, the substituents may be the same or different.

Preferred examples of the compound represented by formula (D) are specified below. $Q^1$ is preferably a 5- or 6-membered unsaturated ring, more preferably any of benzene, pyrimidine, 1,2,3-triazole, 1,2,4-triazole, tetrazole, 1,3,4-thiadiazole, 1,2,4-thiadiazole, 1,3,4-oxadiazole, 1,2,4-oxadiazole, thiazole, oxazole, isothiazole and isoxazole rings. Also preferably, these rings may be condensed with a benzene ring or an unsaturated heterocyclic ring to form a condensed ring. $Q^2$ is preferably a carbamoyl group, and more preferably the carbamoyl group having a hydrogen atom bonded to the nitrogen atom.

Specific examples of the compound of formula (D) are listed below, however, the compounds employable in the present invention are not limited thereto. In the structural formulae as shown above, (t) is an abbreviation for tertiary; (i) is for iso; and the alkyl group and others with no specific indication are linear (normal) groups.

D-1
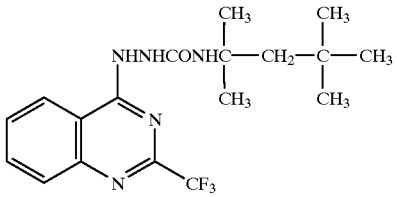
D-2
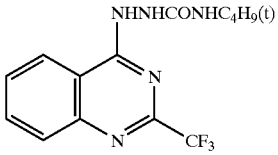
D-3
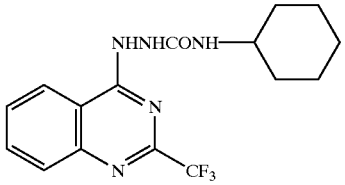
D-4
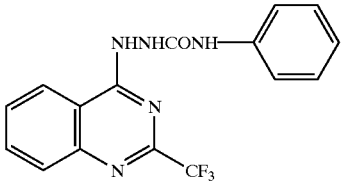
D-5
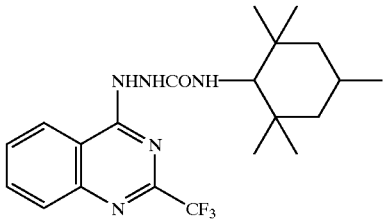
D-6
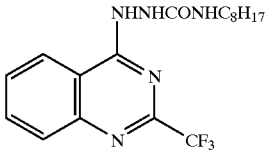
D-7
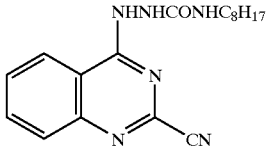
D-8
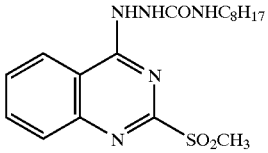
D-9
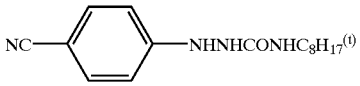
D-10
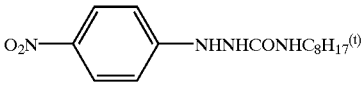
D-11
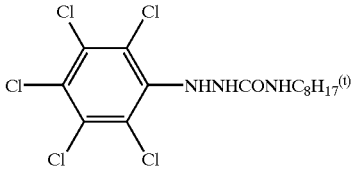
D-12
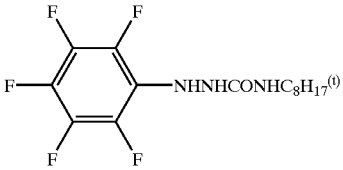
D-13
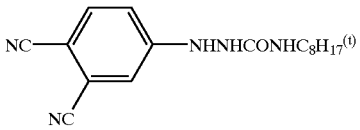
D-14
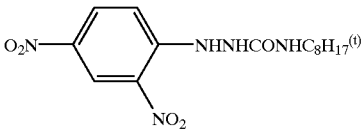
D-15
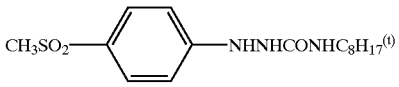
D-101
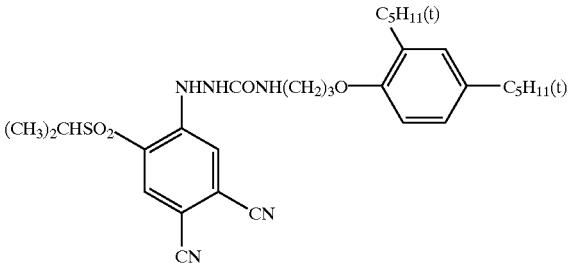

-continued
D-102
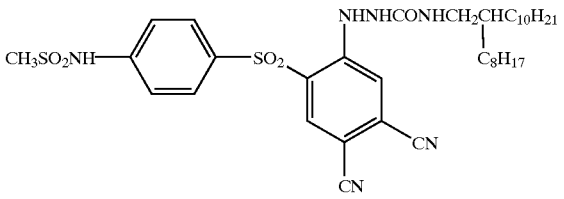
D-103
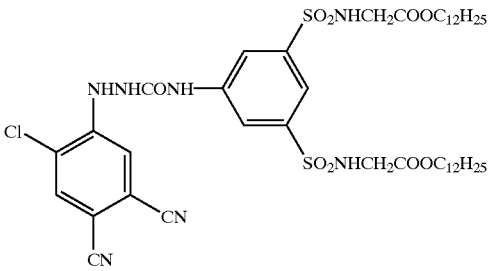
D-104
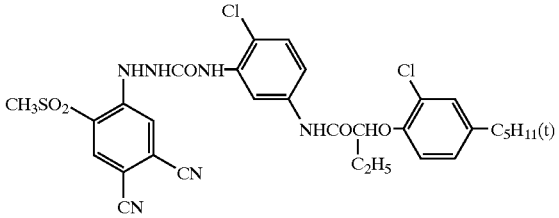
D-105
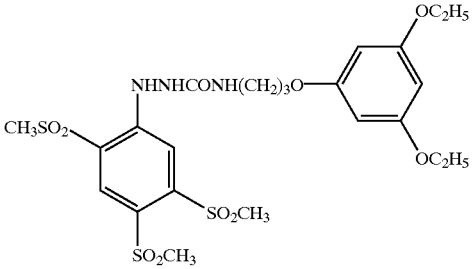
D-106
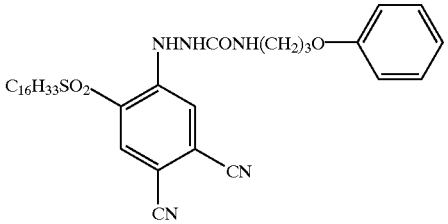
D-107
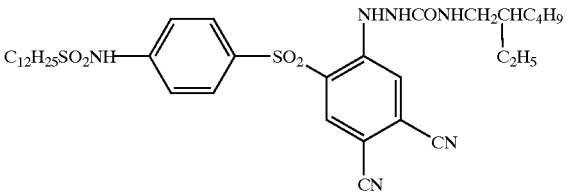
D-108
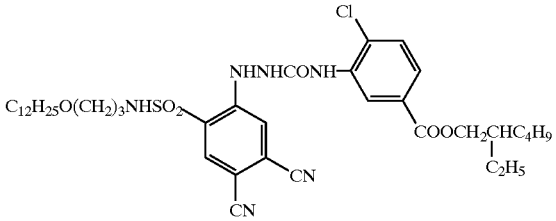
D-109
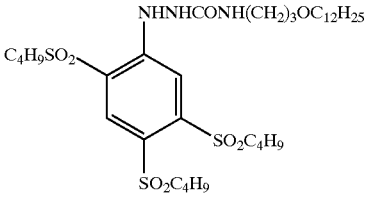
D-110
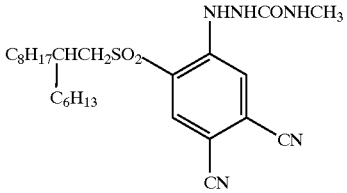
D-111
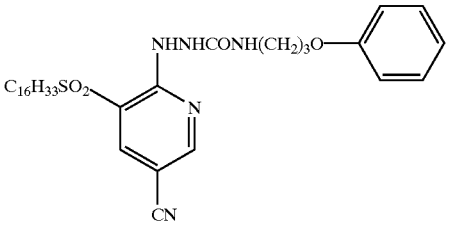
D-112
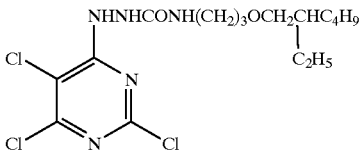
D-113
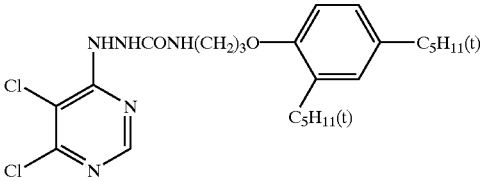

-continued
D-114
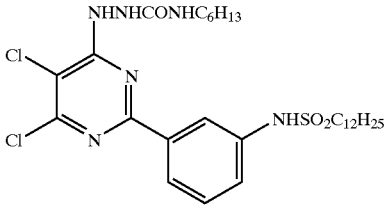
D-115
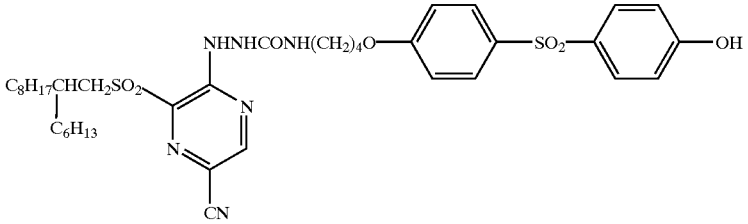
D-116
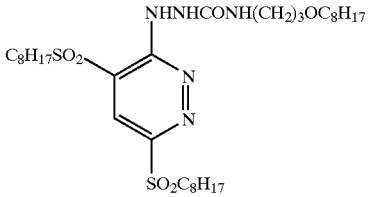
D-117
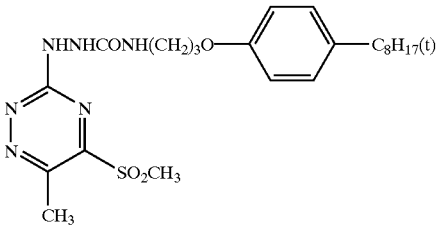
D-118
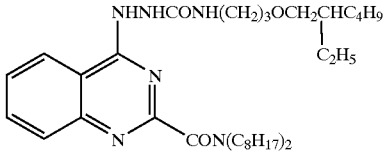
D-119
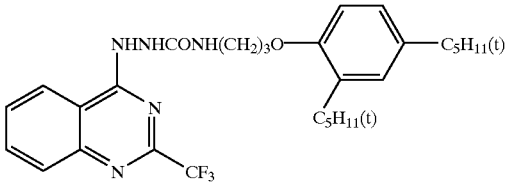
D-120
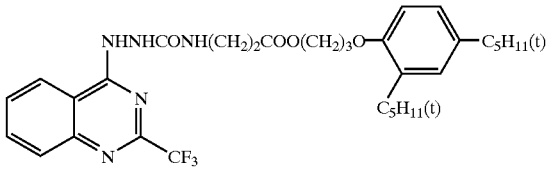
D-121
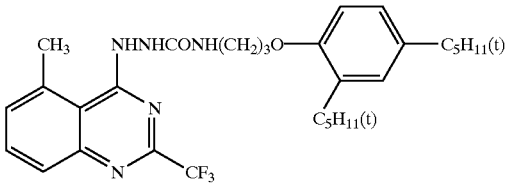
D-122
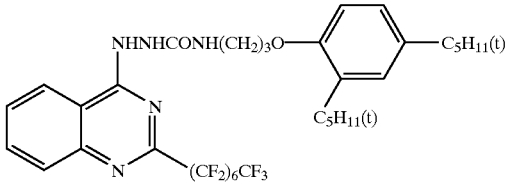
D-123
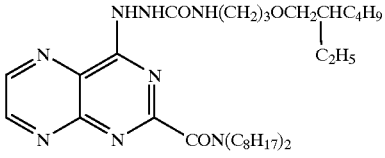
D-124
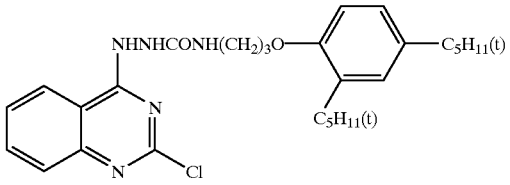
D-125
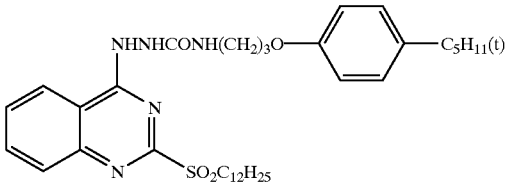

-continued
D-126
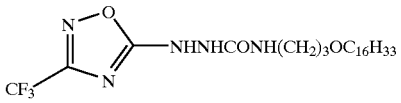
D-127
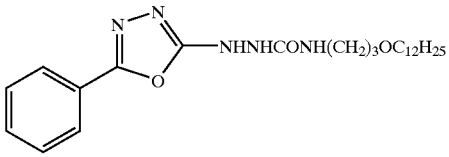
D-128
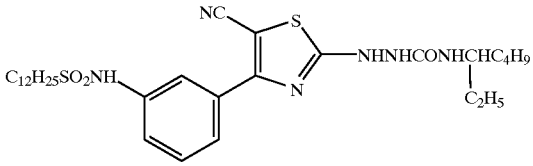
D-129
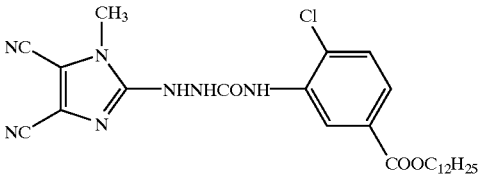
D-130
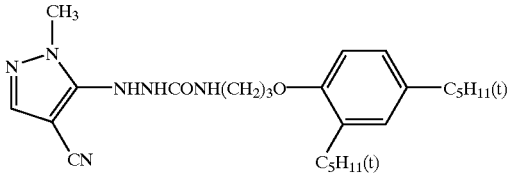
D-131
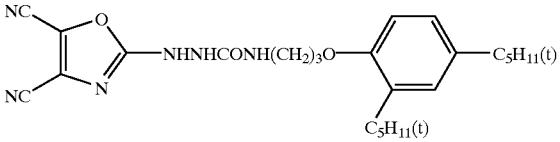
D-132
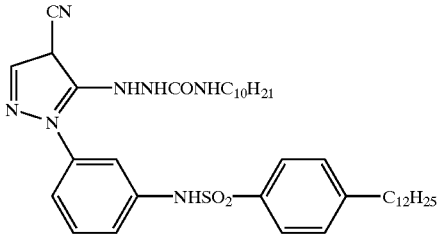
D-133
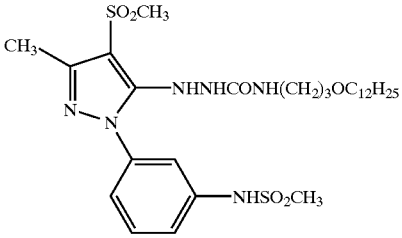
D-134
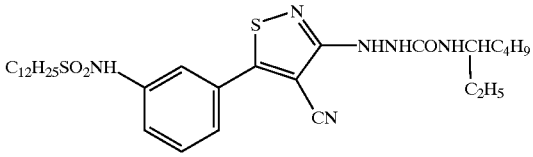
D-135
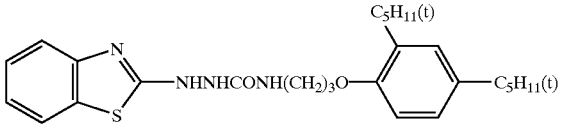
D-136
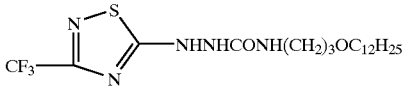
D-137
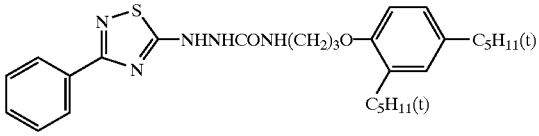
D-138
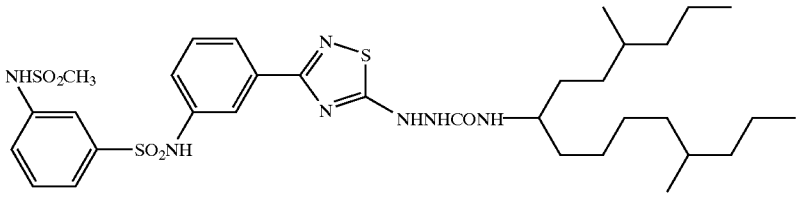
D-139
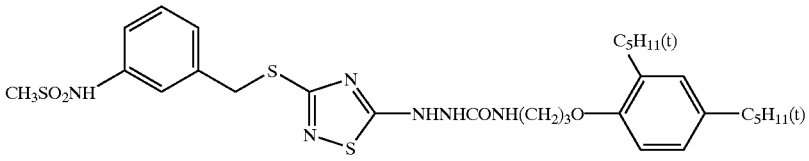

-continued
D-140
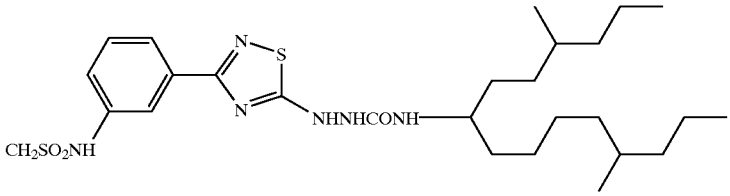
D-141
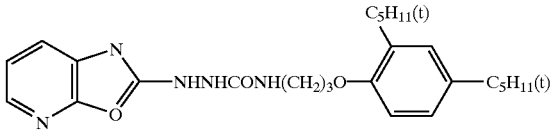
D-142
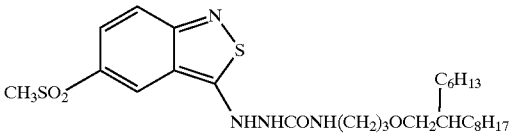
D-143
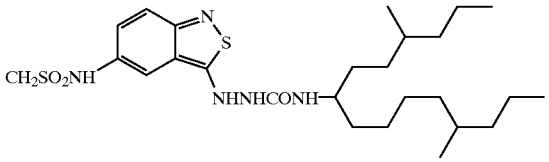
D-144
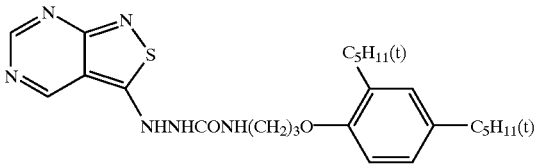
D-145
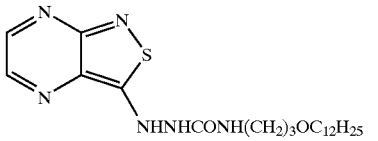
D-146
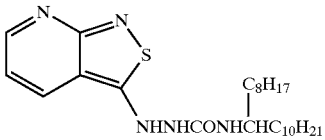
D-147
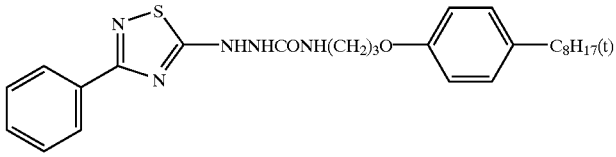
D-148
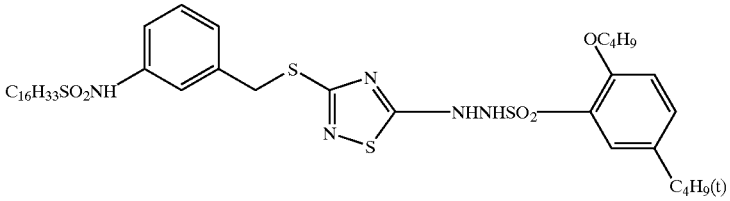
D-149
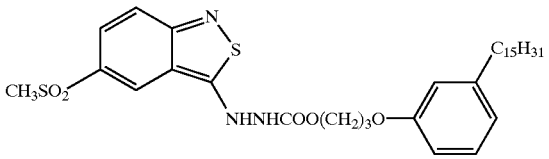
D-150
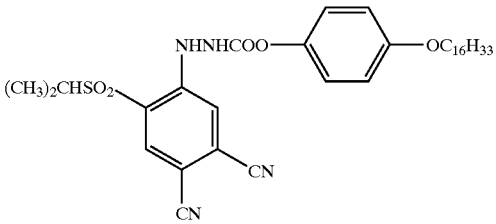
D-151
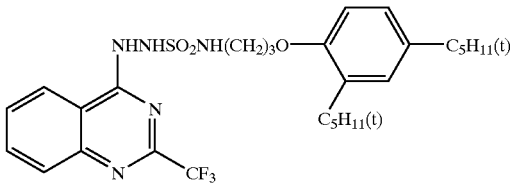
D-152
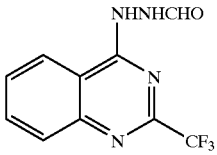

-continued

D-153

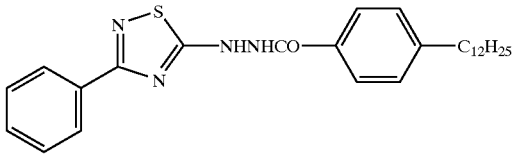

D-154

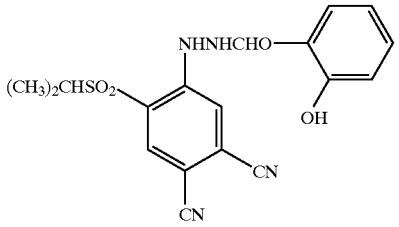

The compounds represented by formula (D) can be produced according to the methods described in, for example, JP-A Nos.9-152702, 8-286340, 9-152700, 9-152701, 9-152703 and 9-152704.

The compound represented by formula (D) may be added to the image-forming layer in any form of a solution, a powder, a dispersion of solid microparticles, an emulsion or an oil-protected dispersion. In order to prepare a dispersion of solid microparticles of the compound, any known milling device of, for example, ball mill, shaking ball mill, sand mill, colloid mill, jet mill and roller mill may be used. If desired, a dispersing auxiliary (dispersant) may be used in preparing the dispersion of solid microparticles of the compound.

The amount of the compound represented by formula (D) to be added preferably falls between 0.01 and 100 mol % of the reducing agent. More preferably, it falls between 0.1 and 50 mol %, even more preferably between 0.5 and 20 mol %, most preferably between 1 and 10 mol % of the reducing agent.

The image-forming layer in the present invention may contain a hydrogen bond-forming compound.

The "hydrogen bond-forming compound" as used herein is a non-reducing compound having a group capable of forming a hydrogen bond with a compound having an OH group and/or NH group. The group of the compound capable of forming a hydrogen bond with the group OH or NH of the other compound includes, for example, a phosphoryl group, a sulfoxido group, a sulfonyl group, a carbonyl group, an amido group, an ester group, an urethane group, an ureido group, a tertiary amino group, and a nitrogen-containing aromatic group. Among these, preferred are compounds having any of a phosphoryl group, a sulfoxido group, an amido group (not having >N—H group but blocked like >N—R, in which R is a substituent except H), an urethane group (not having >N—H group but blocked like >N—R, in which R is a substituent except H), an ureido group (not having >N—H group but blocked like >N—R, in which R is a substituent except H).

Particularly preferable hydrogen bond-forming compounds for use in the present invention are those represented by the following formula (II):

Formula (II)

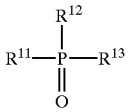

In formula (II), $R^{11}$, $R^{12}$ and $R^{13}$ each independently represent an alkyl group, an aryl group, an alkoxy group, an aryloxy group, an amino group or a heterocyclic group, which may be unsubstituted or substituted; and any two of $R^{11}$, $R^{12}$ and $R^{13}$ may be bonded to each other to form a ring.

When $R^{11}$, $R^{12}$ and $R^{13}$ have substituents, examples of the substituents include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, and a phosphoryl group. Among these, preferred are an alkyl group and an aryl group. Specifically, methyl, ethyl, isopropyl, tert-butyl, tert-octyl, phenyl, 4-alkoxyphenyl and 4-acyloxyphenyl groups are mentioned.

Examples of the groups represented by $R^{11}$, $R^{12}$ and $R^{13}$ include a substituted or unsubstituted alkyl group such as methyl, ethyl, butyl, octyl, dodecyl, isopropyl, tert-butyl, tert-amyl, tert-octyl, cyclohexyl, 1-methylcyclohexyl, benzyl, phenethyl and 2-phenoxypropyl groups; a substituted or unsubstituted aryl group such as phenyl, cresyl, xylyl, naphthyl, 4-tert-butylphenyl, 4-tert-octylphenyl, 4-anisidyl and 3,5-dichlorophenyl groups; a substituted or unsubstituted alkoxyl group such as methoxy, ethoxy, butoxy, octyloxy, 2-ethylhexyloxy, 3,5,5-trimethylhexyloxy, dodecyloxy, cyclohexyloxy, 4-methylcyclohexyloxy and benzyloxy groups; a substituted or unsubstituted aryloxy group such as phenoxy, cresyloxy, isopropylphenoxy, 4-tert-butylphenoxy, naphthoxy and biphenyloxy groups; a substituted or unsubstituted amino group such as amino, dimethylamino, diethylamino, dibutylamino, dioctylamino, N-methyl-N-hexylamino, dicyclohexylamino, diphenylamino and N-methyl-N-phenylamino groups; and a heterocyclic group such as 2-pyridyl, 4-pyridyl, 2-furanyl, 4-piperidinyl, 8-quinolyl and 5-quinolyl groups.

For $R^{11}$, $R^{12}$ and $R^{13}$, preferred are an alkyl group, an aryl group, an alkoxy group and an aryloxy group. In view of the effects of the present invention, at least one of $R^{11}$, $R^{12}$ and $R^{13}$ is preferably an alkyl group or an aryl group. More preferably, at least two of them are an alkyl or an aryl group. Even more preferably, $R^{11}$, $R^{12}$ and $R^{13}$ are the same group in view of inexpensiveness of the compounds available.

Specific examples of the compound of formula (II) are listed below, however, the compounds employable in the present invention are not limited thereto.

(II)-1

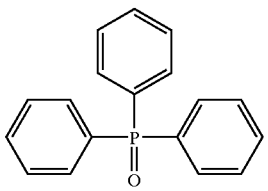

-continued
(II)-2
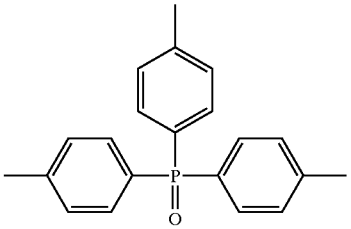
(II)-3
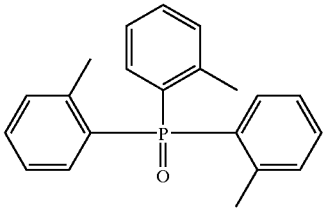
(II)-4
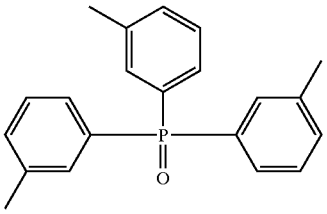
(II)-5
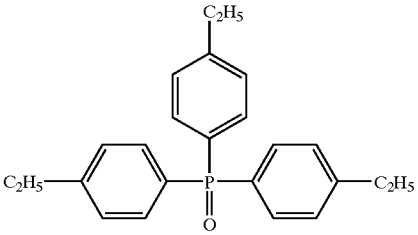
(II)-6
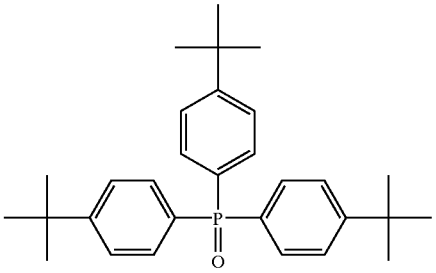
(II)-7
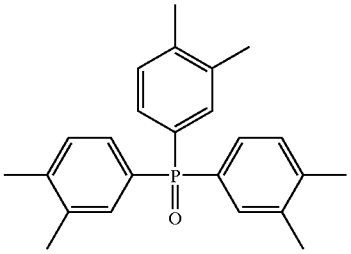
-continued
(II)-8
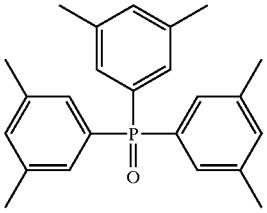
(II)-9
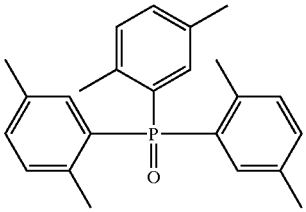
(II)-10
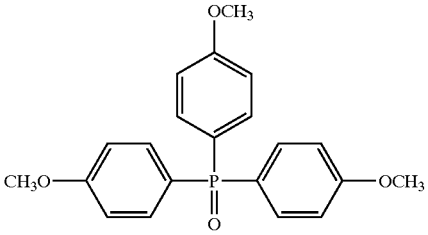
(II)-11
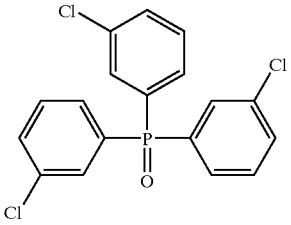
(II)-12
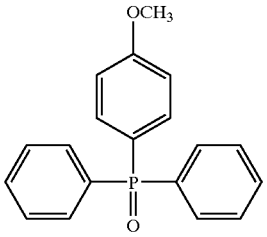
(II)-13
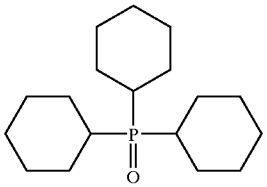
(II)-14
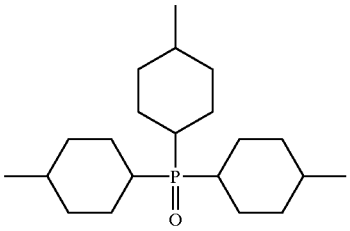

-continued
(II)-15
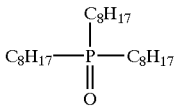
(II)-16
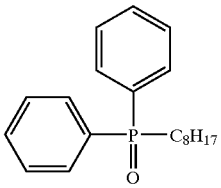
(II)-17
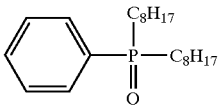
(II)-18
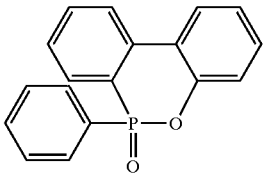
(II)-19
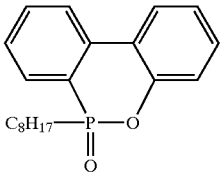
(II)-20
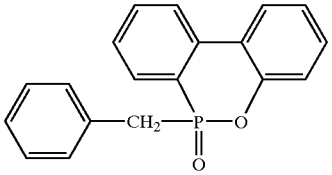
(II)-21
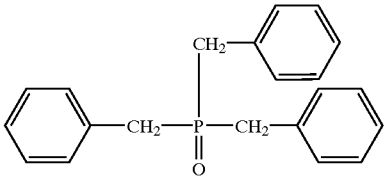
(II)-22
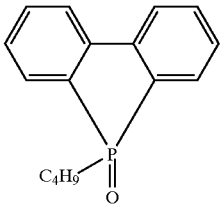
(II)-23
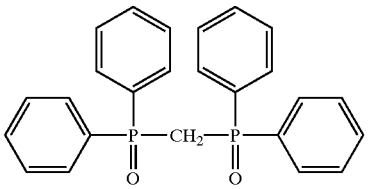
-continued
(II)-24
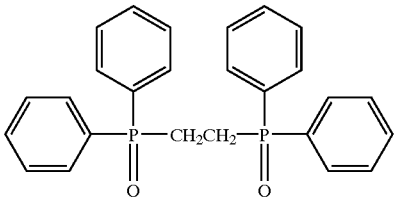
(II)-25
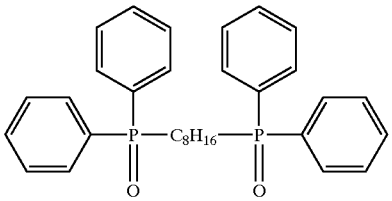
(II)-26
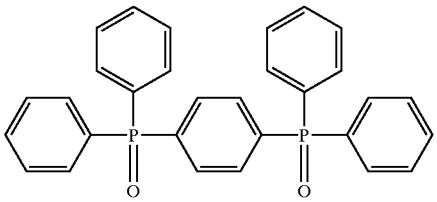
(II)-27
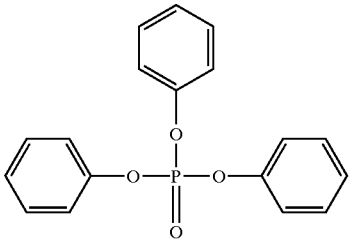
(II)-28
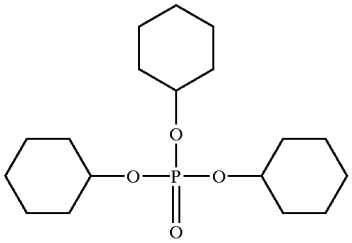
(II)-29
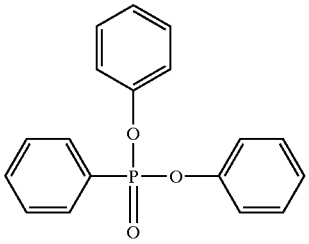
(II)-30
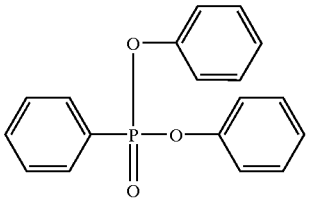

-continued (II)-31

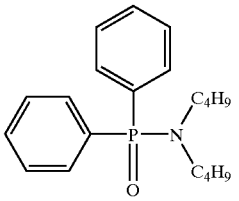

(II)-32

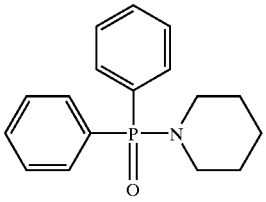

(II)-33

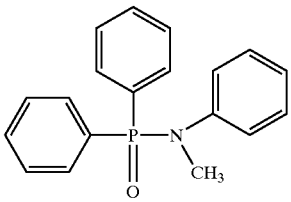

(II)-34

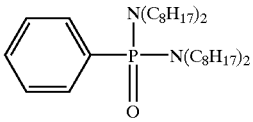

(II)-35

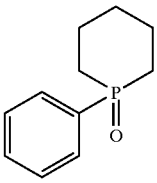

(II)-36

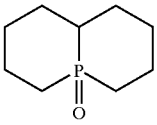

(II)-37

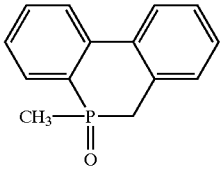

(II)-38

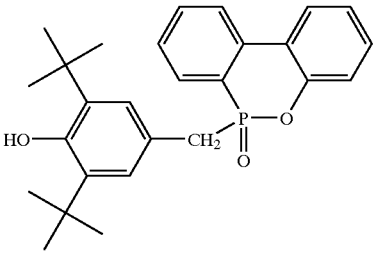

-continued (II)-39

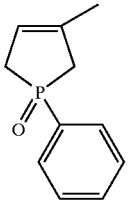

(II)-40

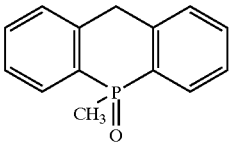

Like the reducing agent, the hydrogen bond-forming compound may be included in a coating solution for producing the thermally developable photosensitive material of the present invention in any form of, for example, a solution, an emulsified dispersion or a dispersion of solid microparticles. While present in the form of a solution, the hydrogen bond-forming compound forms a hydrogen-bonding complex with a compound having a phenolic hydroxyl group or an amino group. Depending on the combination with a reducing agent and a hydrogen bond-forming compound, the complex can be isolated as crystals. Use of a powder in the form of the thus-isolated crystals to form a dispersion of solid microparticles of the hydrogen bond-forming compound is especially preferred from the standpoint of achieving stable performances. Also preferably used is a method of mixing the reducing agent and the hydrogen bond-forming compound both in the form of a powder, followed by milling the resulting mixture together with a suitable dispersant in a sand grinder mill or the like to thereby form a complex while present in the form of a dispersion.

The amount of the hydrogen bond-forming compound to be used preferably falls between 1 and 200 mol %, more preferably between 10 and 150 mol %, and even more preferably between 30 and 100 mol % relative to the amount of the reducing agent used.

The binder to be used in the photosensitive layer of the thermally developable photosensitive material of the present invention is described below.

The binder to be used in the photosensitive layer (that is, the layer containing organic silver salts) in the thermally developable photosensitive material of the present invention may be a polymer of any type, but is preferably transparent or semitransparent and is generally colorless. Preferable examples of the binder are natural resins, polymers and copolymers; synthetic resins, polymers and copolymers; and other film-forming media. More specifically, they include, for example, gelatins, rubbers, poly(vinyl alcohols), hydroxyethyl celluloses, cellulose acetates, cellulose acetate butyrates, poly(vinylpyrrolidones), casein, starch, poly(acrylic acids), poly(methyl methacrylates), poly(vinyl chlorides), poly(methacrylic acids), styrene/maleic anhydride copolymers, styrene/acrylonitrile copolymers, styrene/butadiene copolymers, poly(vinylacetals) (e.g., poly(vinylformal) and poly(vinylbutyral)), poly(esters), poly(urethanes), phenoxy resins, poly(vinylidene chlorides), poly(epoxides), poly(carbonates), poly(vinyl acetates), poly(olefins), cellulose esters, and poly(amides). A coating layer is formed from an aqueous solution, a solution in an organic solvent or an emulsion of the binder.

The glass transition point of the binder to be included in the organic silver salt-containing layer in the present invention preferably falls between 10° C. and 80° C. (the binder of this type will hereinafter be referred to as a high-Tg binder), more preferably between 20° C. and 70° C., even more preferably between 23° C. and 65° C.

As used herein, Tg is calculated according to the following equation:

$$1/Tg=\Sigma(Xi/Tgi)$$

The polymer whose glass transition point Tg is calculated as above comprises n's monomers copolymerized (i indicates the number of the monomers copolymerized, falling between 1 and n); Xi indicates the mass fraction of i'th monomer ($\Sigma Xi=1$); Tgi indicates the glass transition point (in terms of the absolute temperature) of the homopolymer of i'th monomer alone; and $\Sigma$ indicates the sum total of i falling between 1 and n. Incidentally, the value of glass transition point (Tgi) of the homopolymer of each monomer alone is adopted from the values described in "*Polymer Handbook*" (3rd edition) (written by J. Brandrup, E. H. Immergut (Wiley-Interscience, 1989)).

A single kind of polymer may be used for the binder, or alternatively, two or more kinds of polymers may be used in combination. For example, a combination of a polymer having a glass transition point of higher than 20° C. and another polymer having a glass transition point of lower than 20° C. is possible. In case where at least two kinds of polymers that differ in Tg are blended for use therein, it is desirable that the mass-average Tg of the resulting blend falls within the ranges specified as above.

In case where the organic silver salt-containing layer is formed by applying a coating solution in which at least 30% by mass of the solvent is water, followed by drying, and in case where the binder to be included in the organic silver salt-containing layer is soluble or dispersible in an aqueous solvent (watery solvent), and especially when the binder to be included in the organic silver salt-containing layer is a polymer latex having an equilibrium water content of at most 2% by mass at 25° C. and 60% RH, the thermally developable photosensitive material achieves improved properties. Most preferably, the binder for use in the present invention has ionic conductivity at most 2.5 mS/cm. In order to prepare such a binder, employable is a method of preparing a polymer followed by purification through a functional membrane for separation.

The aqueous solvent as used herein in which the polymer binder is soluble or dispersible in water or a mixture of water and at most 70% by mass of a water-miscible organic solvent. The water-miscible organic solvent includes, for example, alcohols such as methyl alcohol, ethyl alcohol, propyl alcohol; cellosolves such as methyl cellosolve, ethyl cellosolve, butyl cellosolve; ethyl acetate, and dimethylformamide.

The terminology "aqueous solvent" as used herein refers to polymer systems in which the polymer is not only thermodynamically dissolved but also is in the form of a dispersion.

The term "equilibrium water content at 25° C. and 60% RH" as used herein is represented by the following equation, in which $W^1$ indicates the mass of a polymer in humidity-conditioned equilibrium at 25° C. and 60% RH, and $W^0$ indicates the absolute dry mass of the polymer at 25° C.

$$\text{Equilibrium water content at 25° C. and 60\% RH} = \{(W^1-W^0)/W^0\}\times 100 \text{ (mass \%)}$$

For the details of the definition of water content and the method for measuring it, for example, referred to is "*Lecture of High Polymer Engineering*", No.14, Test Methods for High Polymer Materials (by the Society of High Polymer of Japan, Chijin Shokan).

Preferably, the equilibrium water content at 25° C. and 60% RH of the binder polymer for use in the present invention is at most 2% by mass, more preferably from 0.01 to 1.5% by mass, even more preferably from 0.02 to 1% by mass.

Polymers for use in the present invention are preferably dispersible in aqueous solvents. Preferable polymer dispersions include, for example, a polymer latex in which water-insoluble hydrophobic polymer microparticles are dispersed, a dispersion in which a molecular or micellar polymer is dispersed, and the like. Any of such a polymer dispersion is preferred for use in the present invention. The particles in the polymer dispersion preferably have a mean particle size falling between 1 and 50,000 nm, more preferably approximately between 5 and 1,000 nm. The particle size distribution of the dispersed particles is not specifically limited. For example, the dispersed particles may have a broad particle size distribution, or may have a monodispersed size distribution.

Preferable examples of polymers which are dispersible in an aqueous solvent for use in the present invention include hydrophobic polymers such as acrylic polymers, poly (esters), rubbers (e.g., SBR resins), poly(urethanes), poly (vinyl chlorides), poly(vinyl acetates), poly(vinylidene chlorides), and poly(olefins). These polymers may be linear, branched or crosslinked. They may be homopolymers from a single monomer, or copolymers from two or more kinds of monomers. The copolymers may be random copolymers or block copolymers. The polymers preferably have a number-average molecular weight falling between 5,000 and 1,000,000, and more preferably between 10,000 and 200,000. If too small a molecular weight of polymer is used, the mechanical strength of the image-forming layer is insufficient; in contrast, if too large a molecular weight of polymer is used, film forming properties are poor.

Preferred examples of polymer latex for use in the present invention are mentioned below. These polymer latexes are expressed by their constituent monomers, in which each numeral in parentheses indicates the proportion, in terms of % by mass, of the monomer unit, and the molecular weight of the constituent monomers represents the number-average molecular weight. When polyfunctional monomers are used, the molecular weights of the constituent monomers are omitted and only referred to as "crosslinked" in parentheses since the concept of molecular weight does not apply thereto. Tg indicates the glass transition point of a polymer latex.

P-1: Latex of -MMA(70)-EA(27)-MAA(3)- (molecular weight: 37,000)

P-2: Latex of -MMA(70)-2EHA(20)-St(5)-AA(5)- (molecular weight: 40,000)

P-3: Latex of -St(50)-Bu(47)-MMA(3)- (crosslinked)

P-4: Latex of -St(68)-Bu(29)-AA(3)- (crosslinked)

P-5: Latex of -St(71)-Bu(26)-AA(3)- (crosslinked, Tg 24° C.)

P-6: Latex of -St(70)-Bu(27)-IA(3)- (crosslinked)

P-7: Latex of -St(75)-Bu(24)-AA(1)- (crosslinked)

P-8: Latex of -St(60)-Bu(35)-DVB(3)-MAA(2)- (crosslinked)

P-9: Latex of -St(70)-Bu(25)-DVB(2)-AA(3)- (crosslinked)

P-10: Latex of -VC(50)-MMA(20)-EA(20)-AN-(5)-AA(5)- (molecular weight: 80,000)

P-11: Latex of -VDC(85)-MMA(5)-EA(5)-MAA(5)- (molecular weight: 67,000)

P-12: Latex of -Et(90)-MAA(10)- (molecular weight: 12000)

P-13: Latex of -St(70)-2EHA(27)-AA(3)- (molecular weight: 130,000)

P-14: Latex of -MMA(63)-EA(35)-AA(2)- (molecular weight: 33,000)

P-15: Latex of -St(70.5)-Bu(26.5)-AA(3)- (crosslinked, Tg 23° C.)

P-16: Latex of -St(69.5)-Bu(27.5)-AA(3)- (crosslinked, Tg 20.5° C.)

Abbreviations of constituent monomers are as follows:

MMA: methyl methacrylate
EA: ethyl acrylate
MAA: methacrylic acid
2EHA: 2-ethylhexyl acrylate
St: styrene
Bu: butadiene
AA: acrylic acid
DVB: divinylbenzene
VC: vinyl chloride
AN: acrylonitrile
VDC: vinylidene chloride
Et: ethylene
IA: itaconic acid The polymer latexes mentioned above are commercially available. Some available products employed in the present invention are mentioned below. Examples of acrylic polymers include CEBIAN A-4635, 4718 and 4601 (produced by Daicel Chemical Industries), and NIPOL Lx811, 814, 821, 820 and 857 (produced by Nippon Zeon); examples of poly(esters) include FINETEX ES650, 611, 675 and 850 (produced by Dai-Nippon Ink & Chemicals), and WD-size and WMS (produced by Eastman Chemical); examples of poly(urethanes) include HYDRAN AP10, 20, 30 and 40 (produced by Dai-Nippon Ink & Chemicals); examples of rubbers include LACSTAR 7310K, 3307B, 4700H and 7132C (produced by Dai-Nippon Ink & Chemicals), and Nipol Lx416, 410, 438C and 2507 (produced by Nippon Zeon); examples of poly(vinyl chlorides) include G351 and G576 (produced by Nippon Zeon); examples of poly (vinylidene chlorides) include L502 and L513 (produced by Asahi Kasei); and examples of poly(olefins) include CHEMIPEARL S120 and SA100 (produced by Mitsui Petrochemical).

These polymer latexes may be used either singly or, as necessary, in combination of two or more.

Particularly preferable polymer latex for use in the present invention is styrene/butadiene copolymer latex. In the styrene/butadiene copolymer, the ratio of styrene monomer unit to butadiene monomer unit preferably falls between 40/60 and 95/5 by mass. Further, the proportion of styrene monomer unit and butadiene monomer unit preferably accounts for from 60 to 99% by mass of the copolymer. The preferred range of the molecular weight of the copolymer is the same as described above.

Preferred styrene/butadiene copolymer latexes for use in the present invention are the above-mentioned P-3 to P-8, P-14 and P-15, and commercially available products, LACSTAR-3307B, 7132C, and NIPOL Lx416.

The organic silver salt-containing layer of the thermally developable photosensitive material of the present invention may optionally contain a hydrophilic polymer serving as a binder, such as gelatin, polyvinyl alcohol, methyl cellulose, hydroxypropyl cellulose and the like. The amount of the hydrophilic polymer to be included in the layer is preferably at most 30% by mass, and more preferably at most 20% by mass of the total binder in the organic silver salt-containing layer.

It is preferable to use a polymer latex as the binder for forming the organic silver salt-containing layer (that is, the image-forming layer) of the thermally developable photosensitive material of the present invention. Specifically, the binder is used in the organic silver salt-containing layer in a ratio of a total binder/an organic silver salt falling between 1/10 and 10/1, and more preferably between 1/5 and 4/1 by mass.

The organic silver salt-containing layer is a photosensitive layer (an emulsion layer) which generally contains a photosensitive silver salt, that is, a photosensitive silver halide. In the layer, the ratio of total binder/silver halide preferably falls between 5 and 400, and more preferably between 10 and 200 by mass.

The overall amount of the binder in the image-forming layer of the thermally developable photosensitive material of the present invention preferably falls between 0.2 and 30 $g/m^2$, and more preferably between 1 and 15 $g/m^2$. The image-forming layer may optionally contain a crosslinking agent, and a surfactant for improving the coatability of the coating solution.

The thermally developable photosensitive material of the present invention contains a non-photosensitive organic silver salt which is relatively stable to light, but forms a silver image when heated to 80° C. or higher in the presence of an exposed photocatalyst (e.g., latent image of photosensitive silver halide) and a reducing agent. The organic silver salt may be any organic substance that contains a source capable of reducing silver ions. Such non-photosensitive organic silver salts are described, for example, in JP-A NO.10-62899, paragraphs [0048] to [0049]; EP No.0803764A1, from page 18 line 24 to page 19, line 37; and EP No.0962812A1. Silver salts of organic acids, especially silver salts of long-chained (C10 to C30, preferably C15 to C28) aliphatic carboxylic acids are preferable. Preferred examples of the organic silver salts include silver behenate, silver arachidate, silver stearate, silver oleate, silver laurate, silver caproate, silver myristate, silver palmitate, and the mixtures thereof. Among these, especially preferred are organic silver salts containing at least 75 mol % of silver behenate.

The shape of particles of an organic silver salt usable in the present invention is not particularly limited, and may be a needle, rod, plate or flake shape.

Preferably, a flaky organic silver salt is used in the present invention. Herein, flaky organic silver salts are defined as follows. If the salt is examined through an electron microscope and the shape of the particles is considered to be approximately a rectangular parallelepiped, its sides are named "a", "b" and "c" in an order beginning with the shortest dimension ("c" may be equal to "b"), and the values of the two shortest sides "a" and "b" are used to calculate "x" by the following equation:

$$x=b/a$$

The value "x" is calculated for about 200 particles and if their mean value, x (mean)≧1.5, the particles are defined as flaky. Preferably, 30≧x (mean)≧1.5, and more preferably 20≧x (mean)≧2.0. Incidentally, the particles are needle-shaped if 1≦x (mean)<1.5.

Side "a" of a flaky particle can be regarded as the thickness of a plate-shaped particle having a principal face defined by sides "b" and "c". The mean value of "a" is preferably from 0.01 to 0.23 μm, and more preferably from 0.1 to 0.20 μm. The mean value of c/b is preferably from 1 to 6, more preferably from 1.05 to 4, still more preferably from 1.1 to 3, and particularly preferably from 1.1 to 2.

The particle sizes of the organic silver salt preferably have a monodispersed size distribution. In the monodispersed distribution, the standard deviation of the length of the minor axis or major axis of the particles divided by a length value of the minor axis or major axis, respectively, is preferably not more than 100%, more preferably not more than 80%, and still more preferably not more than 50%. The shape of particles of the salt can be determined from an observed image of a dispersion thereof through a transmission electron microscope. The particle size distribution of the salt can alternatively be determined by employing the standard deviation of the volume weighted mean diameter of the particles, and is monodispersed if a percentage obtained by dividing the standard deviation of the volume weighted mean diameter by the volume weighted mean diameter (coefficient of variation) is not more than 100%, more preferably not more than 80%, and still more preferably not more than 50%. The particle size (volume weighted mean diameter) can be determined, for example, by applying laser light to the organic silver salt dispersed in a liquid and determining an autocorrelation function of the variation of fluctuation of scattered light with time.

Known methods can be employed to prepare and disperse an organic silver salt usable in the present invention. Reference can be made to, for example, Japanese Patent Application Laid-Open No. 62899/1998, European Patent Laid-Open No. 0803763A1 and European Patent Laid-Open No.962812A1.

A dispersion of the organic silver salt is preferably substantially free from any photosensitive silver salt, since fogging will be increased and its sensitivity will be greatly lowered. According to the present invention, an aqueous dispersion contains not more than 0.1 mol % of a photosensitive silver salt per 1 mol % of the organic silver salt, and photosensitive silver salt should not be added thereto.

According to the present invention, the photosensitive material can be prepared by mixing an aqueous dispersion of an organic silver salt with an aqueous dispersion of a photosensitive silver salt in a ratio depending on the purpose for which it will be used, preferably employing 1 to 30 mol %, more preferably 3 to 20 mol %, and still more preferably 5 to 15 mol % of the photosensitive silver salt relative to the organic silver salt. It is preferable, for obtaining a material having controlled photographic properties, to mix two or more kinds of aqueous dispersions of organic silver salts with two or more kinds of aqueous dispersions of photosensitive silver salts.

According to the present invention, the organic silver salt may be used in any amount as desired, but preferably in an amount containing 0.1 to 5 g/m$^2$, and more preferably 1 to 3 g/m$^2$ in terms of silver.

The thermally developable photosensitive material of the present invention preferably contains a reducing agent for silver ions. The reducing agent (preferably an organic substance) may be any substance capable of reducing a silver ion to metallic silver. Such reducing agents are described in paragraphs [0043] to [0045] of Japanese Patent Application Laid-Open No. 65021/1999, and page 7, line 34 to page 18, line 12 of European Patent Laid-Open No. 0803764A1.

A bisphenol-type reducing agent is preferably used as the reducing agent in the present invention. Particularly preferable are compounds of the following general formula (1):

General Formula (1)

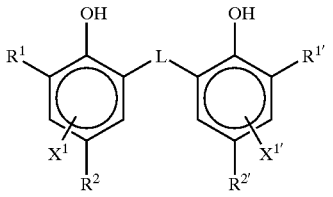

In the general formula (1), $R^1$ and $R^{1'}$ each independently represent an alkyl group; $R^2$ and $R^{2'}$ each independently represent a hydrogen atom, or a substituent for the benzene ring; $X^1$ and $X^{1'}$ each independently represent a hydrogen atom, or a substituent for the benzene ring; $R^1$ and $X^1$, $R^{1'}$ and $X^{1'}$, $R^2$ and $X^1$, and $R^{2'}$ and $X^{1'}$ may be bonded to each other to form a ring; L represents a group of —S— or —CHR$^3$—; and $R^3$ represents a hydrogen atom or an alkyl group.

In the general formula (1), $R^1$ and $R^{1'}$ each independently represent a substituted or unsubstituted, linear, branched or cyclic alkyl group. The alkyl group preferably has 1 to 20 carbon atoms. The substituent for the alkyl group is not specifically limited, but preferably includes, for example, an aryl group, a hydroxyl group, an alkoxy group, an aryloxy group, an alkylthio group, an arylthio group, an acylamino group, a sulfonamido group, a sulfonyl group, a phosphoryl group, an acyl group, a carbamoyl group, an ester group, and a halogen atom.

More preferably, $R^1$ and $R^{1'}$ are secondary or tertiary alkyl groups having 3 to 15 carbon atoms, specifically including, for example, isopropyl, isobutyl, tert-butyl, tert-amyl, tert-octyl, cyclohexyl, cyclopentyl, 1-methylcyclohexyl and 1-methylcyclopropyl groups. More specifically, preferred is a tertiary alkyl group having 4 to 12 carbon atoms; even more preferred are tert-butyl, tert-amyl and 1-methylcyclohexyl groups; and most preferred is a tert-butyl group.

$R^2$ and $R^{2'}$ each independently represent a hydrogen atom, or a substituent for the benzene ring; $X^1$ and $X^{1'}$ each independently represent a hydrogen atom, or a substituent for the benzene ring. Preferred examples of the substituent for the benzene ring are an alkyl group, an aryl group, a halogen atom, an alkoxy group, and an acylamino group.

$R^2$ and $R^{2'}$ are preferably alkyl groups having 1 to 20 carbon atoms, specifically including, for example, methyl, ethyl, propyl, butyl, isopropyl, tert-butyl, tert-amyl, cyclohexyl, 1-methylcyclohexyl, benzyl, methoxymethyl and methoxyethyl groups. More preferred are methyl, ethyl, propyl, isopropyl and tert-butyl groups.

$X^1$ and $X^{1'}$ are preferably hydrogen atoms, halogen atoms or alkyl groups; and particularly preferably, they are hydrogen atoms.

$R^1$ and $X^1$, $R^{1'}$ and $X^{1'}$, $R^2$ and $X^1$, and $R^{2'}$ and $X^{1'}$ may be bonded to each other to form a ring. Preferably, the ring is a 5- to 7-membered ring, and is more preferably a saturated 6-membered ring.

L represents a group of —S— or —CHR$^3$-group, but is preferably —CHR$^3$-group.

$R^3$ represents a hydrogen atom or an alkyl group. The alkyl group represented by $R^3$ may be linear, branched or cyclic, and may have substituents. Preferably, the alkyl group represented by $R^3$ has 1 to 20 carbon atoms, more preferably 1 to 15 carbon atoms. Examples of the unsubstituted alkyl group include methyl, ethyl, propyl, butyl, heptyl, undecyl, isopropyl, 1-ethylpentyl and 2,4,4-trimethylpentyl groups. The substituent for the alkyl group includes, for example, a halogen atom, an alkoxy group, an alkylthio group, an aryloxy group, an arylthio group, an acylamino group, a sulfonamido group, a sulfonyl group, a phosphoryl group, an oxycarbonyl group, a carbamoyl group, and a sulfamoyl group. Preferably, $R^3$ is a hydrogen atom, or a methyl, ethyl, propyl, isopropyl or 2,4,4-trimethylpentyl group. More preferably, $R^3$ is a hydrogen atom, or a methyl, ethyl or propyl group.

In case where $R^3$ in formula (I) is a hydrogen atom, $R^2$ and $R^{2'}$ are preferably alkyl groups having 2 to 5 carbon atoms, more preferably ethyl or propyl groups, most preferably, they are ethyl groups.

In case where $R^3$ is a primary or secondary alkyl group having 1 to 8 carbon atoms, $R^2$ and $R^{2'}$ are preferably methyl groups. The primary or secondary alkyl group having 1 to 8 carbon atoms for $R^3$ is preferably a methyl, ethyl, propyl or isopropyl group, more preferably a methyl, ethyl or propyl group.

Among the compounds represented by the general formula (1), especially preferred are those in which $R^1$ and $R^{1'}$ each independently represent a secondary or tertiary alkyl group, $R^2$ and $R^{2'}$ each represent independently an alkyl group, $R^3$ is a hydrogen atom or an alkyl group, and $X^1$ and $X^{1'}$ are both hydrogen atoms; and those in which $R^1$ and $R^{1'}$ each represent a tertiary alkyl group, $R^2$ and $R^{2'}$ each represent an alkyl group, and $R^3$ is a hydrogen atom or an alkyl group; and more preferred are those in which $R^1$ and $R^{1'}$ each represent a tertiary alkyl group, $R^2$ and $R^{2'}$ represent an alkyl group having at least 2 carbon atoms, and $R^3$ is a hydrogen atom.

Examples of the compound represented by the general formula (1) are listed below, however, the compounds employable in the present invention are not limited thereto.

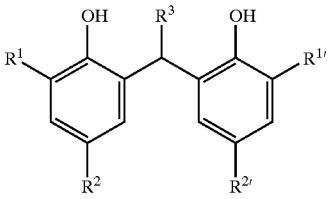

| | $R^1$ | $R^{1'}$ | $R^2$ | $R^{2'}$ | $R^3$ |
|---|---|---|---|---|---|
| I-1 | $CH_3$ | $CH_3$ | $CH_3$ | $CH_3$ | H |
| I-2 | $CH_3$ | $CH_3$ | $CH_3$ | $CH_3$ | $CH_3$ |
| I-3 | $CH_3$ | $CH_3$ | $CH_3$ | $CH_3$ | $C_3H_7$ |
| I-4 | $CH_3$ | $CH_3$ | $CH_3$ | $CH_3$ | i-$C_3H_7$ |
| I-5 | $CH_3$ | $CH_3$ | $CH_3$ | $CH_3$ | $CH(C_2H_5)C_4H_9$ |
| I-6 | $CH_3$ | $CH_3$ | $CH_3$ | $CH_3$ | $CH_2CH(CH_3)CH_2C(CH_3)_3$ |
| I-7 | $CH_3$ | $CH_3$ | $C_2H_5$ | $C_2H_5$ | H |
| I-8 | $CH_3$ | $CH_3$ | $C_2H_5$ | $C_2H_5$ | i-$C_3H_7$ |
| I-9 | $C_2H_5$ | $C_2H_5$ | $CH_3$ | $CH_3$ | H |
| I-10 | $C_2H_5$ | $C_2H_5$ | $CH_3$ | $CH_3$ | i-$C_3H_7$ |
| I-11 | t-$C_4H_9$ | t-$C_4H_9$ | $CH_3$ | $CH_3$ | H |
| I-12 | t-$C_4H_9$ | t-$C_4H_9$ | $CH_3$ | $CH_3$ | $CH_3$ |
| I-13 | t-$C_4H_9$ | t-$C_4H_9$ | $CH_3$ | $CH_3$ | $C_2H_5$ |
| I-14 | t-$C_4H_9$ | t-$C_4H_9$ | $CH_3$ | $CH_3$ | n-$C_3H_7$ |
| I-15 | t-$C_4H_9$ | t-$C_4H_9$ | $CH_3$ | $CH_3$ | n-$C_4H_9$ |
| I-16 | t-$C_4H_9$ | t-$C_4H_9$ | $CH_3$ | $CH_3$ | n-$C_7H_{15}$ |
| I-17 | t-$C_4H_9$ | t-$C_4H_9$ | $CH_3$ | $CH_3$ | n-$C_{11}H_{23}$ |
| I-18 | t-$C_4H_9$ | t-$C_4H_9$ | $CH_3$ | $CH_3$ | i-$C_3H_7$ |
| I-19 | t-$C_4H_9$ | t-$C_4H_9$ | $CH_3$ | $CH_3$ | $CH(C_2H_5)C_4H_9$ |
| I-20 | t-$C_4H_9$ | t-$C_4H_9$ | $CH_3$ | $CH_3$ | $CH_2CH(CH_3)_2$ |
| I-21 | t-$C_4H_9$ | t-$C_4H_9$ | $CH_3$ | $CH_3$ | $CH_2CH(CH_3)CH_2C(CH_3)_3$ |
| I-22 | t-$C_4H_9$ | t-$C_4H_9$ | $CH_3$ | $CH_3$ | $CH_2OCH_3$ |
| I-23 | t-$C_4H_9$ | t-$C_4H_9$ | $CH_3$ | $CH_3$ | $CH_2CH_2OCH_3$ |
| I-24 | t-$C_4H_9$ | t-$C_4H_9$ | $CH_3$ | $CH_3$ | $CH_2CH_2OC_4H_9$ |
| I-25 | t-$C_4H_9$ | t-$C_4H_9$ | $CH_3$ | $CH_3$ | $CH_2CH_2SC_{12}H_{25}$ |

-continued

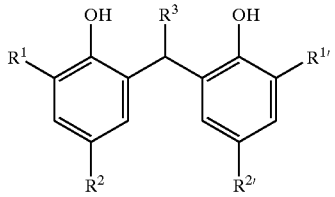

| | $R^1$ | $R^{1'}$ | $R^2$ | $R^{2'}$ | $R^3$ |
|---|---|---|---|---|---|
| I-26 | t-$C_4H_9$ | t-$C_4H_9$ | $C_2H_5$ | $C_2H_5$ | H |
| I-27 | t-$C_4H_9$ | t-$C_4H_9$ | $C_2H_5$ | $C_2H_5$ | $CH_3$ |
| I-28 | t-$C_4H_9$ | t-$C_4H_9$ | $C_2H_5$ | $C_2H_5$ | n-$C_3H_7$ |
| I-29 | t-$C_4H_9$ | t-$C_4H_9$ | $C_2H_5$ | $C_2H_5$ | i-$C_3H_7$ |
| I-30 | t-$C_4H_9$ | t-$C_4H_9$ | $C_2H_5$ | $C_2H_5$ | $CH_2CH_2OCH_3$ |
| I-31 | t-$C_4H_9$ | t-$C_4H_9$ | n-$C_3H_7$ | n-$C_3H_7$ | H |
| I-32 | t-$C_4H_9$ | t-$C_4H_9$ | n-$C_3H_7$ | n-$C_3H_7$ | $CH_3$ |
| I-33 | t-$C_4H_9$ | t-$C_4H_9$ | n-$C_3H_7$ | n-$C_3H_7$ | n-$C_3H_7$ |
| I-34 | t-$C_4H_9$ | t-$C_4H_9$ | n-$C_4H_9$ | n-$C_4H_9$ | H |
| I-35 | t-$C_4H_9$ | t-$C_4H_9$ | n-$C_4H_9$ | n-$C_4H_9$ | $CH_3$ |
| I-36 | t-$C_4H_{11}$ | t-$C_5H_{11}$ | $CH_3$ | $CH_3$ | H |
| I-37 | t-$C_5H_{11}$ | t-$C_5H_{11}$ | $CH_3$ | $CH_3$ | $CH_3$ |
| I-38 | t-$C_5H_{11}$ | t-$C_5H_{11}$ | $C_2H_5$ | $C_2H_5$ | H |
| I-39 | t-$C_5H_{11}$ | t-$C_5H_{11}$ | $C_2H_5$ | $C_2H_5$ | $CH_3$ |
| I-40 | i-$C_3H_7$ | i-$C_3H_7$ | $CH_3$ | $CH_3$ | H |
| I-41 | i-$C_3H_7$ | i-$C_3H_7$ | $CH_3$ | $CH_3$ | n-$C_3H_7$ |
| I-42 | i-$C_3H_7$ | i-$C_3H_7$ | $C_2H_5$ | $C_2H_5$ | H |
| I-43 | i-$C_3H_7$ | i-$C_3H_7$ | $C_2H_5$ | $C_2H_5$ | n-$C_3H_7$ |
| I-44 | i-$C_3H_7$ | i-$C_3H_7$ | i-$C_3H_7$ | i-$C_3H_7$ | H |
| I-45 | i-$C_3H_7$ | i-$C_3H_7$ | i-$C_3H_7$ | i-$C_3H_7$ | $CH_3$ |
| I-46 | t-$C_4H_9$ | $CH_3$ | $CH_3$ | $CH_3$ | H |
| I-47 | t-$C_4H_9$ | $CH_3$ | $CH_3$ | $CH_3$ | $CH_3$ |
| I-48 | t-$C_4H_9$ | $CH_3$ | $CH_3$ | $CH_3$ | n-$C_3H_7$ |
| I-49 | t-$C_4H_9$ | $CH_3$ | t-$C_4H_9$ | $CH_3$ | $CH_3$ |
| I-50 | i-$C_3H_7$ | $CH_3$ | $CH_3$ | $CH_3$ | $CH_3$ |

I-51

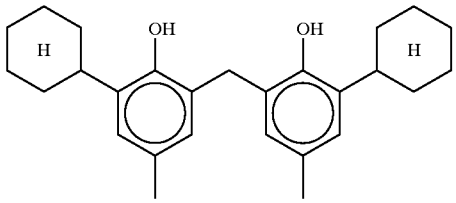

I-52

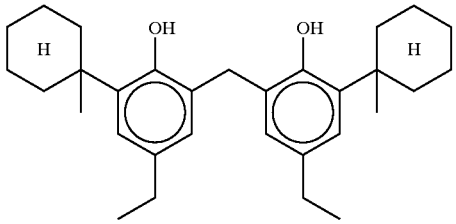

I-53

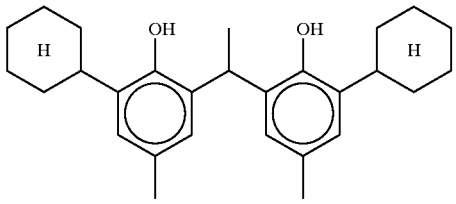

-continued
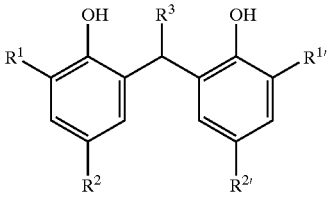
| $R^1$ | $R^{1'}$ | $R^2$ | $R^{2'}$ | $R^3$ |
|---|---|---|---|---|
I-54
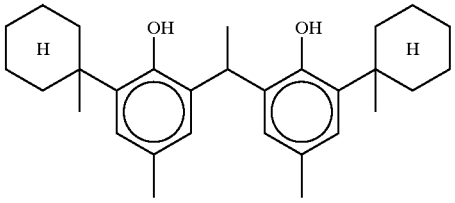
I-55
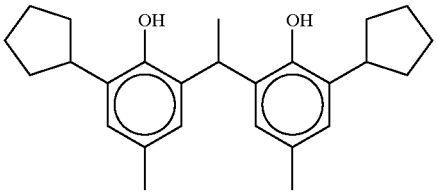
I-56
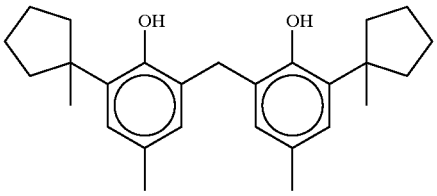
I-57
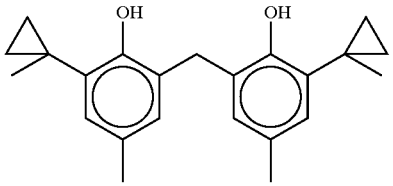
I-58
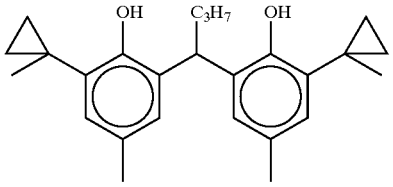
-continued
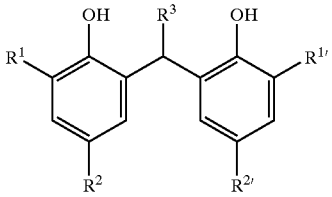
| $R^1$ | $R^{1'}$ | $R^2$ | $R^{2'}$ | $R^3$ |
|---|---|---|---|---|
I-59
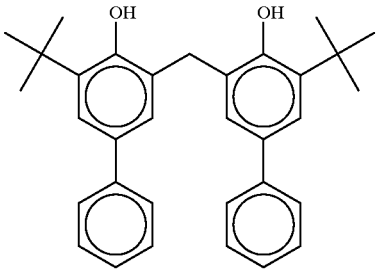
I-60
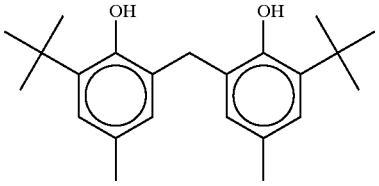
I-61
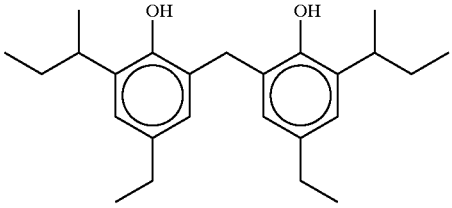
I-62
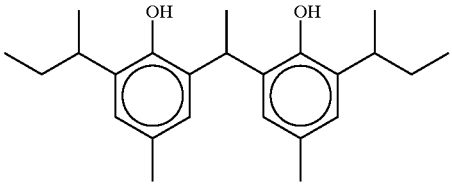
I-63
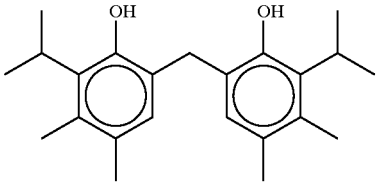

-continued
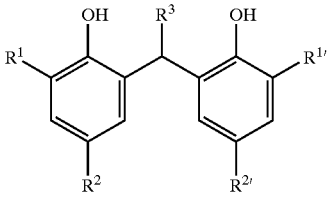
| $R^1$ | $R^{1'}$ | $R^2$ | $R^{2'}$ | $R^3$ |
|---|---|---|---|---|
I-64
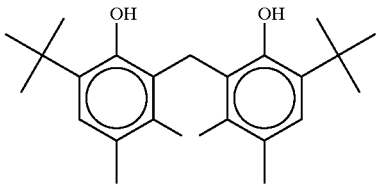
I-65
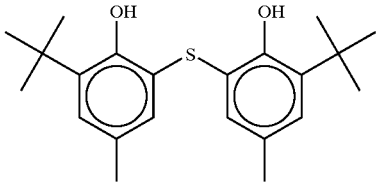
I-66
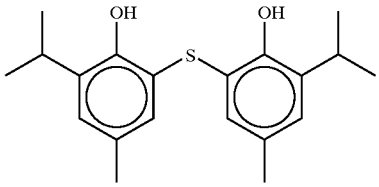
I-67
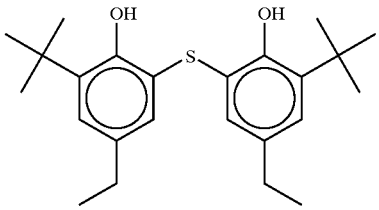
I-68
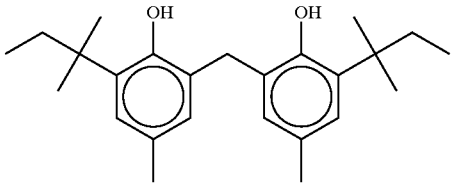
I-69
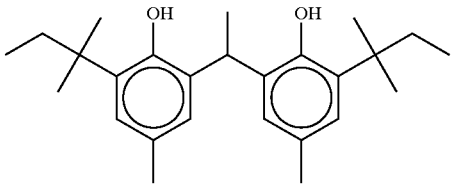
-continued
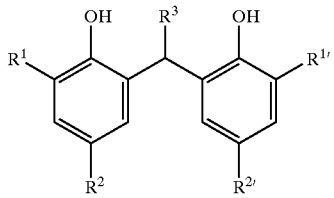
| $R^1$ | $R^{1'}$ | $R^2$ | $R^{2'}$ | $R^3$ |
|---|---|---|---|---|
I-70
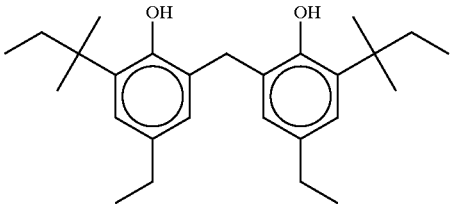
I-71
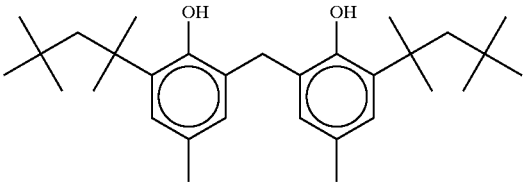
I-72
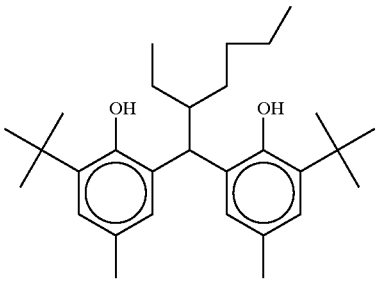
I-73
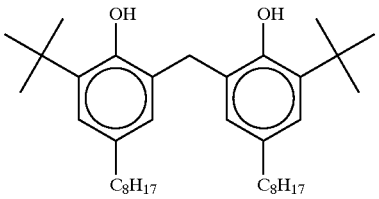
I-74
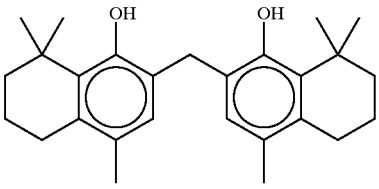

-continued

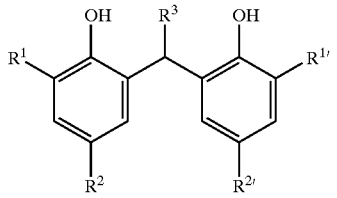

| R1 | R1' | R2 | R2' | R3 |
|---|---|---|---|---|

I-75

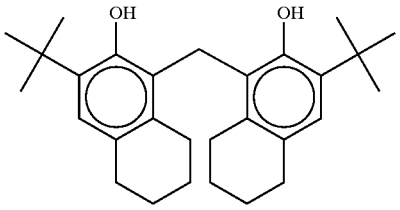

I-76

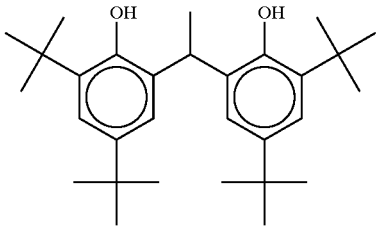

I-77

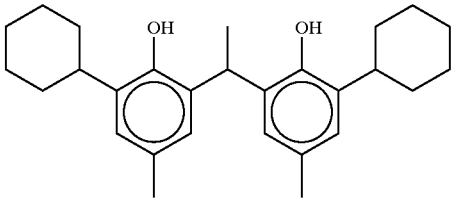

I-78

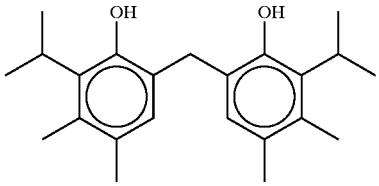

I-79

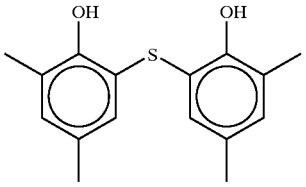

-continued

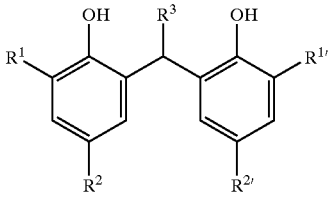

| R1 | R1' | R2 | R2' | R3 |
|---|---|---|---|---|

I-80

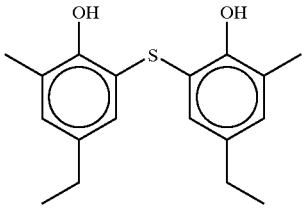

Preferably, the amount of the reducing agent to be added falls between 0.01 and 5.0 g/m$^2$, more preferably between 0.1 and 3.0 g/m$^2$. Specifically, the amount of the reducing agent to be added falls between 5 and 50 mol %, more preferably between 10 and 40 mol %, per mol of silver present in the face of the image-forming layer of the material. Particularly preferably, the reducing agent is included in the image-forming layer of the material.

The reducing agent may be added to the coating solution in any form of an emulsified dispersion, a dispersion of solid microparticles and the like by employing any known method so as to be incorporated into the thermally developable photosensitive material of the present invention.

A well known method of emulsifying and dispersing the reducing agent comprises dissolving the reducing agent in an auxiliary solvent such as dibutyl phthalate, tricresyl phosphate, glyceryl triacetate, diethyl phthalate or the like oily solvent, or in ethyl acetate or cyclohexanone, followed by mechanical operation to form an emulsifed dispersion.

In order to prepare a solid microparticle dispersion of the reducing agent, for example, employable is a method that comprises dispersing a powder of the reducing agent in water or any other suitable solvent by means of a ball mill, a colloid mill, a shaking ball mill, a sand mill, a jet mill or a roller mill, or ultrasonically to thereby prepare a desired dispersion of the solid reducing agent. In this method, a protective colloid (e.g., polyvinyl alcohol), and a surfactant (e.g., anionic surfactant such as sodium triisopropylnaphthalenesulfonate, which is a mixture of the sodium salts in which three isopropyl groups are present in different positions) may be used. If desired, the aqueous dispersion may contain a preservative (e.g., sodium benzoisothiazolinone).

In order to form an image-forming layer, a crosslinking agent, and a surfactant for improving coatability of the coating solution may be used.

Fogging inhibitors, stabilizers and stabilizer precursors for use in the present invention are described, for example, in JP-A No.10-62899, paragraph [0070], and in EP No.0803764A1, from page 20, line 57 to page 21, line 7. Fogging inhibitors preferred for use in the present invention are organic halides as described, for example, in JP-A No.11-65012, paragraphs [0111] to [0112]. Particularly preferred are organic halides of formula (P) in JP-A No.11-

87297; and organic polyhalogen compounds of formula (II) in JP-A No.10-339934.

Organic polyhalogen compounds used as the fogging inhibitor in the present invention are specifically described below. Preferable polyhalogen compounds are represented by the following formula (III):

$$Q—(Y)n—C(Z^1)(Z^2)X \quad (III)$$

wherein Q represents an optionally-substituted alkyl, aryl or heterocyclic group; Y represents a divalent linking group; n indicates 0 or 1; $Z^1$ and $Z^2$ each represent a halogen atom; and X represents a hydrogen atom or an electron-attracting group.

In formula (III), the alkyl group represented by Q is a linear, branched or cyclic alkyl group, preferably having 1 to 20, more preferably 1 to 12, even more preferably 1 to 6 carbon atoms, including for example methyl, ethyl, allyl, n-propyl, isopropyl, sec-butyl, isobutyl, tert-butyl, sec-pentyl, isopentyl, tert-pentyl, tert-octyl and 1-methylcyclohexyl groups. Among them, a tertiary alkyl group is preferable.

The alkyl group represented by Q may have substituents. Any substituent without exerting any negative influence on the photographic properties of the thermally developable photosensitive material of the present invention may be used. Examples of the substituent include a halogen atom (e.g., fluorine, chlorine, bromine, iodine), an alkyl group, an alkenyl group, an alkynyl group, an aryl group, a heterocyclic group (including N-substituted nitrogen-containing heterocyclic groups, e.g., morpholino), an alkoxycarbonyl group, an aryloxycarbonyl group, a carbamoyl group, an imino group, an N atom-substituted imino group, a thiocarbonyl group, a carbazoyl group, a cyano group, a thiocarbamoyl group, an alkoxy group, an aryloxy group, a heterocyclic-oxy group, an acyloxy group, an (alkoxy or aryloxy)carbonyloxy group, a sulfonyloxy group, an acylamido group, a sulfonamido group, an ureido group, a thioureido group, an imido group, an (alkoxy or aryloxy) carbonylamino group, a sulfamoylamino group, a semicarbazido group, a thiosemicarbazido group, an (alkyl or aryl)sulfonylureido group, a nitro group, an (alkyl or aryl) sulfonyl group, a sulfamoyl group, a group having a phosphoramide or phosphate structure, a silyl group, a carboxyl group or its salts, a sulfo group or its salts, a phosphoric acid group, a hydroxyl group, and a quaternary ammonium group. These substituents may further be substituted with these substituents.

The aryl group represented by Q in formula (III) may be a monocyclic or condensed aryl group, preferably having 6 to 20, more preferably 6 to 16, even more preferably 6 to 10 carbon atoms, among which phenyl and naphthyl groups are preferred.

The aryl group represented by Q may optionally have substituents. Any substituent without exerting any negative influence on the photographic properties of the thermally developable photosensitive material of the present invention may be used. Examples of the substituent includes the same substituents as listed for the alkyl group stated above. Especially preferable for Q is a phenyl group substituted with an electron-attracting group having a positive Hammett's substituent constant $\sigma_p$. The substituent constant $\sigma_p$ of the electron-attracting group preferably falls between 0.2 and 2.0, more preferably between 0.4 and 1.0. Specific examples of the electron-attracting group include a cyano group, an alkoxycarbonyl group, an aryloxycarbonyl group, a carbamoyl group, a sulfamoyl group, an alkylsulfonyl group, an arylsulfonyl group, an alkylphosphoryl group, a sulfoxido group, an acyl group, a heterocyclic group, a halogen atom, a halogenated alkyl group, and a phosphoryl group. More preferably, the electron-attracting group is a carbamoyl group, an alkoxycarbonyl group, an alkylsulfonyl group, or an alkylphosphoryl group. Among these, most preferred is a carbamoyl group.

The heterocyclic group represented by Q in formula (III) is preferably a 5- to 7-membered, saturated or unsaturated, monocyclic or condensed heterocyclic ring having at least one heteroatom selected from the group consisting of nitrogen, oxygen and sulfur atoms. Preferred examples of the heterocyclic ring include pyridine, quinoline, isoquinoline, pyrimidine, pyrazine, pyridazine, phthalazine, triazine, furan, thiophene, pyrrole, oxazole, benzoxazole, thiazole, benzothiazole, imidazole, benzimidazole, thiadiazole, and triazole. More preferred are pyridine, quinoline, pyrimidine, thiadiazole, and benzothiazole; and even more preferred are pyridine, quinoline, and pyrimidine.

The heterocyclic group represented by Q may optionally have substituents similarly to the substituents for the alkyl group represented by Q stated above.

Particularly preferable Q is a phenyl group substituted with an electron-attracting group having a positive Hammett's substituent constant $\sigma_p$.

Q in formula (III) may be substituted with any of a ballast group, an adsorbing group for silver salt and a group for providing water-solubility, that are generally used in photographic materials for retarding diffusion, or alternatively may be those capable of polymerizing each other to form a polymer, or bonding to each other to form a bis-, tris- or tetrakis-structure.

In formula (III), Y represents a divalent linking group, preferably —$SO_2$—, —SO—, or —CO—, more preferably —$SO^2$—.

In formula (III), n is 0 or 1, preferably 1.

$Z^1$ and $Z^2$ in formula (III) each independently represent a halogen atom (e.g., fluorine, chlorine, bromine, iodine), and most preferably, they are both bromine atoms.

X in formula (III) represents a hydrogen atom or an electron-attracting group. The electron-attracting group represented by X is a substituent having a positive Hammett's substituent constant $\sigma_p$, such as a cyano group, an alkoxycarbonyl group, an aryloxycarbonyl group, a carbamoyl group, a sulfamoyl group, an alkylsulfonyl group, an arylsulfonyl group, a halogen atom, an acyl group, and a heterocyclic group. Preferably, X is a hydrogen atom or a halogen atom, most preferably a bromine atom.

The polyhalogen compounds represented by formula (III) are described in, for example, U.S. Pat. Nos. 3,874,946, 4,756,999, 5,340,712, 5,369,000, 5,464,737; JP-A NOs.50-137126, 50-89020, 50-119624, 59-57234, 7-2781, 7-5621, 9-160164, 10-197988, 9-244177, 9-244178, 9-160167, 9-319022, 9-258367, 9-265150, 9-319022, 10-197989, 11-242304, 10-181459, 10-292864, 11-90095, 11-89773 and 11-205330.

Examples of the polyhalogen compounds represented by formula (III) are listed below, however, the compounds employable in the present invention are not limited thereto (P-1)

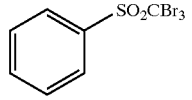

-continued
(P-2)
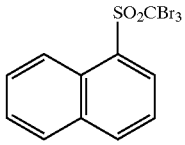
(P-3)
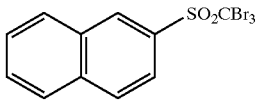
(P-4)
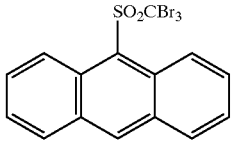
(P-5)
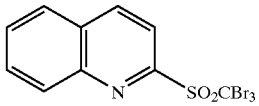
(P-6)
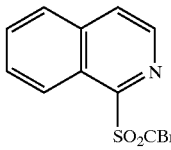
(P-7)
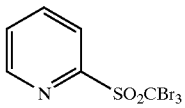
(P-8)
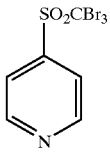
(P-9)
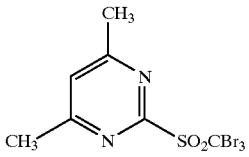
(P-10)
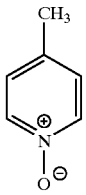
(P-11)
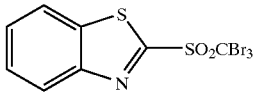
(P-12)
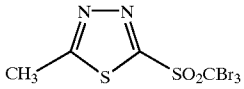
-continued
(P-13)
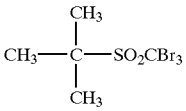
(P-14)
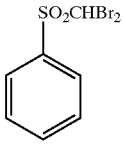
(P-15)
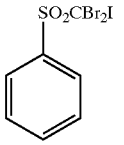
(P-16)
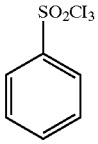
(P-17)
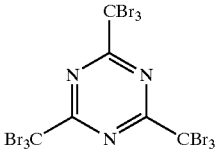
(P-18)
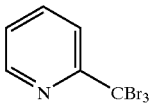
(P-19)
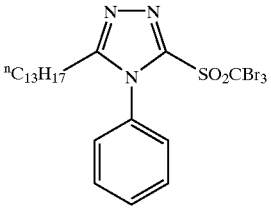
(P-20)
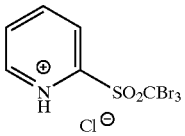
(P-21)
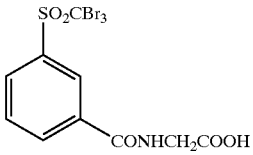
(P-22)
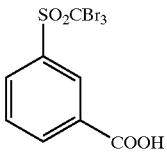

-continued
(P-23)
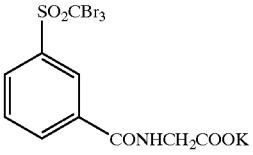
(P-24)
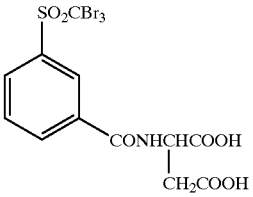
(P-25)
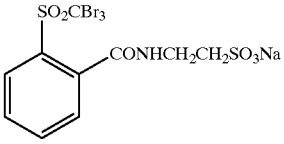
(P-26)
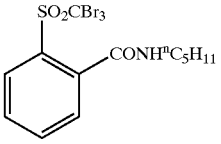
(P-27)
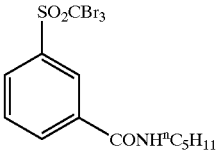
(P-28)
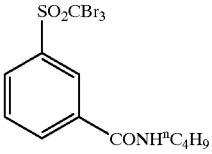
(P-29)
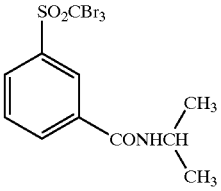
(P-30)
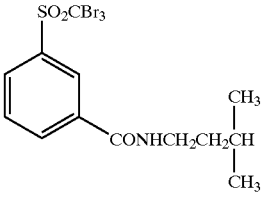
(P-31)
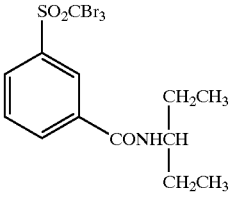
-continued
(P-32)
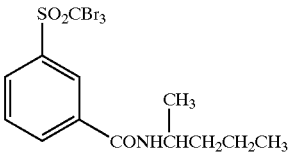
(P-33)
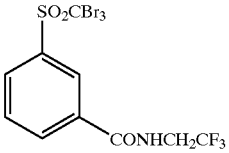
(P-34)
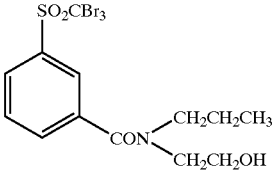
(P-35)
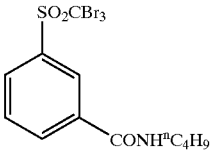
(P-36)
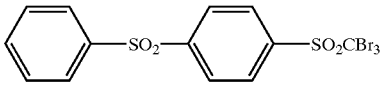
(P-37)
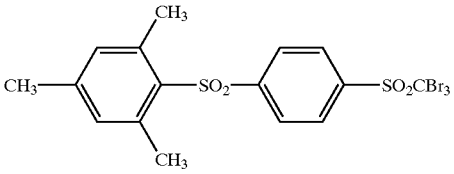
(P-38)
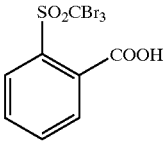
(P-39)
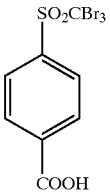
(P-40)
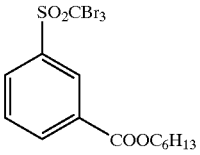

-continued (P-41)

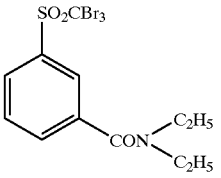

(P-42)

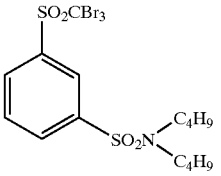

(P-43)

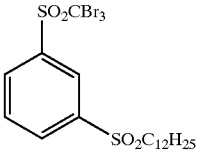

(P-44)

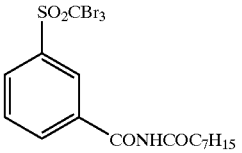

(P-45)

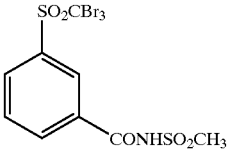

Polyhalogen compounds represented by formula (III) may be used either singly or in combination of two or more.

Preferably, the amount of the compound of formula (III) to be added falls between $10^{-4}$ and 1 mol, more preferably between $10^{-3}$ and 0.8 mol, even more preferably between $5\times10^{-3}$ and 0.5 mol, per mol of the non-photosensitive silver salt present in the image-forming layer.

The fogging inhibitors may be incorporated into the thermally developable photosensitive material of the present invention in the same manner as conducted for the reducing agent. Preferably, the organic polyhalogen compound is also incorporated into the material in the form of a solid microparticle dispersion.

Additional fogging inhibitors for use in the present invention include, for example, mercury(II) salts described in JP-A No.11-65021, paragraph [0113]; benzoic acids described in JP-A No.11-65021, paragraph [0114]; salicylic acid derivatives of formula (Z) described in JP-A No.11-87297; formalin scavenger compounds of formula (S) described in JP-A No.11-23995; triazine compounds stated in claim 9 in JP-A No.11-352624; the compounds of formula (III) in JP-A No.6-11791; and 4-hydroxy-6-methyl-1,3,3a,7-tetrazaindene.

The thermally developable photosensitive material of the present invention may contain an azolium salt for the purpose of fogging inhibition. Examples of azolium salts include the compounds of formula (XI) described in JP-A No.59-193447, the compounds described in JP-B No.55-12581, and the compounds of formula (II) described in JP-A No.60-153039. The azolium salt may be added to any site of the thermally developable photosensitive material. Preferably, the salt is included in any layer on the side having an image-forming layer, and more preferably in the organic silver salt-containing layer of the material. The azolium salt may be added to the coating solution at any stage of preparing the liquid. When included in the organic silver salt-containing layer, the azolium salt may be added to the coating solution at any stage of preparing them, preferably after the step of preparing the organic silver salt and immediately before the stage of coating the liquid. The azolium salt may be added in any form of a powder, a solution or a dispersion of microparticles. It may be added in combination with other additives such as a sensitizing dye, a reducing agent and a toning agent in the form of a solution. The amount of the azolium salt to be added to the thermally developable photosensitive material of the present invention is not specifically limited, but preferably falls between $1\times10^{-6}$ mols and 2 mols, more preferably between $1\times10^{-3}$ mols and 0.5 mol, per mol of silver.

The thermally developable photosensitive material of the present invention may optionally contain any of mercapto compounds, disulfide compounds and thione compounds in order to control, i.e., or to promote the developability of the material, or to enhance the spectrally sensitizing efficiency, or to improve the storability before and after development. For the above purposes, for example, reference is made to JP-A No.10-62899, paragraphs [0067] to [0069]; compounds of formula (I) in JP-A No.10-186572, and their illustrative examples in paragraphs [0033] to [0052]; EP No.0803764A1, page 20, lines 36 to 56; and JP-A No.11-273670. Among others, preferred are mercapto-substituted heteroaromatic compounds.

It is preferred to add a toning agent to the thermally developable photosensitive material of the present invention. Examples of the toning agent for use in the present invention are described in JP-A No.10-62899, paragraphs [0054] to [0055]; EP 0803764A1, page 21, lines 23 to 48; and JP-A No.35631/2000. Preferred for use are phthalazinones (phthalazinone, phthalazinone derivatives and their metal salts, e.g., 4-(1-naphthyl)phthalazinone, 6-chlorophthalazinone, 5,7-dimethoxyphthalazinone, 2,3-dihydro-1,4-phthalazinone); combinations of phthalazinones and phthalic acids (e.g., phthalic acid, 4-methylphthalic acid, 4-nitrophthalic acid and tetrachlorophthalic anhydride); phthalazines (phthalazine, phthalazine derivatives and their metal salts, e.g., 4-(1-naphthyl)phthalazine, 6-isopropylphthalazine, 6-tert-butylphthalazine, 6-chlorophthalazine, 5,7-dimethoxyphthalazine and 2,3-dihydrophthalazine); combinations of phthalazines and phthalic acids. Particularly preferred are combinations of phthalazines and phthalic acids.

Plasticizers and lubricants that may be used in the image-forming layer of the thermally developable photosensitive material of the present invention are described in, for example, JP-A No.11-65021, paragraph [0117]. As to ultrahard gradation enhancing agent for forming ultrahard gradatiom images, methods of using them, and their addition amounts, reference is made to JP-A No.11-65021, paragraph [0118]; JP-A No.11-223898, paragraphs [0136] to [0193]; the compounds of formula (H), the compounds of formulae (1) to (3) and the compounds of formulae (A) and (B) in JP-A No.11-87287; the compounds of formulae (III) to (V) in JP-A No.11-91652, particularly specific compounds of [Formula 21] to [Formula 24] therein. As to hard gradation promoting agent, reference is made to JP-A No.11-65021, paragraph [0102]; and JP-A No.11-223898, paragraphs [0194] to [0195].

In case where a formic acid or the salt thereof is used as a strong fogging agent in the present invention, it may be added to an image-forming layer of the material containing the photosensitive silver halide in an amount of preferably at most 5 mmols, and more preferably at most 1 mmol per mol of silver.

In case where an ultrahard gradation enhancing agent is used in the thermally developable photosensitive material of the present invention, it is preferably used in combination with an acid or the salt thereof formed by hydration of diphosphorus pentaoxide. The acid and the salts thereof to be formed through hydration of diphosphorus pentaoxide include, for example, metaphosphoric acid (and its salts), pyrophosphoric acid (and its salts), orthophosphoric acid (and its salts), triphosphoric acid (and its acid), tetraphosphoric acid (and its salts), and hexametaphosphoric acid (and its salts). For the acid and the salt thereof to be formed through hydration of diphosphorus pentaoxide, preferably mentioned are orthophosphoric acid (and its salts), and hexametaphosphoric acid (and its salts). Specific examples of the salts are sodium orthophosphate, sodium dihydrogenorthophosphate, sodium hexametaphosphate, and ammonium hexametaphosphate.

The amount of the acid to be formed through hydration of diphosphorus pentaoxide or the salt thereof to be added in the invention (that is, the coating amount thereof per $m^2$ of the thermally developable photosensitive material) preferably falls between 0.1 and 500 $mg/m^2$, and more preferably between 0.5 and 100 $mg/m^2$.

In the thermally developable photosensitive material of the present invention, there may be provided a surface protective layer so as to prevent the image-forming layer from adhering. The surface protective layer may be of a mono-layered or multi-layered construction. The details of the surface protective layer are described, for example, in JP-A No.11-65021, paragraphs [0119] to [0120].

Gelatin is preferably used as the binder in the surface protective layer, but polyvinyl alcohol (PVA) is also usable for it. As the gelatin for use in the invention may be an inert gelatin (e.g., NITTA GELATIN 750), gelatin phthalide (e.g., NITTA GELATIN 801) or the like. PVA usable in the invention includes, for example, a completely saponified product PVA-105; partially saponified products PVA-205 and PVA-355; and a modified polyvinyl alcohol, MP-203 (all commercially available from Kuraray Co., Ltd.). The coating amount of polyvinyl alcohol (per $m^2$ of one layer) of the protective layer preferably falls between 0.3 and 4.0 $g/m^2$, more preferably between 0.3 and 2.0 $g/m^2$.

In case where the thermally developable photosensitive material of the present invention is used for printing where a problem of varying dimensions are involved, it is preferable to use a polymer latex in a surface protective layer or a back layer of the material. The polymer latexes used for this purpose are described in, for example, "*Synthetic Resin Emulsions*" (edited by Taira Okuda & Hiroshi Inagaki, the Polymer Publishing Association of Japan, 1978); "*Applications of Synthetic Latexes*" (edited by Takaaki Sugimura, Yasuo Kataoka, Sohichi Suzuki & Keiji Kasahara, the Polymer Publishing Association of Japan, 1993); and *Chemistry of Synthetic Latexes*" (written by Sohichi Muroi, the Polymer Publishing Association of Japan, 1970). Specifically, there may be mentioned, for example, methyl methacrylate (33.5 mass %)/ethyl acrylate (50 mass %)/methacrylic acid (16.5 mass %) copolymer latex; methyl methacrylate (47.5 mass %)/butadiene (47.5 mass %)/itaconic acid (5 mass %) copolymer latex; ethyl acrylate/methacrylic acid copolymer latex; methyl methacrylate (58.9 mass %)/2-ethylhexyl acrylate (25.4 mass %)/styrene (8.6 mass %)/2-hydroxyethyl methacrylate (5.1 mass %)/acrylic acid (2.0 mass %) copolymer latex; and methyl methacrylate (64.0 mass %)/styrene (9.0 mass %)/butyl acrylate (20.0 mass %)/2-hydroxyethyl methacrylate (5.0 mass %)/acrylic acid (2.0 mass %) copolymer latex. As the binder used for the surface protective layer in the present invention, for example, reference is made to the combination of polymer latexes disclosed in JP-A No.11-6872; the techniques disclosed in JP-A No.11-143058, paragraphs [0021] to [0025]; the techniques disclosed in JP-A No.11-6872, paragraphs [0027] to [0028]; and the techniques disclosed in JP-A NO.12-19678, paragraphs [0023] to [0041]. The ratio of the polymer latex to the binder preferably falls between 10% and 90% by mass, more preferably between 20% and 80% by mass in the surface protective layer.

The coating amount of overall binder (including a water-soluble polymer and a latex polymer) per $m^2$ of the support in the protective layer (per one layer) preferably falls between 0.3 and 5.0 $g/m^2$, and more preferably between 0.3 and 2.0 $g/m^2$.

The temperature at which the coating solution for the image-forming layer is prepared preferably falls between 30° C. and 65° C., more preferably between 35° C. and 60° C. or lower, and even more preferably between 35° C. and 55° C. Further, the temperature of the coating solution is preferably maintained between 30° C. and 65° C. immediately after a polymer latex has been added thereto. Still further, it is preferable that a reducing gent has been mixed with an organic silver salt before a polymer latex is added.

The image-forming layer is provided on the support in a mono-layered or multi-layered construction. In case where the image-forming layer has a mono-layered construction, the layer contains an organic silver salt, a photosensitive silver halide, a reducing agent and a binder, and additionally as desired, a toning agent, a coating aid and other auxiliaries. In case where the image-forming layer has a two or more layered construction, the first image-forming layer (usually, this is directly adjacent to the support) must contain an organic silver salt and a photosensitive silver halide, and the second image-forming layer or the both layers must contain additional several ingredients. The multi-color thermally developable photosensitive material may have a combination of these two layers for respective colors, or alternatively the material may contain all the essential ingredients in a single layer as disclosed in U.S. Pat. No. 4,708,928. In case of multi-color thermally developable photosensitive material using a plurality of dyes, the respective emulsion layers are usually partitioned one another with a functional or non-functional barrier layer between the adjacent photosensitive layers as disclosed in U.S. Pat. No. 4,460,681.

The image-forming layer (photosensitive layer) of the thermally developable photosensitive material of the present invention may contain a variety of dyes and pigments (e.g., C.I. Pigment Blue 60, C.I. Pigment Blue 64, C.I. Pigment Blue 15:6) in order to improve the silver color tone, to prevent interference band from occurring during laser exposure, and to prevent irradiation. The details of such dyes and pigments are described in, for example, WO98/36322, and JP-A NOs.10-268465 and 11-338098.

The thermally developable photosensitive material of the present invention may have an antihalation layer at the side remoter from the light source with respect to an image-forming layer.

In general, the thermally developable photosensitive material has a non-photosensitive layer in addition to a photosensitive layer. The non-photosensitive layer is composed of (1) a protective layer disposed on a photosensitive layer (at a side remoter from the support); (2) an interlayer disposed between adjacent photosensitive layers or between a photosensitive layer and a protective layer; (3) an undercoat layer disposed between a photosensitive layer and a support; and (4) a back layer disposed at a side opposite to a photosensitive layer. The layers (1) and (2) are provided as a filter layer in the thermally developable photosensitive material. The layers (3) and (4) are provided as an antihalation layer in the material.

The antihalation layer is described in, for example, JP-A No.11-65021, paragraphs [0123] to [0124]; JP-A Nos.11-223898, 9-230531, 10-36695, 10-104779, 11-231457, 11-352625 and 11-352626.

The antihalation layer contains an antihalation dye capable of absorbing light in a range of wavelengths of light for exposing the thermally developable photosensitive material. In case where the wavelength of light for exposure falls in the infrared region, IR-absorbing dyes may be used, preferably the dyes which do not absorb visible light.

In case where the dyes capable of adsorbing visible light are used for antihalation, it is preferable that the dyes are rendered substantially decolored after image formation, by employing, for example, a means of decoloring the dyes by heat generated by thermal development. It is particularly preferable to add a thermally decolorable dye and a base precursor to the non-photosensitive layer so that the layer can function as an antihalation layer. The details of these techniques are described in, for example, JP-A No.11-231457.

The amount of the decolorable dye to be added is determined, depending on the using purposes of the dye. In general, the use amount of the dye is specified to give an optical density (absorbance), measured at a predetermined wavelength, of larger than 1.0. The optical density preferably falls between 0.2 and 2. The use amount of the dye to achieve the desired optical density falling within the range is usually about from 0.001 to 1 g/m$^2$.

If the dyes are decolored in such a manner, the optical density can be lowered to 0.1 or less after thermal development. Two or more kinds of decolorable dyes may be used in combination in the thermally decoloring type of recording material or the thermally developable photosensitive material. Similarly, two or more kinds of base precursors may be used in combination.

When thermally decoloring is conducted with use of a decolorable dye and a base precursor, it is preferable, in view of the thermal decolorability, to use a substance which, when used in combination with the base precursor, can lower the melting point by at least 3° C. (e.g., diphenyl sulfone, 4-chlorophenyl(phenyl) sulfone), as described in JP-A No.11-352626.

In the present invention, a coloring agent which has a maximum absorption in the range falling between 300 and 450 nm may be added to the thermally developable photosensitive material so as to improve the silver tone and the image stability with the passing of time. Such coloring agents are described in, for example, JP-A Nos.62-210458, 63-104046, 63-103235, 63-208846, 63-306436, 63-314535, 1-61745, 11-376751.

In general, the amount of the coloring agent to be added falls between 0.1 mg/m$^2$ and 1 g/m$^2$. Preferably, the coloring agent is added to a back layer that is opposite to an image-forming layer of the material.

Preferably, the thermally developable photosensitive material of the present invention is a so-called single-sided photosensitive material, i.e., the material has, on one surface of its support, at least one image-forming layer that contains a silver halide emulsion, and has a back layer on the other surface thereof.

It is preferable to add to the thermally developable photosensitive material of the present invention a matting agent so as to improve the conveying property of the material. Matting agents are described in JP-A No.11-65021, paragraphs [0126] to [0127]. The amount of the matting agent to be added to the thermally developable photosensitive material of the present invention preferably falls between 1 and 400 mg/m$^2$, and more preferably between 5 and 300 mg/m$^2$ of the material.

The matte degree on the surface of the image-forming layer of the thermally developable photosensitive material of the present invention is not specifically limited, insofar as the matted layer surface is free from star dust shaped surface defects, but preferably is specified to achieve the Beck's smoothness falling between 30 and 2,000 seconds, and particularly preferably between 40 and 1,500 seconds. The Beck's smoothness is readily obtained according to JIS P8119 (method of testing surface smoothness of paper and paper boards with a Beck tester), and to TAPPI Standard T479.

Regarding the matte degree of the back layer of the thermally developable photosensitive material of the present invention, the Beck's smoothness of the matted back layer preferably falls between 10 and 1,200 seconds, and more preferably between 20 and 800 seconds, and even more preferably between 40 and 500 seconds.

Preferably, the thermally developable photosensitive material of the present invention contains a matting agent in the outermost layer, or in a layer functioning as an outermost layer, or in a layer nearer to the outermost surface. Also preferably, the material may contain a matting agent in a layer functioning as a protective layer.

The details of the back layer applicable to the present invention are described in JP-A No.11-65021, paragraphs [0128] to [0130].

The film surface of the thermally developable photosensitive material of the present invention preferably has a pH of at most 6.0, and more preferably at most 5.5, before thermal development. The lowermost limit of the pH is not specifically limited, but may be at least 3 or so. In order to control the pH of the film surface, employable are nonvolatile acids, for example, organic acids such as phthalic acid derivatives, or sulfuric acid, or nonvolatile bases such as ammonia in view of the ability to decrease the pH of film surface. Particularly preferred to achieve a decreased pH on the film surface is ammonia, as it is highly volatile and hence can readily be removed during the coating step or prior to the thermal development. Methods for measuring the film surface pH is the described in JP-A No.11-87297, paragraph [0123].

A hardening agent may be added to the image-forming layer, the protective layer, the back layer and other layers. Examples of the hardening agent applicable to the present invention are described in "*The Theory of the Photographic Process*", written by T. H. James, 4th Ed. (Macmillan Publishing Co., Inc., 1977), pp. 77–87. For example, preferred for use in the invention are chrome alum, 2,4-dichloro-6-hydroxy-s-triazine sodium salt, N,N-ethylenebis (vinylsulfonacetamide), N,N-propylenebis (vinylsulfonacetamide); as well as polyvalent metal ions described on page 78, ibid; polyisocyanates described in U.S. Pat. No. 4,281,060 and JP-A No.6-208193; epoxy compounds described in U.S. Pat. No. 4,791,042; and vinylsulfone-base compounds described in JP-A No. 62-89048.

The hardening agent is added to the coating solutions in the form of a solution. The time at which the solution is added to the coating solution for a protective layer may fall between 180 minutes before coating the liquid and a time immediately before the coating, preferably between 60 minutes before the coating and 10 seconds before the coating. The methods and the conditions for adding are not specifically limited insofar as the effects of the present invention can be attained. Specifically, employable is a method of adding a hardening agent to a coating solution in a tank in such a controlled manner that the mean dwell time for the agent as calculated from an amount of the agent added and a flow rate of the coating solution to a coater could become a desired duration; or a method of mixing them using a static mixer as described in "*Liquid Mixing Technology*", written by N. Harunby, M. F. Edwards & A. W. Nienow's Chap. 8 (translated by Koji Takahasi, published by Nikkan Kogyo Shinbun, 1989).

Surfactants applicable to the thermally developable photosensitive material of the present invention are described in JP-A No.11-65021, paragraph [0132]; solvents applicable thereto are disclosed, ibid, paragraph [0133]; supports applicable thereto are described, ibid, paragraph [0134]; antistatic and electroconductive layers applicable thereto are described, ibid, paragraph [0135]; methods of forming color images applicable thereto are described, ibid, paragraph [0136]; lubricants applicable thereto are described in JP-A No.11-84573, paragraphs [0061] to [0064] and JP-A No.11-106881, paragraphs [0049] to [0062].

The transparent support is preferably a polyester, particularly polyethylene terephthalate which has been heat-treated at a temperature of 130 to 185° C., so that the support can reduce residual internal distortion occurred in forming a biaxially oriented film and prevents any thermal shrinkage distortion from occurring during thermal developing process. A transparent support for a thermally developable photosensitive material to be used for medical diagnosis may or may not be colored with a blue dye (e.g., Dye-1 as described in Japanese Patent Application Laid-Open No. 240877/1996). It is preferable to employ a method of applying an undercoat of, e.g., a water-soluble polyester as described in Japanese Patent Application Laid-Open No. 84574/1999, a styrene-butadiene copolymer as described in Japanese Patent Application Laid-Open No. 186565/1998, or a vinylidene chloride copolymer as described in Japanese Patent Application Laid-Open No. 39684/2000, or paragraphs 0063 to 0080 of Japanese Patent Application No. 106881/1999. For an antistatic layer, or undercoat, it is possible to employ methods described in Japanese Patent Application Laid-Open Nos. 143430/1981, 143431/1981, 62646/1983 or 120519/1981, paragraphs 0040 to 0051 of Japanese Patent Application Laid-Open No. 84573/1999, U.S. Pat. No. 5,575,957, or paragraphs 0078 to 0084 of Japanese Patent Application Laid-Open No. 223898/1999.

The thermally developable photosensitive material is preferably of a mono-sheet type (a type which can form an image thereon without using another sheet such as an image-receiving material).

The thermally developable photosensitive material may further contain an antioxidant, stabilizer, plasticizer, ultraviolet absorber, and coating auxiliary. The various additives may be added to a photosensitive or non-photosensitive layer. In this connection, reference can be made to WO98/36322, EP803764A1, Japanese Patent Application Laid-Open Nos. 186567/1998 and 186568/1998, etc.

Any method of coating can be employed to produce the thermally developable photosensitive material according to the present invention. More specifically, any of various coating methods including extrusion coating, slide coating, curtain coating, dip coating, knife or flow coating, and extrusion coating using a hopper of the type described in U.S. Pat. No. 2,681,294 can be employed, preferably extrusion or slide coating as described on pages 399 to 536 of "LIQUID FILM COATING" by Stephen F. Kistler and Peter M. Schweizer (Chapman & Hall, 1997), and more preferably slide coating. Examples of the form of a slide coater used for slide coating are shown in FIG. 11b.1 on page 427 thereof. If desired, it is also possible to form two or more coating layers simultaneously by employing a method as described on pages 399 to 536, ibid., in U.S. Pat. No. 2,761,791 or in British Patent No. 837,095.

The coating solution for forming a layer containing an organic silver salt according to the present invention is preferably a thixotropic fluid. Thixotrophy is a phenomenone of a fluid whose viscosity decreases with an increase in its shear rate. Any apparatus is usable to measure the viscosity of fluids. Preferably used is RFS Fluid Spectmeter manufactured by Rheometrics Far East, by which measurement is conducted at 25° C. In this connection, reference is made to Japanese Patent Application Laid-Open No.52509/1999. The solution preferably has a viscosity of 400 to 100,000 mPa·s and more preferably 500 to 20,000 mPa·s at a shear rate of 0.1 $s^{-1}$, and a viscosity of 1 to 200 mPa·s and more preferably 5 to 80 mPa·s at a shear rate of 1000 $s^{-1}$.

Various thixotropic fluid systems are known, for example, as described in "*Lecture on Rheology*" (Polymer Publishing); and "*Polymer Latexes*" (by Muroi & Morino, Polymer Publishing). In order to exert thixotropy, fluids are required to include a large amount of solid microparticles. In order to enhance their thixotropic property, it is effective that the fluids contain a thickening linear polymer, solid microparticles exhibiting anisotropy and an increased aspect ratio, or an alkaline thickening agent or a surfactant.

Other techniques applicable to the thermally developable photosensitive material of the present invention are described, for example, in EP No.803764A1, EP No.883022A1, WO98/36322; JP-A Nos.56-62648, 58-62644, 9-281637, 9-297367, 9-304869, 9-311405, 9-329865, 10-10669, 10-62899, 10-69023, 10-186568, 10-90823, 10-171063, 10-186565, 10-186567, 10-186569, 10-186570, 10-186571, 10-186572, 10-197974, 10-197982, 10-197983, 10-197985,10-197986, 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536, 11-133537, 11-133538, 11-133539, 11-133542, 11-133543, 11-223898 and 11-352627.

The thermally developable photosensitive material of the present invention may be developed by any method. Usually, after having been subjected to imagewise exposure, the material is developed at an elevated temperature. Preferably, the temperature for development falls between 80 and 250° C., more preferably between 100 and 140° C. The duration for the development preferably falls between 2 and 30 seconds, more preferably between 5 and 19 seconds, and even more preferably between 5 and 16 seconds.

In a method of developing the material, a plate heater is preferably used. As a thermal development using the plate heater, preferably employed is the method described in JP-A No.11-133572, in which a thermally developing system is used to obtain visible images by making a photosensitive material having a latent image formed thereon contact with a heating means at a thermally developing zone. In this system, the heating means comprises a plate heater, and a plurality of press rolls disposed to face each other along with one surface of the plate heater. The exposed thermally developable photosensitive material is rendered to pass through between the plurality of press rolls and the plate heater, so as to be thermally developed. The plate heater may preferably be sectioned, in heating ability, into 2 to 6 portions in order to control the temperature of respective portions, specifically to lower the temperature of the end portion by 1 to 10° C. Such a system is also described in JP-A NO.54-30032. By using such a system, water and organic solvents present in the thermally developable photosensitive material can be removed from the material, and further, a change in the shape of the support attributed to a rapid temperature elevation can be prevented.

The thermally developable photosensitive material of the present invention can be exposed in any manner. Preferably laser light is used as a light source. The laser light for use in the present invention is, for example, gas laser ($Ar^+$ or He—Ne), YAG laser, dye laser, or semiconductor laser. Also employable is a combination of a semiconductor laser and a secondary harmonic generating element. Among these, preferred are a gas or semiconductor laser emitting light in the infrared region of the spectrun.

As one example of laser imagers used in the medical field equipped with an exposure unit and a thermally developing unit, there is mentioned Dry Laser Imager FM-DP L manufactured by Fuji Medical Systems. Details of the system FM-DP L is described in Fuji Medical Review No. 8, pp. 39–55, and the techniques disclosed therein are applicable to the laser imagers used for the thermally developable photosensitive material of the present invention. In addition, a laser imager in a network system adaptable for DICOM Standards as proposed by Fuji Medical System may be used for the thermally developable photosensitive material of the present invention.

The thermally developable photosensitive material of the present invention forms a monochromatic silver image, and hence is preferably used in medical diagnosis, industrial photography, printing and COM (computor output microfilm).

EXAMPLES

The features of the present invention are described in more detail with reference to the following Examples. In these Examples, the ingredients to be used, their use amount, their mixing ratio, the details of processing them and the procedures can be modified as appropriately without departing from the spirit and the scope of the present invention. Accordingly, the Examples given below are not intended to restrict the scope of the present invention.

Example 1

<<Preparation of Undercoated Support>>

<Preparation of PET Support>

From terephthalic acid and ethylene glycol, PET was produced in an ordinary manner. PET thus produced had an intrinsic viscosity, IV, of 0.66, as measured in a phenol/tetrachloroethane ratio (6/4 by mass) at 25° C. After pelletized, the PET was dried at 130° C. for 4 hours, and melted at 300° C., followed by extrusion through a T-die. After rapid cooling, a non-oriented film was obtained which had a thickness of 175 μm after thermal fixation.

The resultant film was stretched 3.3 times in MD (machine direction) using a roll at different rotating speeds, then stretched 4.5 times in CD (cross direction) using a tenter. The temperatures for MD and CD stretchings were 110° C. and 130° C., respectively. Then, the film was thermally fixed at 240° C. for 20 seconds, and relaxed by 4% in CD at the same temperature. Subsequently, the chuck of the tenter was released, the both edges of the film was knurled, and the film was rolled up under 4 kg/cm$^2$ to give a rolled film having a thickness of 175 μm.

(Corona Discharge Surface Treatment)

Both surfaces of the support were subjected to corona discharge treatment at room temperature at a speed of 20 m/min, using a solid-state corona discharge system MODEL 6KVA manufactured by Pillar Technologies. From the data of the current and the voltage read from the system, the support was found to be processed at 0.375 kV·A·min/m$^2$. The frequency for the treatment was 9.6 kHz, and the gap clearance between an electrode and a dielectric roll was 1.6 mm.

(Preparation of Undercoated Support)

(1) Preparation of a Coating Solution for an Undercoat Layer:

Formulation (1) (for an undercoat layer at the side of providing an image-forming layer):

| | |
|---|---|
| Pesuresin A-520 (a 30 mass % solution) manufactured by Takamatsu Yushi KK | 59 g |
| Polyethylene glycol monononylphenyl ether (average ethylene oxide number = 8.5, a 10 mass % solution) | 5.4 g |
| Polymer microparticles (MP-1000, mean particle size: 0.4 μm) manufactured by Soken Chemical & Engineering Co., Ltd. | 0.91 g |
| Distilled water | 935 ml |
| Formulation (2) (for a first back layer): | |
| Styrene-butadiene copolymer latex (solid content: 40 mass %, styrene/butadiene ratio = 68/32 by mass) | 158 g |
| Sodium 2,4-Dichloro-6-hydroxy-S-triazine (a 8 mass % aqueous solution) | 20 g |
| Sodium laurylbenzenesulfonate (a 1 mass % aqueous solution) | 10 ml |
| Distilled water | 854 ml |
| Formulation (3) (for a second back layer): | |
| $SnO_2$/SbO (9/1 by mass, mean particle size: 0.038 μm, a 17 mass % dispersion) | 84 g |
| Gelatin (a 10% aqueous solution) | 89.2 g |
| Metolose TC-5 (a 2% aqueous solution) manufactured by Shin-etsu Chemical Industry Co., Ltd. | 8.6 g |
| MP-1000 manufactured by Soken Chemical & Engineering Co., Ltd. | 0.01 g |
| Sodium dodecylbenzenesulfonate (a 1 mass % aqueous solution) | 10 ml |
| NaOH (1 mass %) | 6 ml |
| Proxel (manufactured by ICI) | 1 ml |
| Distilled water | 805 ml |

(Preparation of Undercoated Support)

Both surfaces of the biaxially-oriented polyethylene terephthalate support (thickness: 175 μm) were subjected to corona discharge treatment in the same manner as above. One surface (to have an image-forming layer thereon) of the support was coated with a coating solution of the undercoat layer formulation (1) using a wire bar, and then dried at 180° C. for 5 minutes to provide a wet coated amount of 6.6 ml/m$^2$ (one surface). Next, the other surface (back surface) of the support was coated with a coating solution of the back layer formulation (2) using a wire bar, and then dried at 180° C. for 5 minutes to provide a wet coated amount of 5.7 ml/m$^2$. The thus-coated back surface was further coated with the back layer formulation (3) using a wire bar, and then dried at 180° C. for 6 minutes to provide a wet coated amount of 7.7 ml/m$^2$, to finally give an undercoated support.

<<Preparation of Coating Solution for Back Surface>>

(Preparation of Base Precursor Microparticle Dispersion (a))

64 g of a base precursor compound 11, 28 g of diphenyl sulfone and 10 g of a surfactant DEMOLE N (manufactured by Kao Corporation) were admixed with 220 ml of distilled water, and the resulting mixture was milled in a sand mill (¼ GALLON SAND GRINDER manufactured by Imex) with beads. Thus, a dispersion (a) containing solid microparticles of the base precursor compound having a mean particle size of 0.2 μm was obtained.

(Preparation of Dye Solid Microparticle Dispersion)

9.6 g of a cyanine dye compound 13 and 5.8 g of sodium p-dodecylbenzenesulfonate were admixed with 305 ml of distilled water, and the resulting mixture was milled in a sand mill (¼ GALLON SAND GRINDER manufactured by Imex) with beads. Thus, a dispersion containing solid microparticles of the dye having a mean particle size of 0.2 μm was obtained.

(Preparation of Coating Solution for an Antihalation Layer)

17 g of gelatin, 9.6 g of polyacrylamide, 70 g of the dispersion of base precursor microparticles (a), 56 g of the dispersion of the above-produced dye microparticles, 1.5 g of a monodispersion of polymethyl methacrylate microparticles (mean particle size: 8.0 μm, particle size standard deviation: 0.4), 0.03 g of benzoisothiazolinone, 2.2 g of sodium polyethylenesulfonate, 0.2 g of a blue dye compound 14, 3.9 g of a yellow dye compound 15, and 844 ml of water were admixed together to prepare a coating solution for an antihalation layer.

(Preparation of Coating Solution for a Back Surface Protective Layer)

A reactor was maintained at 40° C. Into this were charged 50 g of gelatin, 0.2 g of sodium polystyrenesulfonate, 2.4 g of N,N-ethylenebis(vinylsulfonacetamide), 1 g of sodium tert-octylphenoxyethoxyethanesulfonate, 30 mg of benzoisothiazolinone, 37 mg of potassium N-perfluorooctylsulfonyl-N-propylalanine, 0.15 g of polyethylene glycol mono(N-perfluorooctylsulfonyl-N-propyl-2-aminoethyl)ether (mean polymerization degree of ethylene oxides: 15), 32 mg of $C_8F_{17}SO_3K$, 64 mg of $C_8F_{17}SO_2N(C_3H_7)(CH_2CH_2O)_4(CH_2)_4SO_3Na$, 8.8 g of acrylic acid/ethyl acrylate copolymer (copolymerization ratio: 5/95 by mass), 0.6 g of AEROSOL OT (manufactured by American Cyanamid), 1.8 g of paraffin emulsion (in the form of liquid paraffin) and 950 ml of water to prepare a coating solution for a back surface protective layer.

<<Preparation of Silver Halide Emulsion 1>>

To 1421 ml of distilled water were added 3.1 ml of a 1 mass % aqueous potassium bromide solution, followed by further addition of 3.5 ml of an aqueous sulfuric acid solution (5 mols/liter) and 31.7 g of phthalated gelatin. The resulting mixture was maintained at 30° C. with stirring in a stainless reactor, to which were added 95.4 ml of a solution A containing 22.22 g of silver nitrate diluted with distilled water, and 97.4 ml of a solution B containing 15.3 g of potassium bromide and 0.8 g of potassium iodide diluted with distilled water, at a fixed flow rate over a period of 45 seconds. Then, 10 ml of a 3.5 mass % aqueous hydrogen peroxide solution and then 10.8 ml of a 10 mass % aqueous benzimidazole solution were added thereto. To the resultant mixture were further added 317.5 ml of a solution C containing 51.86 g of silver nitrate diluted with distilled water at a fixed flow rate over a period of 20 minutes, and 400 ml of a solution D containing 44.2 g of potassium bromide and 2.2 g of potassium iodide diluted with distilled water employing a controlled double jet method while maintaining a constant pAg of 8.1. 10 minutes after the commencement of adding the solutions C and D, potassium hexachloroiridate(III) was added thereto to provide $1\times10^{-4}$ mols per mol of silver. Five seconds after the completion of adding the solution C, an aqueous potassium ferrocyanide solution was added thereto to provide $3\times10^{-4}$ mols per mol of silver. pH was controlled to be 3.8 with sulfuric acid (0.5 mols/liter). Stirring was halted, and the resultant mixture was precipitated, desalted and then washed with water. pH was controlled to be 5.9 with sodium hydroxide (1 mol/liter) to thus give a dispersion of silver halide having pAg of 8.0.

The produced dispersion of silver halide was maintained with stirring at 38° C., to which was added 5 ml of a solution of 0.34 mass % 1,2-benzoisothiazolin-3-one in methanol. 40 minutes after, a solution of spectral sensitizing dye A and spectral sensitizing dye B in a ratio of 1/1 by mol in methanol was added thereto to give a total amount of the spectral sensitizing dyes A and B of $1.2\times10^{-3}$ mols per mol of silver. 1 minute after, the temperature was raised to 47° C. 20 minutes after raising, $7.6\times10^{-5}$ mols, per mol of silver, of a solution of sodium benzenethiosulfonate in methanol was added; and 5 minutes after, $2.9\times10^{-4}$ mols, per mol of silver, of a solution of tellurium sensitizer C in methanol was added, followed by ripening for 91 minutes. Then, 1.3 ml of a solution of 0.8 mass % N,N'-dihydroxy-N"-diethylmelamine in methanol was added thereto; and 4 minutes after, $4.8\times10^{-3}$ mols, per mol of silver, of a solution of 5-methyl-2-mercaptobenzimidazole in methanol, and $5.4\times10^{-3}$ mols, per mol of silver, of a solution of 1-phenyl-2-heptyl-5-mercapto-1,3,4-triazole in methanol were added thereto, to finally prepare a silver halide emulsion 1.

The grains in the thus-prepared silver halide emulsion were silver iodobromide grains having a mean sphere-corresponding diameter of 0.042 μm and having a sphere-corresponding diameter fluctuation coefficient of 20%. The iodide content of the grains was 3.5 mol %, and the iodide was uniformly distributed within the grains. The grain size was obtained from 1000 grains using an electronic microscope and taking an average. The {100} plane ratio of the grains was determined to be 80%, as measured according to the Kubelka-Munk method.

<<Preparation of Silver Halide Emulsion 2>>

A silver halide emulsion 2 was produced in a similar manner to the procedures for preparing the silver halide emulsion 1, except that the liquid temperature for forming the grains was changed from 30° C. to 47° C.; the solution B was prepared by diluting 15.9 g of potassium bromide with distilled water to make a volume of 97.4 ml; the solution D was prepared by diluting 45.8 g of potassium bromide with distilled water to make a volume of 400 ml; the solution C was added over a period 30 minutes; and potassium ferrocyanide was not added. Further, similarly to the procedures for the silver halide emulsion 1, precipitating, desalting, washing with water and dispersing were conducted. In addition, similarly to the procedures for the silver halide emulsion 1, spectral sensitization and chemically sensitization were performed by adding 5-methyl-2-mercaptobenzimidazole and 1-phenyl-2-heptyl-5-mercapto-1,3,4-triazole, except that a solution of the spectral sensitizing dye A and the spectral sensitizing dye B (1/1 by mol) in methanol was added to give a total amount of the dyes A and B of $7.5\times10^{-4}$ mols per mol of silver; the amount of the tellurium sensitizer C added was $1.1\times10^{-4}$ mols per mol of silver; and the amount of 1-phenyl-2-heptyl-5-mercapto-1,3,4-triazole added was $3.3\times10^{-3}$ mols per mol of silver to thus prepare a silver halide emulsion 2. The emulsion grains in the thus-prepared silver halide emulsion 2 were cubic, pure silver bromide grains having a mean sphere-corresponding diameter of 0.080 μm and having a sphere-corresponding diameter fluctuation coefficient of 20%.

<<Preparation of Silver Halide Emulsion 3>>

A silver halide emulsion 3 was prepared in a similar manner to the procedures for preparing the silver halide emulsion 1, except that the liquid temperature for forming the grains was changed from 30° C. to 27° C. Also, similarly to the procedures for the silver halide emulsion 1, precipitating, desalting, washing with water and dispersing were conducted. In addition, similarly to the procedures for the silver halide emulsion 1, a dispersion of solids (an aqueous gelatin solution) of the spectral sensitizing dye A and the spectral sensitizing dye B (ratio: 1/1 by mol) was added to give a total amount of the spectral sensitizing dyes A and B of $6\times10^{-3}$ mols per mol of silver; and the amount of the tellurium sensitizer C added was $5.2\times10^{-4}$ mols per mol of silver. The emulsion grains in the thus-prepared silver halide emulsion 3 were silver iodobromide grains having a mean sphere-corresponding diameter of 0.034 μm and having a sphere-corresponding diameter fluctuation coefficient of 20%. The iodide content of the grains was 3.5 mol %, and the iodide was uniformly distributed within the grains.

<<Preparation of Mixed Emulsions A to J for Coating Solutions>>

70% by mass of the silver halide emulsion 1, 15% by mass of the silver halide emulsion 2 and 15% by mass of the silver halide emulsion 3 were dissolved, followed by addition of $7\times10^{-3}$ mols, per mol of silver, of an aqueous solution of 1 mass % benzothiazolium iodide. Next, $1\times10^{-3}$ mols per mol of silver of the compound of formula (1) shown in Table 1 below was added thereto, followed by addition of water to thereby make a mixed emulsion having a silver halide content of 38.2 g in terms of silver per kg of the emulsion.

<<Preparation of Fatty Acid Silver Salt Dispersion>>

87.6 kg of benenic acid (EDENOR C22-85R manufactured by Henkel), 423 liters of distilled water, 49.2 liters of an aqueous NaOH solution (5 mols/liter), and 120 liters of tert-butanol were admixed together and allowed to cause reaction, with stirring at 75° C. for 1 hour, to prepare a solution of sodium behenate. Separately, 206.2 liters of an aqueous solution (pH 4.0) of 40.4 kg of silver nitrate was prepared, and maintained at 10° C. 635 liters of distilled water and 30 liters of tert-butanol were poured into a reactor and maintained at 30° C., into which were fed, with stirring, the solution containing sodium behenate prepared as above entirely and the aqueous silver nitrate solution prepared as above entirely at a predetermined flow rate, over a period of 93 minutes and 15 seconds, and 90 minutes, respectively. At this stage, for the duration of 11 minutes after the commencement of feeding the aqueous silver nitrate solution, only the aqueous silver nitrate solution could was added, then the sodium behenate solution was started to be fed, and for the duration of 14 minutes and 15 seconds after completion of feeding the aqueous silver nitrate, only the sodium benenate solution was added to the reactor. At this stage, the temperature inside the reactor was set at 30° C., and the temperature outside it was so controlled to keep the liquid temperature inside constant. The pipes through which the sodium behenate solution flew was kept warm by steam tracing, and the steam opening was controlled to keep the liquid temperature at the outlet of the nozzle tip at 75° C. The pipes through which the aqueous silver nitrate solution flew was kept warm by circulating cold water outside the double-walled pipe. The positions at which the sodium behenate solution and the aqueous silver nitrate solution, respectively, were added were disposed symmetrically to each other relative to the shaft of the stirrer, with the hights adjested in order not to contact with the reaction solution.

After addition of the sodium behenate solution was completed, the reaction system was kept standing with stirring and the temperature maintained for 20 minutes, and then cooled to 25° C. Subsequently, centrifugal filtration was conducted to separate solids, which were then washed with water until the conductivity of the filtrate water reached 45 μS/cm, to thus give a silver salt of the fatty acid as solids. The solids were stored as a wet cake without drying.

The silver behenate grains obtained as above were analyzed for the shape by electronmicroscopic photography, revealing that the obtained grains were flaky crystals having the dimensions of a=0.14 μm, b=0.4 μm and c=0.6 μm, all on average (a, b and c are determined as defined above). The mean aspect ratio was 5.2, the mean sphere-corresponding diameter was 0.52 μm and the mean sphere-corresponding fluctuation coefficient was 15%.

To the wet cake, corresponding to a weight of 100 g in dry weight, were added 7.4 g of polyvinyl alcohol (product name: PVA-217) and water to make a total weight of 385 g, followed by pre-dispersing in a homo-mixer.

Next, the pre-dispersed stock solution was processed three times in a dispersion mixer (MICROFLUIDIZER M-110S-EH manufactured by Microfluidex International Corporation, equipped with an interaction chamber, G10Z) at a controlled pressure of 1,750 kg/cm$^2$ to give a dispersion of silver behenate. Cooling was carried out by bellows-type heat exchangers disposed before and after an interaction chamber, with controlling the temperature of the refrigerant to achieve a dispersion temperature of 18° C.

<<Preparation of 25 Mass % Reducing Agent Dispersion>>

16 kg of water was added to 10 kg of a compound (I-14) represented by formula (I) and 10 kg of a 20 mass % aqueous solution of modified polyvinyl alcohol (POVAL MP203 manufactured by Kuraray Co., Ltd.), and thoroughly mixed to give a slurry. Using a diaphragm pump, the slurry was fed into a horizontal sand mill (UVM-2 manufactured by Imex) filled with zirconia beads having a mean diameter of 0.5 mm, and dispersed therein for 3 hours and 30 minutes. Then, 0.2 g of sodium benzoisothiazolinone was added thereto together with water to prepare a dispersion of a reducing agent having a concentration of 25% by mass. The reducing agent grains in the dispersion had a median diameter of 0.42 μm, and a maximum grain size of 2.0 μm or smaller. The dispersion was filtered through a polypropylene filter having a pore size of 10.0 μm to remove impurities, and then stored.

<<Preparation of 20 Mass % Hydrogen Bond-Forming Compound Dispersion>>

16 kg of water was added to 10 kg of an representative hydrogen bond-forming compound (II-1) and 10 kg of a 20 mass % aqueous solution of modified polyvinyl alcohol (POVAL MP203 manufactured by Kuraray Co., Ltd.), and thoroughly mixed to give a slurry. Using a diaphragm pump, the slurry was fed into a horizontal sand mill (UVM-2 manufactured by Imex) filled with zirconia beads having a mean diameter of 0.5 mm, and dispersed therein for 3 hours and 30 minutes. Then, 0.2 g of sodium benzoisothiazolinone was added thereto together with water to prepare a dispersion of a hydrogen bond-forming compound having a concentration of 20% by mass. The additive grains in the dispersion had a median diameter of 0.42 μm, and a maximum grain size of 1.6 μm or smaller. The dispersion was filtered through a polypropylene filter having a pore size of 10.0 μm to remove impurities, and then stored.

<<Preparation of 10 Mass % Mercapto Compound Dispersion>>

8.3 kg of water was added to 5 kg of 1-phenyl-2-heptyl-5-mercapto-1,3,4-triazole and 5 kg of a 20 mass % aqueous solution of modified polyvinyl alcohol (POVAL MP203 manufactured by Kuraray Co., Ltd.), and thoroughly mixed to give a slurry. Using a diaphragm pump, the slurry was fed into a horizontal sand mill (UVM-2 manufactured by Imex)

filled with zirconia beads having a mean diameter of 0.5 mm, and dispersed therein for 6 hours. Then, water was added thereto to prepare a dispersion of a mercapto compound having a concentration of 10% by mass. The mercapto compound grains in the dispersion had a median diameter of 0.40 μm, and a maximum grain size of 2.0 μm or smaller. The dispersion was filtered through a polypropylene filter having a pore size of 10.0 μm to remove impurities, and then stored. Just before use, the dispersion was again filtered through a polypropylene filter having a pore size of 10 μm.

<<Preparation of 20 Mass % Organic Polyhalogen Compound Dispersion 1>>

5 kg of tribromomethylnaphthyl sulfone, 2.5 kg of a 20 mass % aqueous solution of modified polyvinyl alcohol (POVAL MP203 manufactured by Kuraray Co., Ltd.), 213 g of a 20 mass % aqueous solution of sodium triisopropylnaphthalenesulfonate, and 10 kg of water were thoroughly mixed to prepare a slurry. Using a diaphragm pump, the slurry was fed into a horizontal sand mill (UVM-2 manufactured by Imex) filled with zirconia beads having a mean diameter of 0.5 mm, and dispersed therein for 5 hours. Then, 0.2 g of sodium benzoisothiazolinone was added thereto together with water to prepare a 20 mass % dispersion of the organic polyhalogen compound. The organic polyhalogen compound grains in the dispersion had a median diameter of 0.36 μm, and a maximum grain size of 2.0 μm or smaller. The dispersion was filtered through a polypropylene filter having a pore size of 3.0 μm to remove impurities, and then stored.

<<Preparation of 25 Mass % Organic Polyhalogen Compound Dispersion 2>>

A 25 mass % organic polyhalogen compound dispersion 2 was prepared in a similar manner to the procedures for preparing the 20 mass % organic polyhalogen compound dispersion 1, except that 5 kg of tribromomethyl(4-(2,4,6-trimethylphenylsulfonyl)phenyl sulfone was used in place of 5 kg of tribromomethylnaphthyl sulfone, dispersed and diluted to give a concentration of this organic polyhalogen compound of 25% by mass, and then filtered. The organic polyhalogen compound grains in the dispersion 2 had a median diameter of 0.38 μm, and a maximum grain size of 2.0 μm or smaller. The dispersion was filtered through a polypropylene filter having a pore size of 3.0 μm to remove impurities, and then stored.

<<Preparation of 26 Mass % Organic Polyhalogen Compound Dispersion 3>>

A 26 mass % organic polyhalogen compound dispersion 3 was prepared in a similar manner to the procedures for preparing the 20 mass % organic polyhalogen compound dispersion 1, except that 5 kg of tribromomethylphenyl sulfone was used in place of 5 kg of tribromomethylnaphthyl sulfone, and the use amount of a 20 mass % aqueous MP203 solution was changed to 5 kg, dispersed and diluted to give a concentration of this polyhalogen compound of 26% by mass, and then filtered. The organic polyhalogen compound grains in the dispersion 3 had a median diameter of 0.41 μm, and a maximum grain size of 2.0 μm or smaller. The dispersion was filtered through a polypropylene filter having a pore size of 3.0 μm to remove impurities, and then stored. Until use, it was stored at 10° C. or lower.

<<Preparation of 5 Mass % Phthalazine Compound Solution>>

8 kg of a modified polyvinyl alcohol MP203 (manufactured by Kuraray Co., Ltd.) was dissolved in 174.57 kg of water, followed by addition of 3.15 kg of a 20 mass % aqueous solution of sodium triisopropylnaphthalenesulfonate and 14.28 kg of a 70 mass % aqueous solution of 6-isopropylphthalazine to prepare a 5 mass % aqueous solution of 6-isopropylphthalazine.

<<Preparation of 20 Mass % Pigment Dispersion>>

250 g of water was added to 64 g of C.I. Pigment Blue 60 and 6.4 g of DEMOLE N (manufactured by Kuraray Co., Ltd.), and thoroughly mixed to produce a slurry. 800 g of zirconia beads having a mean diameter of 0.5 mm were prepared, placed in a vessel together with the slurry and then milled by means of a dispersing mill (¼G SAND GRINDER manufactured by Imex) for 25 hours to obtain a dispersion of the pigment. The pigment grains in the thus-obtained dispersion had a mean grain size of 0.21 μm.

<<Preparation of 40 Mass % SBR Latex>>

SBR latex mentioned below was diluted 10-fold with distilled water, followed by purification through a UF purification module, FS03-FC-FUY03A1 (Membrane System manufactured by Daisen Co., Ltd.) to give an ion conductivity of 1.5 mS/cm. To this was added SANDET-BL (manufactured by Sanyo Kasei Co., Ltd.), to give a concentration of 0.22% by mass. Further, NaOH and $NH_4OH$ were added thereto so that the ion ratio of $Na^+/NH4^+$ would be 1/2.3 by mol and a pH of 8.4 would be obtained. The latex concentration was 40% by mass.

The SBR latex used was a -St(71)-Bu(26)-AA(3)- latex.

The mean grain size of the thus-processed latex was 0.1 μm, the concentration was 45% by mass, the equilibrium water content at 25° C. and 60% RH was 0.6% by mass, the ion conductivity was 4.2 mS/cm, and the pH was 8.2. The ion conductivity was determined by means of a conductometer CM-30S manufactured by Toa Denpa Kogyo using a latex stock solution (40% by mass) at 25° C.

<<Preparation of Coating Solutions A to J for Image-Forming Layer>>

1.1 g of the 20 mass % pigment dispersion, 103 g of the fatty acid silver salt dispersion, 5 g of a 20 mass % aqueous solution of polyvinyl alcohol PVA-205 (manufactured by Kuraray Co., Ltd.), 25 g of the 25 mass % reducing agent dispersion, 100 mol %, relative to the reducing agent, of the 20 mass % hydrogen bond-forming compound dispersion, 14.0 g in total of the organic polyhalogen compound dispersions 1, 2 and 3 (in a ratio of 5/1/3 by mass), 5.8 g of the 10 mass % mercapto compound dispersion, 106 g of the 40 mass %, UF-purified and pH-controlled SBR latex (Tg: 24° C.), 18 ml of the 5 mass % phthalazine compound solution, 3 mol %, relative to the reducing agent, of a solution of the compound (D) (this composition, as shown in Table 1 below, and the equimolar amount of aqueous ammonia were dissolved in 5% methanol/water (1/1)) were successively added. Just before applied to a support, 10 g of the silver halide emulsions A to J were added and thoroughly mixed to prepare a coating solution for an image-forming layer (an emulsion layer or a photosensitive layer). The resulting coating solution was directly fed into a coating die by controlling a flow rate at 70 ml/$m^2$ and applied onto a support.

The viscosity of the coating solution for an image-forming layer was measured using a B-type viscometer manufactured by Tokyo Keiki Co., Ltd. and found to be 85 [mPa·s] at 40° C. (No. 1 rotor at 60 rpm).

When measured using RFS FLUID SPECTROMETER manufactured by Rheometrics Far East at 25° C., the viscosity of the coating solution was 1500, 220, 70, 40 and 20 [mPa·s] at a shear rate of 0.1, 1, 10, 100 and 1000 [1/sec], respectively.

<<Preparation of Coating Solution for Image-Forming Layer Interlayer>>

To 772 g of a 10 mass % aqueous solution of polyvinyl alcohol PVA-205 (manufactured by Kuraray Co., Ltd.), 5.3 g of the 20 mass % pigment dispersion, and 226 g of 27.5 mass % latex of methyl methacrylate/styrene/butyl acrylate/hydroxyethyl methacrylate/acrylic acid copolymer (copolymerization ratio 64/9/20/5/2 by mass) were added 2 ml of a 5 mass % aqueous solution of AEROSOL OT (manufactured by American Cyanamid), 10.5 ml of a 20 mass % aqueous solution of diammonium phthalate and water to make a total weight of 880 g. NaOH was added thereto to adjust the pH to 7.5 and make a coating solution for an interlayer. The coating solution was fed into a coating die, by controlling a flow rate at 10 ml/m$^2$.

The viscosity of the coating solution, measured by a B-type viscometer (No. 1 rotor at 60 rpm) at 40° C., was found to be 21 [mPa·s].

<<Preparation of Coating Solution for Image-Forming First Protective Layer>>

64 g of inert gelatin was dissolved in water, followed by addition of 80 g of a 27.5 mass % latex of methyl methacrylate/styrene/butyl acrylate/hydroxyethyl methacrylate/acrylic acid copolymer (copolymerization ratio 64/9/20/5/2 by mass), 23 ml of a 10 mass % solution of phthalic acid in methanol, 23 ml of a 10 mass % aqueous solution of 4-methylphthalic acid, 28 ml of sulfuric acid (0.5 mol/liter), 5 ml of a 5 mass % aqueous solution of AEROSOL OT (manufactured by American Cyanamid), 0.5 g of phenoxyethanol, 0.1 g of benzoisothiazolinone and water to make a total weight of 750 g used for a coating solution. Just before use, 26 ml of a 4 mass % chrome alum was added thereto, followed by stirring using a static mixer and the resultant mixture was fed into a coating die by controlling a flow rate at 18.6 ml/m$^2$.

The viscosity of the coating solution, measured using a B-type viscometer (No. 1 rotor at 60 rpm) at 40° C., was found to be 17 [mPa·s].

<<Preparation of Coating Solution for Image-Forming Second Protective Layer>>

80 g of inert gelatin was dissolved in water, followed by addition of 102 g of a 27.5 mass % latex of methyl methacrylate/styrene/butyl acrylate/hydroxyethyl methacrylate/acrylic acid copolymer (copolymerization ratio 64/9/20/5/2 by mass), 3.2 ml of a 5 mass % solution of potassium N-perfluorooctylsulfonyl-N-propylalanine, 32 ml of a 2 mass % aqueous solution of polyethylene glycol mono(N-perfluorooctylsulfonyl-N-propyl-2-aminoethyl) ether (mean polymerization degree of ethylene oxides=15), 23 ml of a 5 mass % solution of AEROSOL OT (manufactured by American Cyanamid), 4 g of polymethyl methacrylate microparticles (mean particle size 0.7 $\mu$m), 21 g of polymethyl methacrylate microparticles (mean particle size 4.5 $\mu$m), 1.6 g of 4-methylphthalic acid, 4.8 g of phthalic acid, 44 ml of sulfuric acid (0.5 mols/liter), 10 mg of benzoisothiazolinone and water to make a total weight of 650 g. Just before use, 445 ml of an aqueous solution of 4 mass % chrome alum with 0.67 mass % phthalic acid was added thereto, followed by stirring using a static mixer to give a coating solution for a surface protective layer. This coating solution was fed into a coating die by controlling a flow rate at 8.3 ml/m$^2$.

The viscosity of the coating solution, measured using a B-type viscometer (No. 1 rotor at 60 rpm) at 40° C., was found to be 9 [mPa·s].

<<Preparation of Thermally Developable Photosensitive Materials 1 to 10>>

Onto a back surface of the undercoated support, simultaneously applied were the coating solution for an antihalation layer (to provide a coating amount of 0.04 g/m$^2$) and the coating solution for a back-protective layer (to provide a coating amount of 1.7 g/m$^2$), followed by drying to thereby produce a multi-layered back layer.

Onto the other surface opposite to the back surface, simultaneously applied were the coating solutions for an image-forming layer (to provide a coating amount of the silver halide of 0.14 g/m$^2$ in terms of silver), for an interlayer, for a first protective layer and for a second protective layer in this order on the undercoated surface, using a slide bead coating method, to thus prepare samples of multi-layered thermally developable photosensitive materials. The conditions for coating and drying is mentioned below.

The coating speed was 160 m/min, and the space between a coating die tip and a support fell between 0.10 and 0.30 mm. The pressure in a degassing chamber was kept at a value lower by 196 to 882 Pa than the atmospheric pressure. Before coating, the support was destaticized by sending an ion stream.

In the subsequent chilling zone, the coating solution was cooled by introducing an air stream (dry-bulb temperature fell between 10 and 20° C.). After led in the next helical and non-contact drying zone, the coating solution was dried by sending a dry air stream (dry-bulb temperature fell between 23 and 45° C., and wet-bulb temperature fell between 15 and 21° C.).

After dried as above, the coated layer was conditioned at 25° C. and 40 to 60% RH, followed by heating to a temperature falling between 70 and 90° C. After heating, the layer was cooled to 25° C.

The matting degree, in terms of the Beck's smoothness, of the thus-fabricated thermally developable photosensitive material samples was 550 seconds at the side of the image-forming layer and 130 seconds at the side of the back. The pH of the image-forming layer of the sample was measured to be 6.0.

Base precursor compound 11

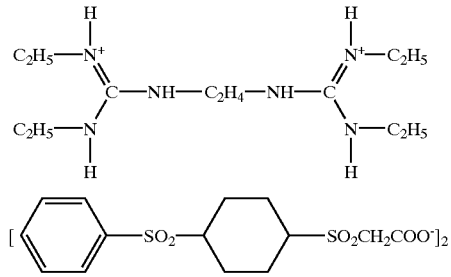

Cyanine dye compound 13

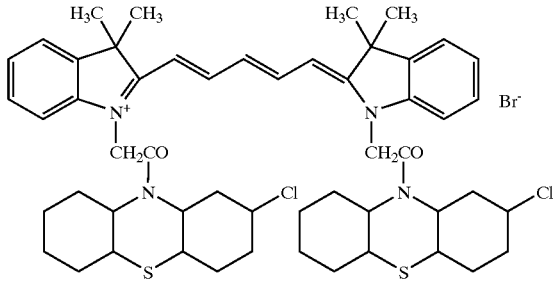

-continued

Blue dye compound 14

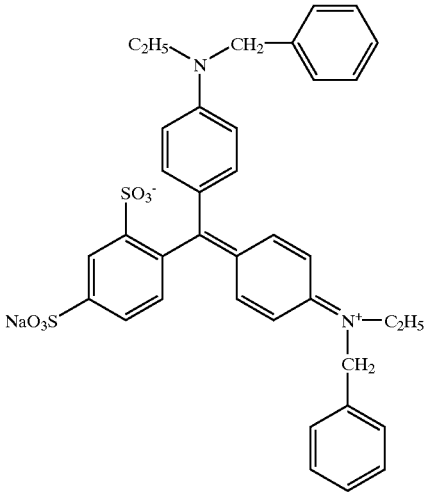

Yellow dye compound 15

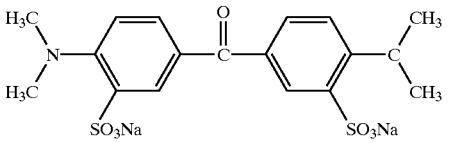

Spectral sensitizing dye A

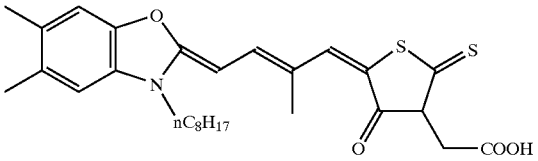

Spectral sensitizing dye B

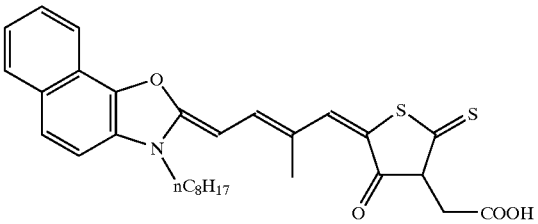

Tellurium sensitizer C

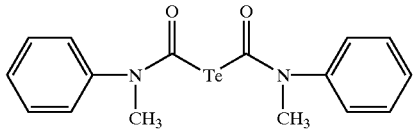

<<Evaluation>>

(Evaluation of Photographic Performance)

Each sample thus fabricated was cut into pieces of a half-size, wrapped with a wrapping material mentioned below at 25° C. and 50% RH, then stored for 2 weeks at room temperature, and assessed according to the tests mentioned below.

(Wrapping Material)

The wrapping material used was a 50 μm-thick polyethylene film containing 10 μm PET/12 μm PE/9 μm aluminum foil/15 μm Ny/3% carbon. Oxygen transmittance was 0 ml/Pa·m$^2$·25° C.·day; and moisture transmittance was 0 g/Pa·m$^2$·25° C.·day.

Using Fuji Medical Dry Laser Imager FM-DP L (equipped with a 660 nm semiconductor laser capable of producing a maximum output of 60 mW (IIIB)), the thermally developable photosensitive material samples fabricated as above were irradiated with laser light, and thermally developed using four panel heaters set at about 112° C., 119° C., 121° C. and 121° C., respectively, for 24 seconds. The images thus formed were analyzed for relative sensitivity (ΔS) and fog density. The data are given in Table 1 below.

(Evaluation of Silver Color Tone Difference in Images)

Using Fuji Medical Dry Laser Imager FM-DP L (equipped with a 660 nm semiconductor laser capable of producing a maximum output of 60 mW (IIIB)), the thermally developable photosensitive material samples were irradiated with laser light and then thermally developed using four panel heaters set at the temperatures varying by +3° C. and −3° C. relative to the standard temperatures 112° C., 119° C., 121° C. and 121° C., respectively, for 24 seconds. The images formed were visually assessed for the silver color tone difference among the samples that have been developed at different temperatures, and were evaluated according to the following criteria. The test results are given in Table 1 below.

<Evaluation>

A: Almost no silver color tone difference depending on the temperature condition found, and good.

B: The silver color tone difference depending on the temperature condition is small, but differentiable.

C: The silver color tone difference depending on the temperature condition is significant, but permissible for practical use.

D: The silver color tone difference depending on the temperature condition is large, and problematic for practical use.

(Evaluation of Dependency of System on Environmental Conditions)

Using Fuji Medical Dry Laser Imager FM-DP L (equipped with a 660 nm semiconductor laser capable of producing a maximum output of 60 mW (IIIB)) placed in a thermo-hygrostat, the thermally developable photosensitive material samples were irradiated with laser light and thermally developed under four different conditions of 32° C. and 70% RH; 32° C. and 10% RH; 13° C. and 70% RH; and 13° C. and 25% RH. The images formed were evaluated for density with a densitometer. Relative to the exposure amount of 1.2 under the conditions at 25° C. and 60% RH, respective samples were actually assessed for the density to compare the difference between the maximum density and the minimum density obtained under the four different conditions. The test results are given in Table 1 below.

TABLE 1

| Thermally developable photosensitive material | Compound of Formula (I) | Compound of Formula (D) | Sensitivity | Fog | Silver Color Tone Difference in Images | Dependency of System on Environmental Conditions | |
|---|---|---|---|---|---|---|---|
| 1 | — | — | 100 | 0.16 | C | 0.15 | comparative sample |
| 2 | Compound (I-1) | — | 215 | 0.15 | B | 0.05 | sample of the present invention |
| 3 | Compound (I-2) | — | 201 | 0.17 | B | 0.06 | sample of the present invention |
| 4 | Compound (I-3) | — | 185 | 0.16 | B | 0.06 | sample of the present invention |
| 5 | — | D-1 | 229 | 0.17 | C | 0.13 | comparative sample |
| 6 | Compound (I-1) | D-1 | 492 | 0.16 | A | 0.03 | sample of the present invention |
| 7 | Compound (I-2) | D-1 | 460 | 0.18 | A | 0.04 | sample of the present invention |
| 8 | Compound (I-3) | D-1 | 423 | 0.17 | A | 0.04 | sample of the present invention |
| 9 | Compound (I-1) | D-12 | 472 | 0.17 | A | 0.03 | sample of the present invention |
| 10 | Compound (I-1) | D-120 | 425 | 0.16 | A | 0.04 | sample of the present invention |

Compound (I-1)

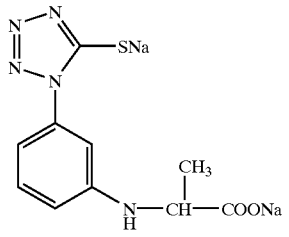

Compound (I-2)

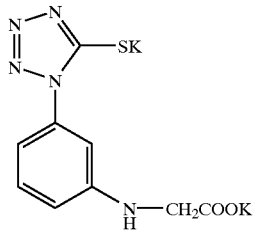

Compound (I-3)

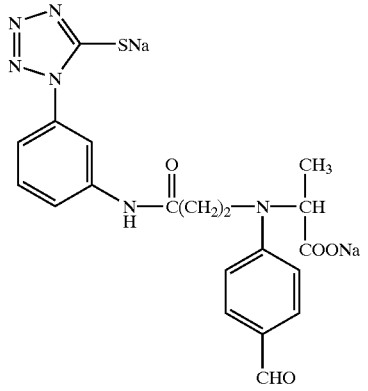

From the results summarized in Table 1, it is revealed that the thermally developable photosensitive material of the present invention containing a compound represented by formula (I) is excellent in the properties of sensitivity, fog, silver color tone and dependency on environmental conditions. In addition, it is also revealed that addition of the compound represented by formula (D) to the material further enhances sensitivity and silver color tone and has reduced dependency on environmental conditions.

As is evident from the foregoing, the thermally developable photosensitive material of the present invention exhibits low fog, good storability, high sensitivity, high Dmax (maximum image density) and excellent silver color tone, and provides an advantageous characteristic of having reduced dependency on temperature and humidity conditions during development.

What is claimed is:

1. A thermally developable photosensitive material comprising a support and an image-forming layer disposed on one surface of the support, the image-forming layer containing a non-photosensitive organic silver salt, a photosensitive silver halide, a reducing agent for reducing silver ions, a binder and a compound represented by the following formula (I), wherein after the material is image-wise exposed and thermally developed at 121° C. for 24 seconds, at least 90% of the developed silver is in contact with the photosensitive silver halide grains after development;

$$(X)_k(L)_m(A—B)_n \qquad \text{Formula (I)}$$

wherein:

X represents a silver halide-adsorbing group or light-absorbing group having at least one atom of N, S, P, Se and Te;

L represents a (k+n)-valent linking group having at least one atom of C, N, S and O;

A represents an electron-donating group, B represents a leaving group or a hydrogen atom, and after the compound represented by formula (I) is oxidized, (A—B) is eliminated, or eliminated and further deprotonated to form a radical A'; and k falls between 0 and 3; m represents 0 or 1; n represents 1 or 2, but m=0 when k=0 and n=1.

2. The thermally developable photosensitive material according to claim 1, wherein the compound represented by formula (I) is a compound having the following chemical structure.

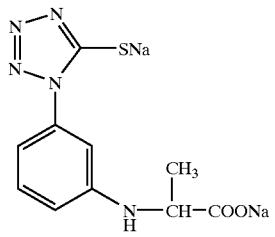

3. The thermally developable photosensitive material according to claim 1, wherein the compound represented by formula (I) is a compound having the following chemical structure.

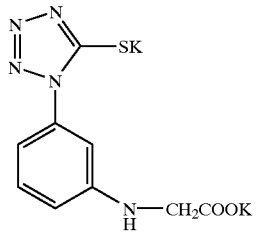

4. The thermally developable photosensitive material according to claim 1, wherein the compound represented by formula (I) is a compound having the following chemical structure.

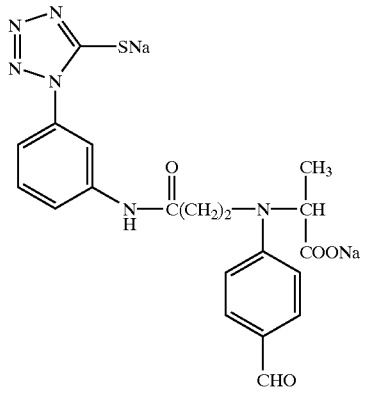

5. The thermally developable photosensitive material according to claim 1, wherein the image-forming layer contains from $1\times10^{-9}$ to $5\times10^{-1}$ mols of the compound represented by formula (I) per mol of the silver halide.

6. The thermally developable photosensitive material according to claim 1, wherein the image-forming layer contains a compound represented by the following formula (D):

$$Q^1—NHNH—Q^2 \qquad \text{Formula (D)}$$

wherein:

$Q^1$ represents an aromatic group or a heterocyclic group whose carbon atom bonds to —NHNH—$Q^2$; and $Q^2$ represents a carbamoyl group, an acyl group, an alkoxycarbonyl group, an aryloxycarbonyl group, a sulfonyl group, or a sulfamoyl group.

7. The thermally developable photosensitive material according to claim 6, wherein $Q^2$ in formula (D) is a carbamoyl group.

8. The thermally developable photosensitive material according to claim 7, wherein the compound represented by formula (D) is a compound having the following chemical structure.

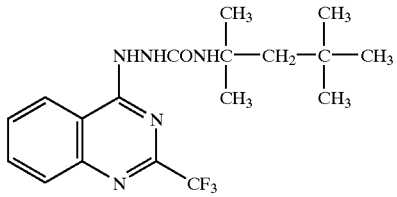

9. The thermally developable photosensitive material according to claim 7, wherein the compound represented by formula (D) is a compound having the following chemical structure.

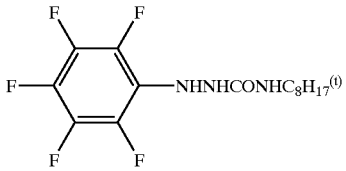

10. The thermally developable photosensitive material according to claim 7, wherein the compound represented by formula (D) is a compound having the following chemical structure;

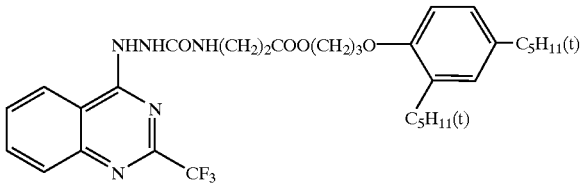

11. The thermally developable photosensitive material according to claim 6, wherein an amount of the compound represented by formula (D) used falls between 0.01 and 100 mol % relative to the reducing agent.

12. The thermally developable photosensitive material according to claim 1, wherein the image-forming layer contains a hydrogen bond-forming compound.

13. The thermally developable photosensitive material according to claim 12, wherein the hydrogen bond-forming compound is a compound represented by the following formula (II):

Formula (II)

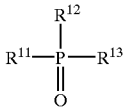

wherein:

$R^{11}$, $R^{12}$ and $R^{13}$ each independently represent an alkyl group, an aryl group, an alkoxy group, an aryloxy group, an amino group or a heterocyclic group, which groups may be unsubstituted or substituted, and any two of $R^{11}$, $R^{12}$ and $R^{13}$ may be bonded to each other to form a ring.

14. The thermally developable photosensitive material according to claim 12, wherein an amount of the hydrogen bond-forming compound used falls between 1 and 200 mol % relative to the reducing agent.

15. The thermally developable photosensitive material according to claim 1, wherein the image-forming layer contains an organic acid silver salt which includes silver behenate at a content of at least 75 mol %.

16. The thermally developable photosensitive material according to claim 1, wherein the image-forming layer contains as an anti-fogging agent an organic polyhalogen compound represented by the following formula (III):

$$Q—(Y)n—C(Z^1)(Z^2)X \qquad \text{Formula (III)}$$

wherein:

Q represents an optionally-substituted alkyl, aryl or heterocyclic group;

Y represents a divalent linking group;

n represents 0 or 1;

$Z^1$ and $Z^2$ each represent a halogen atom; and

X represents a hydrogen atom or an electron-attracting group.

17. The thermally developable photosensitive material according to claim 16, wherein an amount of the anti-fogging agent used falls between $10^{-4}$ and 1 mol per mol of non-photosensitive silver salts present in the image-forming layer.

18. The thermally developable photosensitive material according to claim 1, which contains a mercapto compound as a development regulator.

19. The thermally developable photosensitive material according to claim 1, which contains phthalazines or phthalazinones as a toning agent.

20. The thermally developable photosensitive material according to claim 1, wherein the non-photosensitive layer contains a thermally decolorable dye and a base precursor for antihalation.

* * * * *